US007971451B2

(12) United States Patent
Yabu et al.

(10) Patent No.: US 7,971,451 B2
(45) Date of Patent: Jul. 5, 2011

(54) AIR CONDITIONER

(75) Inventors: Tomohiro Yabu, Osaka (JP); Hiromune Matsuoka, Osaka (JP); Norihiro Takenaka, Osaka (JP); Tetsuya Morizane, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 474 days.

(21) Appl. No.: 12/095,286

(22) PCT Filed: Dec. 6, 2006

(86) PCT No.: PCT/JP2006/324332

§ 371 (c)(1),
(2), (4) Date: May 28, 2008

(87) PCT Pub. No.: WO2007/069507

PCT Pub. Date: Jun. 21, 2007

(65) Prior Publication Data

US 2009/0211284 A1 Aug. 27, 2009

(30) Foreign Application Priority Data

Dec. 12, 2005 (JP) ..... 2005-357621
Jul. 31, 2006 (JP) ..... 2006-207859
Oct. 4, 2006 (JP) ..... 2006-273435

(51) Int. Cl.
*F25D 17/06* (2006.01)

(52) U.S. Cl. ..... 62/419; 62/426

(58) Field of Classification Search ..... 62/426, 62/259.1, DIG. 16, 419, 407, 263; 454/233, 454/292, 299; 165/53, 55, 59
See application file for complete search history.

(56) References Cited

U.S. PATENT DOCUMENTS

| | | | | |
|---|---|---|---|---|
| 3,766,750 | A * | 10/1973 | Aoh et al. | 62/259.1 |
| 6,260,375 | B1 * | 7/2001 | Kuo | 62/407 |
| 6,282,912 | B1 * | 9/2001 | Mannerheim | 62/244 |
| 6,345,667 | B1 * | 2/2002 | Hata et al. | 165/200 |
| 6,470,699 | B1 * | 10/2002 | Okuda et al. | 62/259.2 |
| 6,554,059 | B2 * | 4/2003 | Hata et al. | 165/53 |
| 6,698,220 | B2 * | 3/2004 | Yoneno et al. | 62/184 |
| 6,780,097 | B2 * | 8/2004 | Shuttleworth et al. | 454/136 |
| 6,802,361 | B2 * | 10/2004 | Hatanaka | 165/53 |
| 7,392,821 | B2 * | 7/2008 | Nakata et al. | 137/312 |
| 2004/0172962 | A9 * | 9/2004 | Kosugi et al. | 62/285 |
| 2004/0200607 | A1 * | 10/2004 | Rehberg | 165/167 |

FOREIGN PATENT DOCUMENTS

| | | | |
|---|---|---|---|
| JP | S49-150129 | U | 4/1973 |
| JP | S52-075846 | A | 6/1977 |
| JP | S62-127418 | U | 8/1987 |
| JP | S62-127419 | U | 8/1987 |
| JP | S62-201318 | U | 12/1987 |
| JP | S63-188425 | U | 12/1988 |
| JP | H02-008636 | A | 1/1990 |
| JP | H02-272232 | A | 11/1990 |
| JP | H03-027526 | U | 3/1991 |

(Continued)

*Primary Examiner* — Mohammad Ali
(74) *Attorney, Agent, or Firm* — Global IP Counselors

(57) ABSTRACT

An air conditioner is installable in a ceiling of an air-conditioned room and is disposed with a casing in whose top surface is formed a suction opening and in whose bottom surface are formed blowout openings, and in which is formed an air flow path that leads from the suction opening to the blowout openings, a blow fan that is disposed in the air flow path, and a heat exchanger that is disposed in the air flow path.

31 Claims, 44 Drawing Sheets

FOREIGN PATENT DOCUMENTS

| | | | |
|---|---|---|---|
| JP | H04-263715 | A | 9/1992 |
| JP | H05-040727 | U | 6/1993 |
| JP | H07-275626 | A | 10/1995 |
| JP | H10-185294 | A | 7/1998 |
| JP | 10-238802 | A | 9/1998 |
| JP | H11-226331 | A | 8/1999 |
| JP | 2000-097446 | A | 4/2000 |
| JP | 2000-213766 | A | 8/2000 |
| JP | 2004-156794 | A | 6/2004 |
| JP | 2005-282950 | A | 10/2005 |
| JP | 2005-282956 | A | 10/2005 |
| JP | 2005-308274 | A | 11/2005 |

* cited by examiner

AIR CONDITIONER

CROSS-REFERENCE TO RELATED APPLICATIONS

This U.S. National stage application claims priority under 35 U.S.C. §119(a) to Japanese Patent Application Nos. 2005-357621, filed in Japan on Dec. 12, 2005, 2006-207859, filed in Japan on Jul. 31, 2006 and 2006-273435, filed in Japan on Oct. 4, 2006, the entire contents of which are hereby incorporated herein by reference.

TECHNICAL FIELD

The present invention relates to an air conditioner and particularly to a ceiling-mounted air conditioner where a blowout opening is disposed in a bottom surface of a casing.

BACKGROUND ART

As a conventional ceiling-mounted air conditioner, there is an air conditioner disposed with a casing in whose bottom surface a suction opening and a blowout opening are formed and a blow fan and a heat exchanger that are disposed inside the casing.

SUMMARY OF THE INVENTION

However, there has been the problem that, when both the suction opening and the blowout opening are formed in the bottom surface, it is easy for a phenomenon (called "short circuiting of air flow" below) to occur where air that is blown out from the blowout opening ends up being sucked back inside the casing from the suction opening immediately after being blown out, and indoor comfort is impaired.

It is an object of the present invention to make it more difficult for short circuiting of air flow to occur in a ceiling-mounted air conditioner where a blowout opening is disposed in a bottom surface of a casing.

An air conditioner pertaining to a first aspect of the present invention is an air conditioner that is installable in a ceiling of an air-conditioned room and comprises: a casing in whose top surface is formed a suction opening and in whose bottom surface are formed blowout openings, and in which is formed an air flow path that leads from the suction opening to the blowout openings; a blow fan that is disposed in the air flow path; and a heat exchanger that is disposed in the air flow path.

In this air conditioner, it can be made difficult for short circuiting of air flow to occur because the air conditioner is configured such that air is sucked in from the top surface of the casing and air is blown out from the bottom surface of the casing. Further, when the air conditioner is used in a ceiling-embedded configuration, the suction opening is disposed in a space on the backside of a ceiling, and the blowout openings are disposed in an indoor space, so a ceiling chamber air conditioner that uses the space on the backside of the ceiling as an air supply chamber can be configured. Moreover, because the suction opening is not present in the bottom surface of the casing, a ceiling-embedded configuration can be configured simply by attaching a thin panel, in which are formed just blowout openings, to the bottom surface of the casing.

An air conditioner pertaining to a second aspect of the present invention is an air conditioner that is installable in a ceiling of an air-conditioned room and comprises: a casing in whose side surface is formed a suction opening and in whose bottom surface are formed blowout openings, and in which is formed an air flow path that leads from the suction opening to the blowout openings; a blow fan that is disposed in the air flow path; and a heat exchanger that is disposed in the air flow path.

In this air conditioner, it can be made difficult for short circuiting of air flow to occur because the air conditioner is configured such that air is sucked in from the side surface of the casing and air is blown out from the bottom surface of the casing. Further, when the air conditioner is used in a ceiling-embedded configuration, the suction opening is disposed in a space on the backside of a ceiling, and the blowout openings are disposed in an indoor space, so a ceiling chamber air conditioner that uses the space on the backside of the ceiling as an air supply chamber can be configured. Moreover, because the suction opening is not present in the bottom surface of the casing, a ceiling-embedded configuration can be configured simply by attaching a thin panel, in which are formed just blowout openings, to the bottom surface of the casing.

An air conditioner pertaining to a third aspect of the present invention comprises the air conditioner pertaining to the first or second aspect of the present invention, and further comprises a blowout panel that is attached to the bottom surface of the casing and in which are formed panel blowout openings that face the blowout openings. When the ceiling is a grid system ceiling, the blowout panel is capable of being housed inside a frame of the grid system ceiling.

In this air conditioner, the blowout panel can be installed so as to become substantially flat with the ceiling surface because the blowout panel is capable of being housed inside a frame of the grid system ceiling.

An air conditioner pertaining to a fourth aspect of the present invention comprises the air conditioner pertaining to any of the first to third aspects of the present invention, wherein the blow fan is a turbo fan, and the heat exchanger is disposed on a downstream side of the blow fan in the air flow space.

In this air conditioner, a turbo fan is used as the blow fan, and the heat exchanger is disposed on the downstream side of the blow fan, so an air flow path through which air that flows inside the casing flows generally downward can be formed, and a situation where an air flow path that folds back in a vertical direction is formed inside the casing can be avoided. Thus, ventilation resistance of air that flows in the air flow path can be reduced, and compaction of the height direction dimension of the casing can be realized.

An air conditioner pertaining to a fifth aspect of the present invention comprises the air conditioner pertaining to any of the first to third aspects of the present invention, wherein the blow fan is a diagonal flow fan, and the heat exchanger is disposed on a downstream side of the blow fan in the air flow space.

In this air conditioner, a diagonal flow fan is used as the blow fan, and the heat exchanger is disposed on the downstream side of the blow fan, so an air flow path through which air that flows inside the casing flows generally downward can be formed, and a situation where an air flow path that folds back in a vertical direction is formed inside the casing can be avoided. Thus, ventilation resistance of air that flows in the air flow path can be reduced, and compaction of the height direction dimension of the casing can be realized.

An air conditioner pertaining to a sixth aspect of the present invention comprises the air conditioner pertaining to the fourth or fifth aspect of the present invention, wherein the heat exchanger is plurally disposed on an outer peripheral side of the blow fan when the casing is seen in a plan view.

In this air conditioner, the heat exchanger is plurally disposed on an outer peripheral side of the blow fan when the casing is seen in a plan view, so compaction of the height direction dimension of the casing can be promoted.

An air conditioner pertaining to a seventh aspect of the present invention comprises the air conditioner pertaining to the sixth aspect of the present invention, wherein the heat exchangers are slantingly disposed when the casing is seen in a side view.

In this air conditioner, the heat exchangers are slantingly disposed when the casing is seen in a side view, so compaction of the height direction dimension of the casing can be further promoted and the heat transfer area of the heat exchangers can be enlarged.

An air conditioner pertaining to an eighth aspect of the present invention comprises the air conditioner pertaining to any of the first to third aspects of the present invention, wherein the heat exchanger is disposed on an upstream side of the blow fan in the air flow path.

In this air conditioner, the heat exchanger is disposed on the upstream side of the blow fan, whereby the heat exchanger can be disposed substantially flatly, so the heat transfer area of the heat exchanger of the overall device can be enlarged.

An air conditioner pertaining to a ninth aspect of the present invention comprises the air conditioner pertaining to the first or second aspect of the present invention, wherein the blowout openings are formed along an outer peripheral edge of the bottom surface of the casing, the air flow path includes a blowout flow path through which air that has passed through the heat exchanger flows toward the blowout openings, and an expanded flow path that expands toward an inner peripheral side when the casing is seen in a plan view is formed in the blowout flow path.

In this air conditioner, the blowout openings are formed along the outer peripheral edge of the bottom surface of the casing, and the expanded flow path that expands toward the inner peripheral side when the casing is seen in a plan view is formed in the blowout flow path, so drafts can be controlled and silencing can be achieved when air is blown out into the air-conditioned room from the blowout openings. In particular, in this air conditioner, the suction opening is formed in the top surface or the side surface of the casing, so it becomes possible to enlarge the expanded flow path in comparison to a conventional air conditioner of a configuration where the suction opening is formed on the inner peripheral side of the blowout opening, and thus the effects of control of drafts and silencing when air is blown out into the air-conditioned room from the blowout openings can be sufficiently obtained.

An air conditioner pertaining to a tenth aspect of the present invention is an air conditioner that is installable in a ceiling of an air-conditioned room and comprises: a casing in whose top surface or side surface is formed a suction opening; a blow fan that is disposed inside the casing; a heat exchanger that is disposed inside the casing; and a blowout panel. The blowout panel is attached to a bottom surface of the casing, and panel blowout openings are formed therein along an outer peripheral edge of the bottom surface of the casing. Additionally, air that is sucked in from the suction opening passes through an air flow path that leads from the suction opening to the panel blowout openings and is blown out from the panel blowout openings, the air flow path includes a blowout flow path through which air that has passed through the heat exchanger flows toward the panel blowout openings, and an expanded flow path that expands toward an inner peripheral side when the casing is seen in a plan view is formed in the blowout flow path.

In this air conditioner, it can be made difficult for short circuiting of air flow to occur because the air conditioner is configured such that air is sucked in from the top surface or the side surface of the casing and air is blown out from the panel blowout openings in the blowout panel that is attached to the bottom surface of the casing. Further, when the air conditioner is used in a ceiling-embedded configuration, the suction opening is disposed in a space on the backside of a ceiling, and the panel blowout openings are disposed in an indoor space, so a ceiling chamber air conditioner that uses the space on the backside of the ceiling as an air supply chamber can be configured. Moreover, the panel blowout openings are formed along the outer peripheral edge of the bottom surface of the casing, and the expanded flow path that expands toward the inner peripheral side when the casing is seen in a plan view is formed in the blowout flow path, so drafts can be controlled and silencing can be achieved when air is blown out into the air-conditioned room from the panel blowout openings. In particular, in this air conditioner, the suction opening is formed in the top surface or the side surface of the casing, so it becomes possible to enlarge the expanded flow path in comparison to a conventional air conditioner of a configuration where the suction opening is formed on the inner peripheral side of the panel blowout opening, and thus the effects of control of drafts and silencing when air is blown out into the air-conditioned room from the panel blowout openings can be sufficiently obtained.

An air conditioner pertaining to an eleventh aspect of the present invention comprises the air conditioner pertaining to the tenth aspect of the present invention, wherein when the ceiling is a grid system ceiling, the blowout panel is capable of being housed inside a frame of the grid system ceiling.

In this air conditioner, the blowout panel can be installed so as to become substantially flat with the ceiling surface because the blowout panel is capable of being housed inside a frame of the grid system ceiling.

An air conditioner pertaining to a twelfth aspect of the present invention comprises the air conditioner pertaining to the tenth or eleventh aspect of the present invention, wherein the expanded flow path is formed in a bottom portion of the casing.

In this air conditioner, an increase in the height direction dimension of the blowout panel can be prevented because the expanded flow path is formed in the bottom portion of the casing.

An air conditioner pertaining to a thirteenth aspect of the present invention comprises the air conditioner pertaining to the tenth or eleventh aspect of the present invention, wherein the expanded flow path is formed in the blowout panel.

In this air conditioner, an increase in the height direction dimension of the casing can be prevented because the expanded flow path is formed in the blowout panel.

An air conditioner pertaining to a fourteenth aspect of the present invention comprises the air conditioner pertaining to any of the ninth to thirteenth aspects of the present invention, and further comprises a flow path area changing mechanism for changing a flow path area of the expanded flow path.

In this air conditioner, the air conditioner further comprises the flow path area changing mechanism for changing the flow path area of the expanded flow path, so by changing the flow path area of the expanded flow path such that the flow path area of the expanded flow path becomes smaller, air that is blown out from the blowout openings or the panel blowout openings can be caused to reach a place away from the blowout openings or the panel blowout openings.

An air conditioner pertaining to a fifteenth aspect of the present invention comprises the air conditioner pertaining to the fourteenth aspect of the present invention, wherein the flow path area changing mechanism is controlled such that the flow path area of the expanded flow path becomes large during cooling operation and such that the flow path area of the expanded flow path becomes small during heating operation.

In this conditioner, the flow path area changing mechanism is controlled such that the flow path area of the expanded flow path becomes large during cooling operation, so cold drafts can be controlled and silencing can be achieved, and the flow path area changing mechanism is controlled such that the flow path area of the expanded flow path becomes small during heating operation, so warm air that is blown out from the blowout openings or the panel blowout openings can be caused to reach the lower portion of the air-conditioned room.

An air conditioner pertaining to a sixteenth aspect of the present invention comprises the air conditioner pertaining to the second or third aspect of the present invention, wherein the blow fan is a sirocco fan, and the heat exchanger is disposed closer to the suction opening or the blowout openings than the blow fan in the air flow space.

In this air conditioner, a stacked heat exchanger is employed as the heat exchanger, heat exchange efficiency is high and compaction is possible, so the height direction dimension of the casing can be made compact.

An air conditioner pertaining to a seventeenth aspect of the present invention comprises the air conditioner pertaining to any of the first to sixteenth aspects of the present invention, wherein the heat exchanger is a stacked heat exchanger.

An air conditioner pertaining to an eighteenth aspect of the present invention comprises the air conditioner pertaining to any of the first to seventeenth aspects of the present invention, wherein a heat medium used in the heat exchanger is water.

In this air conditioner, the filter guide portion that holds the filter such that the filter is movable between the suction opening and the bottom surface of the casing is disposed in the casing, so the filter can be easily attached and detached during cleaning even though the air conditioner has a configuration where the suction opening is disposed in the top surface or the side surface of the casing.

An air conditioner pertaining to a nineteenth aspect of the present invention comprises the air conditioner pertaining to any of the first to eighteenth aspects of the present invention, wherein a filter is disposed in the suction opening, and a filter guide portion that holds the filter such that the filter is movable between the suction opening and the bottom surface of the casing is disposed in the casing.

An air conditioner pertaining to a twentieth aspect of the present invention comprises the air conditioner pertaining to the nineteenth aspect of the present invention, wherein a filter drive mechanism for automatically causing the filter to move downward through the filter guide portion is disposed in the casing.

In this air conditioner, the filter drive mechanism for automatically causing the filter to move downward is disposed, so the filter can be lowered while work in a high place is avoided.

An air conditioner pertaining to a twenty-first aspect of the present invention comprises the air conditioner pertaining to the nineteenth aspect of the present invention, wherein a filter drive mechanism for manually causing the filter to move downward through the filter guide portion is disposed in the casing.

In this air conditioner, the filter drive mechanism for manually causing the filter to move downward is disposed, so the filter can be lowered while work in a high place is avoided.

An air conditioner pertaining to a twenty-second aspect of the present invention comprises the air conditioner pertaining to any of the first to eighteenth aspects of the present invention inventions, wherein a filter is disposed in the suction opening, and the air conditioner further comprises a cleaning mechanism that removes dust that the filter has trapped from the filter and a dust box that collects dust removed by the cleaning mechanism.

In this air conditioner, the cleaning mechanism for cleaning the filter that is disposed in the suction opening is disposed, so dust can be removed from the filter without having to remove the filter from the suction opening, and dust that has been removed by the cleaning mechanism can be collected in the dust box. Thus, in this air conditioner, labor required to clean the filter that is disposed in the suction opening can be reduced.

An air conditioner pertaining to a twenty-third aspect of the present invention comprises the air conditioner pertaining to the twenty-second aspect of the present invention, wherein a dust box drive mechanism for automatically causing the dust box to move downward is disposed in the casing.

In this air conditioner, the dust box drive mechanism for automatically causing the dust box in which dust has been collected to move downward is disposed, so the dust box can be lowered while work in a high place is avoided.

An air conditioner pertaining to a twenty-fourth aspect of the present invention comprises the air conditioner pertaining to the twenty-second aspect of the present invention, wherein a dust box drive mechanism for manually causing the dust box to move downward is disposed in the casing.

In this air conditioner, the dust box drive mechanism for manually causing the dust box in which dust has been collected to move downward is disposed, so the dust box can be lowered while work in a high place is avoided.

An air conditioner pertaining to a twenty-fifth aspect of the present invention comprises the air conditioner pertaining to the twenty-second aspect of the present invention, wherein a nozzle insertion opening, into which a nozzle of a vacuum cleaner is capable of being inserted, is formed facing down in the dust box.

In this air conditioner, the nozzle insertion opening, into which a nozzle of a vacuum cleaner is capable of being inserted, is formed facing down in the dust box, so dust that has been collected in the dust box can be sucked into the vacuum cleaner from the inside of the dust box and removed by the simple work of inserting the nozzle of the vacuum cleaner into the nozzle insertion opening from the underside of the air conditioner. Thus, in this air conditioner, labor required to clean the filter can be further reduced.

An air conditioner pertaining to a twenty-sixth aspect of the present invention comprises the air conditioner pertaining to the twenty-fifth aspect of the present invention, wherein open/close lid that opens as a result of a nozzle of a vacuum cleaner being inserted into the nozzle insertion opening is disposed in the nozzle insertion opening.

In this air conditioner, the open/close lid that opens as a result of a nozzle of a vacuum cleaner being inserted into the nozzle insertion opening is disposed in the nozzle insertion opening, so until the work of sucking dust that has been collected in the dust box with the vacuum cleaner is performed, dust that been collected in the dust box by the cleaning mechanism can be prevented from dropping out from the nozzle insertion opening, and work in a high place for opening the open/close lid can be avoided.

An air conditioner pertaining to a twenty-seventh aspect of the present invention comprises the air conditioner pertaining to the twenty-sixth aspect of the present invention, wherein the open/close lid closes by their own weight.

In this air conditioner, the open/close lid closes by their own weight, so the open/close lid can be closed by removing the nozzle of the vacuum cleaner from the nozzle insertion opening.

An air conditioner pertaining to a twenty-eighth aspect of the present invention comprises the air conditioner pertaining to any of the twenty-fifth to twenty-seventh aspect of the present invention, wherein a valve that comprises a material that is elastically deformable by suction force of a vacuum cleaner is disposed in the dust box.

In this air conditioner, the valve that comprises a material that is elastically deformable by suction force of a vacuum cleaner is disposed in the dust box, so dust that has been collected in the dust box by the cleaning mechanism can be prevented from dropping out from the nozzle insertion opening, and the work of sucking dust that has been collected in the dust box into the vacuum cleaner from the inside of the dust box and removing the dust can be performed easily.

An air conditioner pertaining to a twenty-ninth aspect of the present invention comprises the air conditioner pertaining to any of the twenty-second to twenty-eighth aspects of the present invention, wherein the dust box is disposed in a side portion of the casing.

An air conditioner pertaining to a thirtieth aspect of the present invention comprises the air conditioner pertaining to any of the first to eighteenth aspects of the present invention, wherein a take-up filter is disposed in the suction opening.

In this air conditioner, the take-up filter is disposed in the suction opening, so it is not necessary to clean the filter, and it suffices for the take-up filter to be replaced with a new take-up filter just when the taking-up of the filter ends, so effort to clean the filter can be spared.

An air conditioner pertaining to a thirty-first aspect of the present invention comprises the air conditioner pertaining to the first or second aspect of the present invention, and further comprises filters that trap dust included in air that is sucked in from the suction opening, wherein the heat exchanger is disposed on a downstream side of the blow fan in the air flow space, and the filters are disposed between the blow fan and the heat exchanger.

In this air conditioner, the filters are disposed between the blow fan and the heat exchanger, so the filters can be taken out from the bottom surface of the casing by removing part of the bottom surface of the casing, for example. Thus, in this air conditioner, maintenance of the filters can be performed easily even though the suction opening is formed in the top surface or the side surface of the casing.

An air conditioner pertaining to a thirty-second aspect of the present invention comprises the air conditioner pertaining to the thirty-first aspect of the present invention, and further comprises a blowout panel that is attached to the bottom surface of the casing and in which are formed panel blowout openings that face the blowout openings, wherein when at least part of the blowout panel is removed from the casing, the filters are capable of being taken out through the bottom surface of the casing in conjunction with the removal of the at least part of the blowout panel.

In this air conditioner, when at least part of the blowout panel that is attached to the bottom surface of the casing is removed from the casing, the filters can be taken out in conjunction with the removal of the at least part of the blowout panel, so maintenance of the filters can be performed easily even though the air conditioner is used in a ceiling-embedded configuration.

An air conditioner pertaining to a thirty-third aspect of the present invention comprises the air conditioner pertaining to the thirty-second aspect of the present invention, wherein the at least part of the blowout panel is automatically raisable and lowerable, and the filters are raised and lowered in conjunction with the raising and lowering of the at least part of the blowout panel.

In this air conditioner, when the air conditioner is used in a ceiling-embedded configuration by attaching the blowout panel to the bottom surface of the casing, the at least part of the blowout panel is automatically raisable and lowerable, and the filters are raised and lowered in conjunction with the raising and lowering of the at least part of the blowout panel, so the filters can be lowered while work in a high place is avoided.

DETAILED DESCRIPTION OF THE INVENTION

Below, embodiments of a ceiling-mounted air conditioner pertaining to the present invention will be described on the basis of the drawings.

First Embodiment (1) Basic Configuration of Ceiling-mounted Air Conditioner

Figure 1:
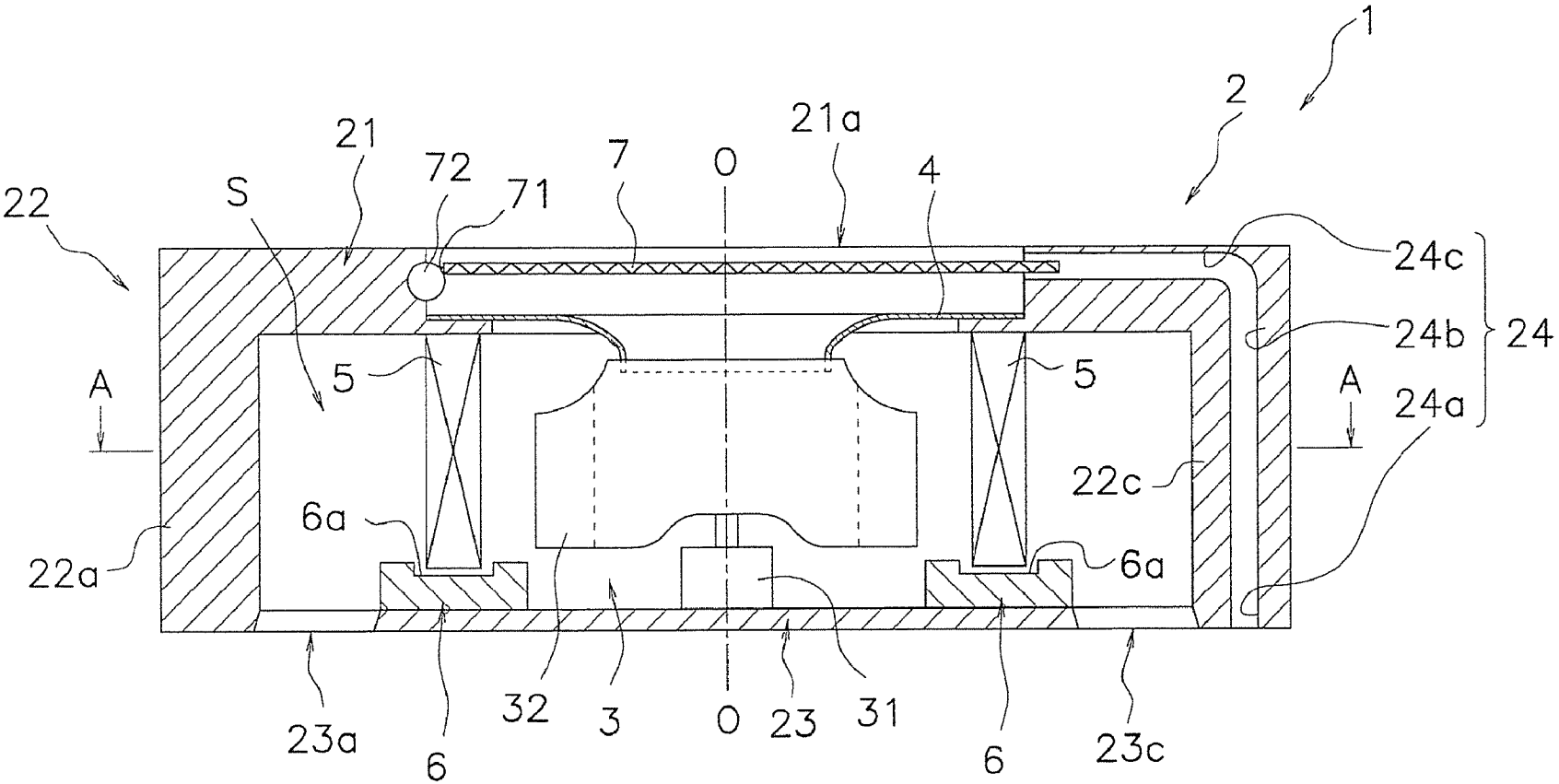
FIG. 1 is a general side sectional view (with a ceiling being omitted) of a ceiling-mounted air conditioner pertaining to a first embodiment of the present invention.
Figure 2:
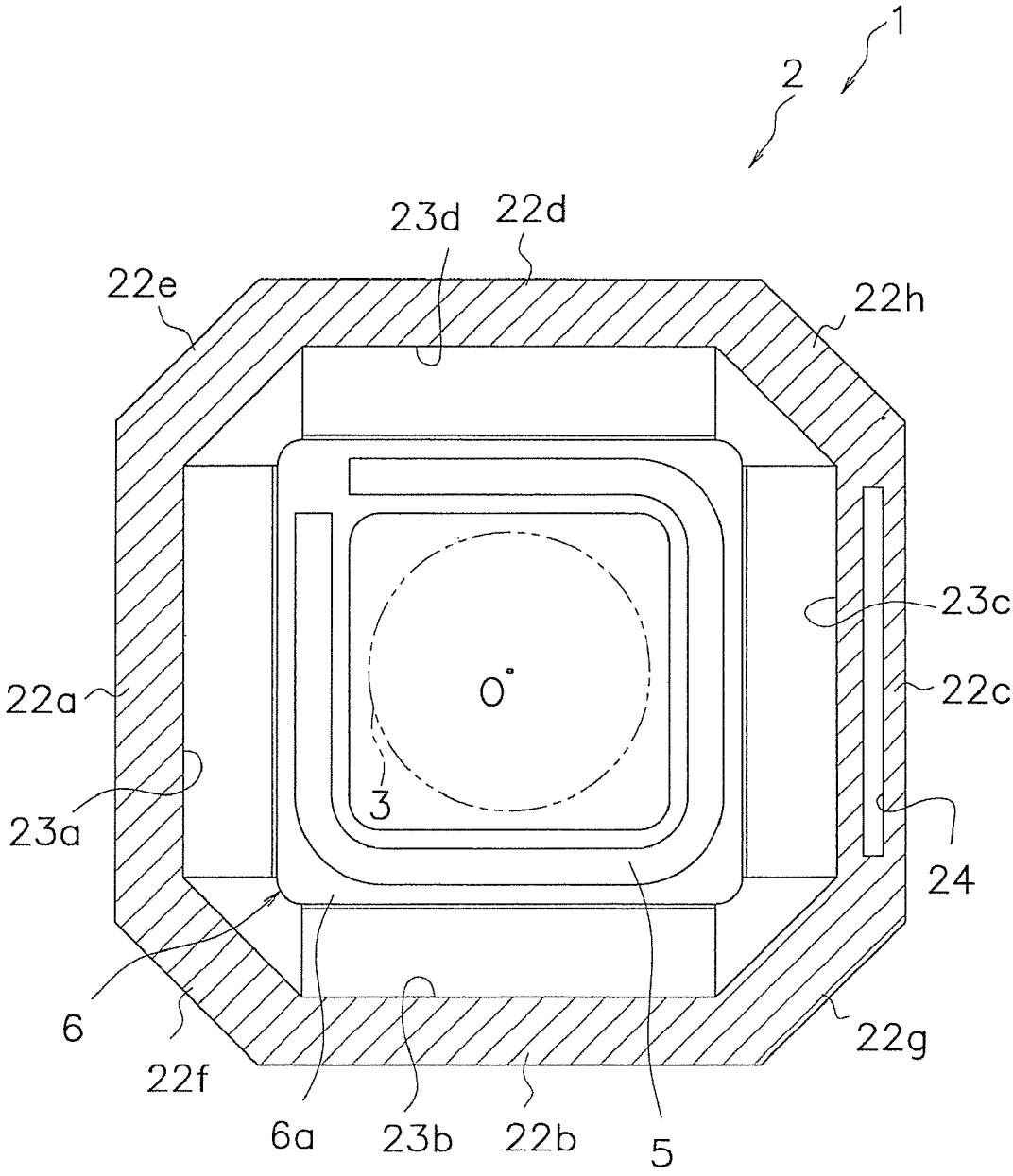
FIG. 2 is a cross-sectional view along A-A of FIG. 1.

FIG. 1 shows a general side sectional view (with a ceiling being omitted) of a ceiling-mounted air conditioner 1 pertaining to a first embodiment of the present invention, and FIG. 2 shows a cross-sectional view along A-A of FIG. 1. The air conditioner 1 is capable of corresponding to both a ceiling-embedded configuration and a ceiling-suspended configuration, and is mainly disposed with a casing 2 that houses various types of configural devices inside. It will be noted that O in the drawings represents an axis-of-rotation line or a rotational center of a blow fan 3.

In the present embodiment, the casing 2 is a box-like member whose shape when seen in a plan view is substantially octagonal, and the casing 2 mainly includes a substantially octagonal top plate 21 whose long sides and short sides are formed so as to be alternately continuous, a side plate 22 that extends downward from the peripheral edge portion of the top plate 21, and a bottom plate 23 that covers an opening formed by the bottom end portion of the side plate 22.

A suction opening 21*a* is formed in the substantial center of the top plate 21 when the casing 2 is seen in a plan view.

The side plate 22 is configured by side plates 22*a*, 22*b*, 22*c* and 22*d* that correspond to the long sides of the top plate 21 and side plates 22*e*, 22*f*, 22*g* and 22*h* that correspond to the short sides of the top plate 21. Here, for example, the side plate 22*d* and the side plate 22*a* are disposed so as to be substantially orthogonal to each other with the side plate 22*e* being interposed therebetween. The other side plates 22*a* and 22*b*, the side plates 22*b* and 22*c*, and the side plates 22*c* and 22*d* are, similar to the side plates 22*d* and 22*a*, disposed so as to be substantially orthogonal to each other. Further, fixing brackets (not shown) that are used when the casing 2 is installed in a space on the backside of a ceiling in a ceiling-embedded configuration or when the casing 2 is installed in a ceiling-suspended configuration inside an air-conditioned room are disposed on each of the side plates 22*e*, 22*f*, 22*g* and 22*h*.

The bottom plate 23 is, similar to the top plate 21, a substantially octagonal plate-like member, and four blowout openings 23*a*, 23*b*, 23*c* and 23*d* are formed in the bottom plate 23 along the long sides of the bottom plate 23 (that is, the side plates 22*a*, 22*b*, 22*c* and 22*d*) when the casing 2 is seen in a plan view. The blowout openings 23*a*, 23*b*, 23*c* and 23*d* are long and narrow substantially rectangular openings that extend horizontally along the long sides of the bottom plate 23.

Further, a long and narrow substantially rectangular guide opening 24*a* is formed between one of the blowout openings (here, the blowout opening 23*c*) in the bottom plate 23 and the long side that corresponds to this blowout opening 23*c* such that the guide opening 24*a* is along the blowout opening 23*c* and the long side that corresponds to the blowout opening 23*c*, and the guide opening 24*a* extends upward and reaches as far as the bottom end of the side plate 22*c*. Additionally, a guide opening 24*b* that is communicated with the guide opening 24*a* is formed in the side plate 22*c*, and the guide opening 24*b* extends upward and reaches as far as the bottom end of the top plate 21. The guide opening 24*b* is, similar to the guide opening 24*a*, a long and narrow substantially rectangular opening. Additionally, a guide opening 24*c* that is communicated with the guide opening 24*b* is formed in the top plate 21, and the guide opening 24*c* extends upward as far as the vicinity of the top end of the top plate 21, thereafter extends horizontally toward the portion of the peripheral edge portion of the suction opening 21*a* that is near the side plate 22*c*, and penetrates to the suction opening 21*a*. The guide opening 24*c* is, similar to the guide opening 24*b*, a long and narrow substantially rectangular opening. In this manner, a guide opening 24 that is configured by the guide openings 24*a*, 24*b* and 24*c* and penetrates from the bottom surface (specifically, the bottom plate 23) to the suction opening 21*a* in the top surface (specifically, the top plate 21) is formed in the casing 2. It will be noted that the guide opening 24 functions as a filter guide portion that holds a later-described filter 7 such that the filter 7 is movable between the suction opening 21*a* and the bottom surface (that is, the bottom plate 23) of the casing 2.

A blow fan 3 is disposed inside the casing 2 so as to face the suction opening 21*a* and such that its axis-of-rotation line O-O extends in a vertical direction. In the present embodiment, the blow fan 3 comprises a turbo fan and includes a fan motor 31, which is disposed in a position on the bottom plate 23 of the casing 2 that faces the suction opening 21*a*, and an impeller 32, which is coupled to and driven to rotate by the fan motor 31. Further, a bellmouth 4 that has a shape that broadens upward from the vicinity of the distal end of the impeller 32 on the suction opening 21*a* side is disposed in the suction opening 21*a*.

Further, a substantially rectangular annular heat exchanger 5 is disposed inside the casing 2 so as to surround the outer peripheral portion of the blow fan 3 when the casing 2 is seen in a plan view. In the present embodiment, the heat exchanger 5 is a cross fin heat exchanger panel that includes numerous fins that are made of aluminum and formed in substantially rectangular shapes and heat transfer tubes that penetrate these fins in a horizontal direction, and the heat exchanger 5 is formed in a substantially rectangular annular shape as a result of multiple stage bending work being administered thereto. The heat exchanger 5 is connected via a refrigerant pipe to a heat source unit (not shown) that is installed outdoors, and the heat exchanger 5 is configured such that it can function as an evaporator of refrigerant (e.g., fluorocarbon) that flows inside during cooling operation and as a condenser of refrigerant (e.g., fluorocarbon) that flows inside during heating operation. Thus, the heat exchanger 5 can perform heat exchange with air that has been sucked inside the casing 2 through the suction opening 21*a* by the blow fan 3, can cool the air during cooling operation, and can heat the air during heating operation. It will be noted that, in addition to refrigerant such as fluorocarbon, water or brine can also be used as the heat medium of the heat exchanger 5. A drain pan 6 for receiving drain water that arises as a result of moisture in the air being condensed in the heat exchanger 5 is disposed below the heat exchanger 5. The drain pan 6 is attached to the bottom surface (that is, the bottom plate 23) of the casing 2. It will be noted that a drain receiving portion 6*a* is formed in a position in the drain pan 6 that faces the bottom portion of the heat exchanger 5.

As mentioned above, in the air conditioner 1 of the present embodiment, the suction opening 21*a* is formed in the top surface (that is, the top plate 21) of the casing 2, the blowout openings 23*a*, 23*b*, 23*c* and 23*d* are formed in the bottom surface (that is, the bottom plate 23) of the casing 2, and an air flow path S that leads from the suction opening 21*a* to the blowout openings 23*a*, 23*b*, 23*c* and 23*d* is formed inside the casing 2. Additionally, the blow fan 3 that comprises a turbo fan and the heat exchanger 5 are housed in this air flow path S, and the heat exchanger 5 is disposed on a downstream side of the blow fan 3 in the air flow path S. Thus, the air flow path S is a flow path through which air that flows inside the casing 2 flows generally downward.

In the air conditioner 1 configured in this manner, a cooling medium or a heating medium is caused to circulate in the heat exchanger 5 and the blow fan 3 is driven to rotate, whereby air can be sucked inside the casing 2 from the suction opening 21*a* in the top surface of the casing 2, be blown out toward the outer peripheral side of the blow fan 3, be heated or cooled as a result of being passed through the heat exchanger 5, and thereafter be blown out from the blowout openings 23*a*, 23*b*, 23*c* and 23*d* in the bottom surface of the casing 2.

Figure 3:
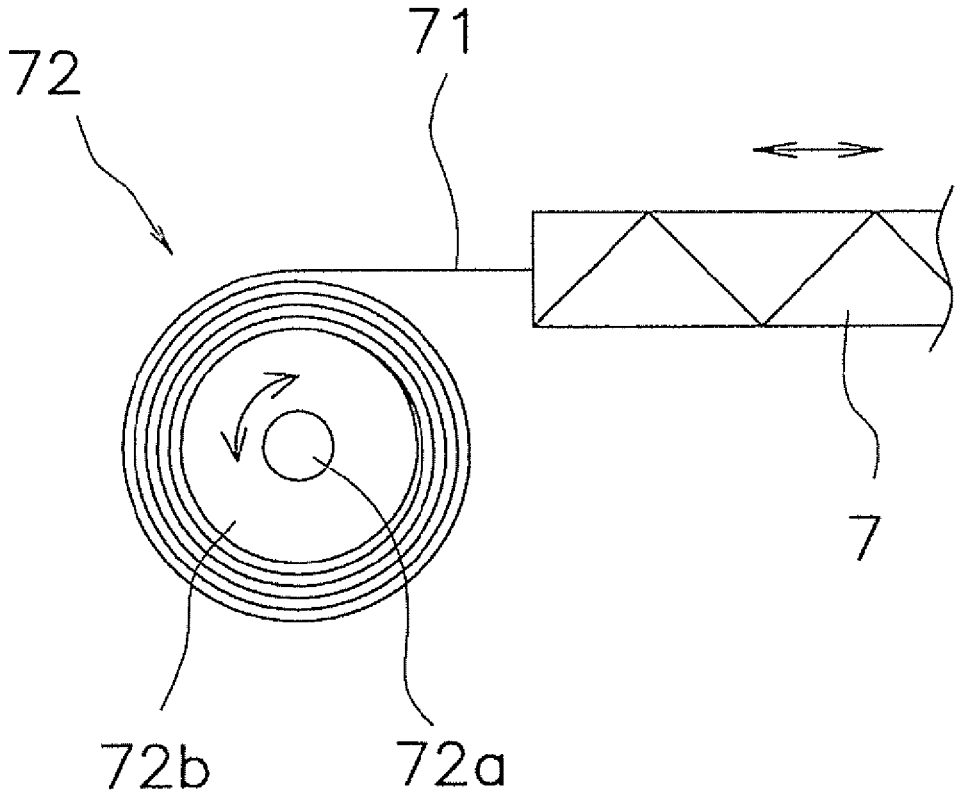
FIG. 3 is a general cross-sectional view showing the structure of a take-up mechanism.

Further, a filter 7 that traps dust in the air that is sucked in from the suction opening 21*a* is disposed in the suction opening 21*a*. The filter 7 is, for example, configured by a frame member that comprises a soft resin material and a net-like member that is formed integrally with the frame member, and the filter 7 has flexibility and elasticity. The end portion of the filter 7 near the side plate 22*a* is, as shown in FIG. 1 and FIG. 3, connected to a connection member 71 such as a plate or a wire that has the same degree of elasticity and rigidity as the filter 7, and the connection member 71 is taken up by a take-up mechanism 72 that is disposed in a portion of the top plate 21 near the side plate 22*a*. The take-up mechanism 72 includes a shaft portion 72*a* that is supported on the casing 2 (specifically, the top plate 21) such that the shaft portion 72*a* may freely rotate, a roller 72*b* that is fitted over the outer periphery of the shaft portion 72*a*, and a take-up motor (not shown) that drives the shaft portion 72*a* to rotate. The other end of the connection member 71 (that is, the end portion on the opposite side of the end portion connected to the end portion of the filter 7 near the side plate 22*a*) is connected to the roller 72*b*. In this take-up mechanism 72, when the shaft portion 72*a* is driven to rotate clockwise in FIG. 3 by the take-up motor, the connection member 71 is fed out from the roller 72*b*, so the filter 7 moves toward the side plate 22*c* in accompaniment therewith. Conversely, when the shaft portion 72*a* is driven to rotate counter-clockwise in FIG. 3 by the take-up motor, the connection member 71 is taken up onto the roller 72*b*, so the filter 7 moves toward the side plate 22*a* in accompaniment therewith. Here, the end portion of the filter 7 near the side plate 22*c* (that is, the end portion on the opposite side of the end portion connected to the connection member 71) is inserted as far as the inside of the end of the guide opening 24 that serves as a filter guide portion near the suction opening 21*a* in a state where the connection member 71 is taken up onto the roller 72*b*, and when the connection member 71 is fed out from the roller 72*b* by the driving of the take-up motor, the filter 7 is caused to automatically move downward through the guide opening 24, so that when cleaning of the filter 7 is to be performed, for example, the filter 7 can be lowered as far as a position reachable by the hands of a worker, and cleaning of the filter 7 can be performed thereafter. Additionally, after cleaning of the filter 7 has been performed, the connection member 71 is caused to be taken up onto the roller 72*b* by the driving of the take-up motor, whereby the filter 7 can again be installed in the suction opening 21*a*. In this manner, the connection member 71 and the take-up mechanism 72 function as a filter drive mechanism for automatically causing the filter 7 to move downward through the guide opening 24.

(2) When Given a Ceiling-suspended Configuration

Figure 4:
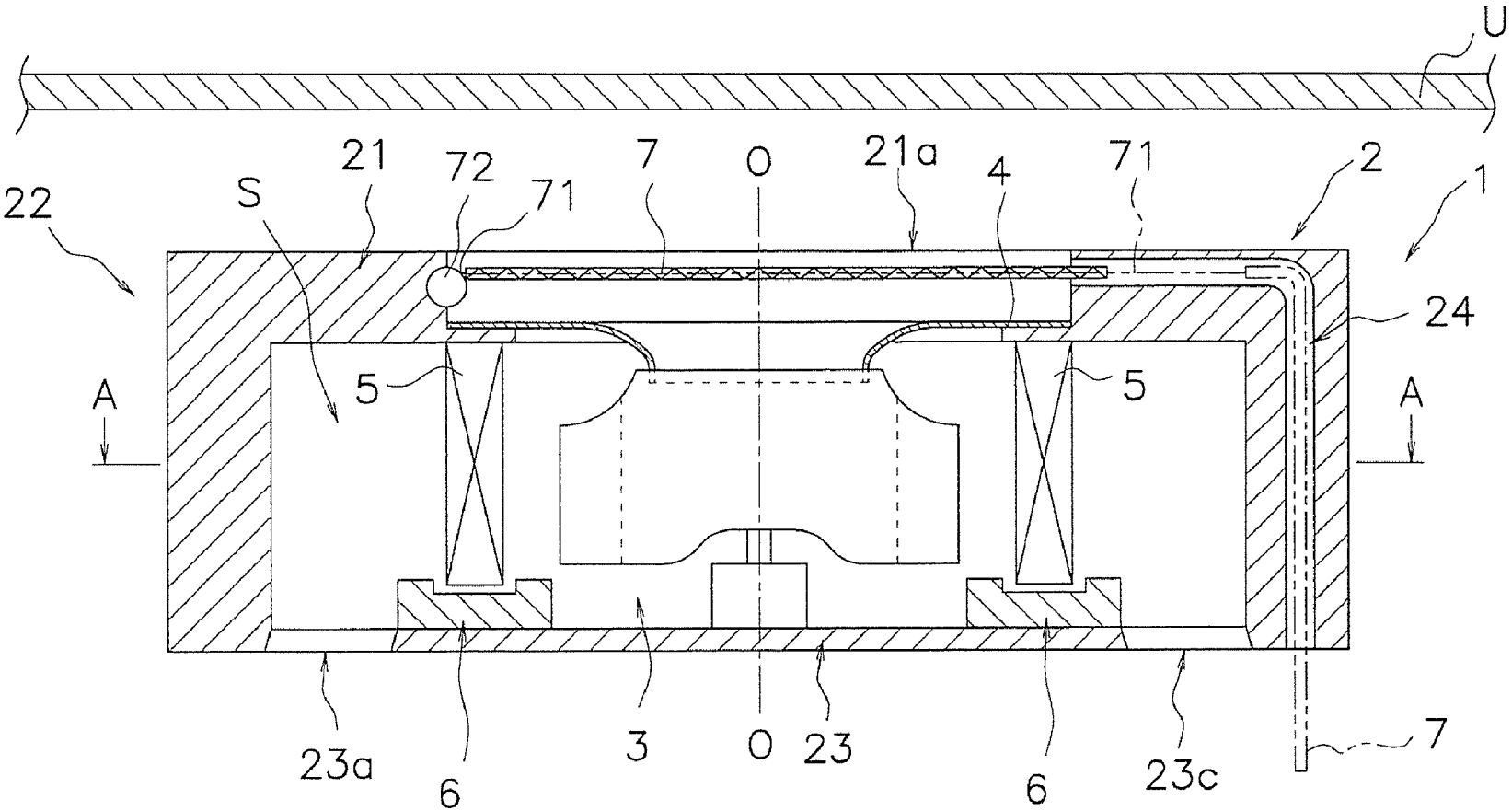
FIG. 4 is a view that corresponds to FIG. 1 and shows a state where the ceiling-mounted air conditioner pertaining to the first embodiment is given a ceiling-suspended configuration.

When the ceiling-mounted air conditioner 1 is given a configuration where it is suspended from a ceiling surface U in an air-conditioned room and installed (called a "ceiling-suspended configuration" below), as shown in FIG. 4, the air conditioner 1 is installed such that there is a clearance between the ceiling surface U and the casing 2 (specifically, the top plate 21).

In the air conditioner 1 that has been installed in a ceiling-suspended configuration in this manner, air in the air-conditioned room is sucked in from the suction opening 21*a* that is formed in the top surface (that is, the top plate 21) of the casing 2, passes through the blow fan 3 and the heat exchanger 5 that are installed in the air flow path S, is heated or cooled, and is thereafter blown out from the blowout openings 23*a*, 23*b*, 23*c* and 23*d* that are formed in the bottom surface (that is, the bottom plate 23) of the casing 2. For this reason, it becomes more difficult, in comparison to when both the suction opening and the blowout openings are formed in the bottom surface of the casing 2, for the phenomenon (that is, the short circuiting of air flow phenomenon) to occur that air which is blown out from the blowout openings ends up being sucked back inside the casing from the suction opening immediately after being blown out.

Further, when the air conditioner 1 is given a ceiling-suspended configuration and cleaning of the filter 7 is to be performed, the take-up motor of the take-up mechanism 72 is driven, whereby the filter 7 can be automatically caused to move downward through the guide opening 24 (refer to the filter 7 and the connection member 71 represented by the two-dotted chain lines in FIG. 4).

(3) When Given a Ceiling-embedded Configuration

Figure 5:
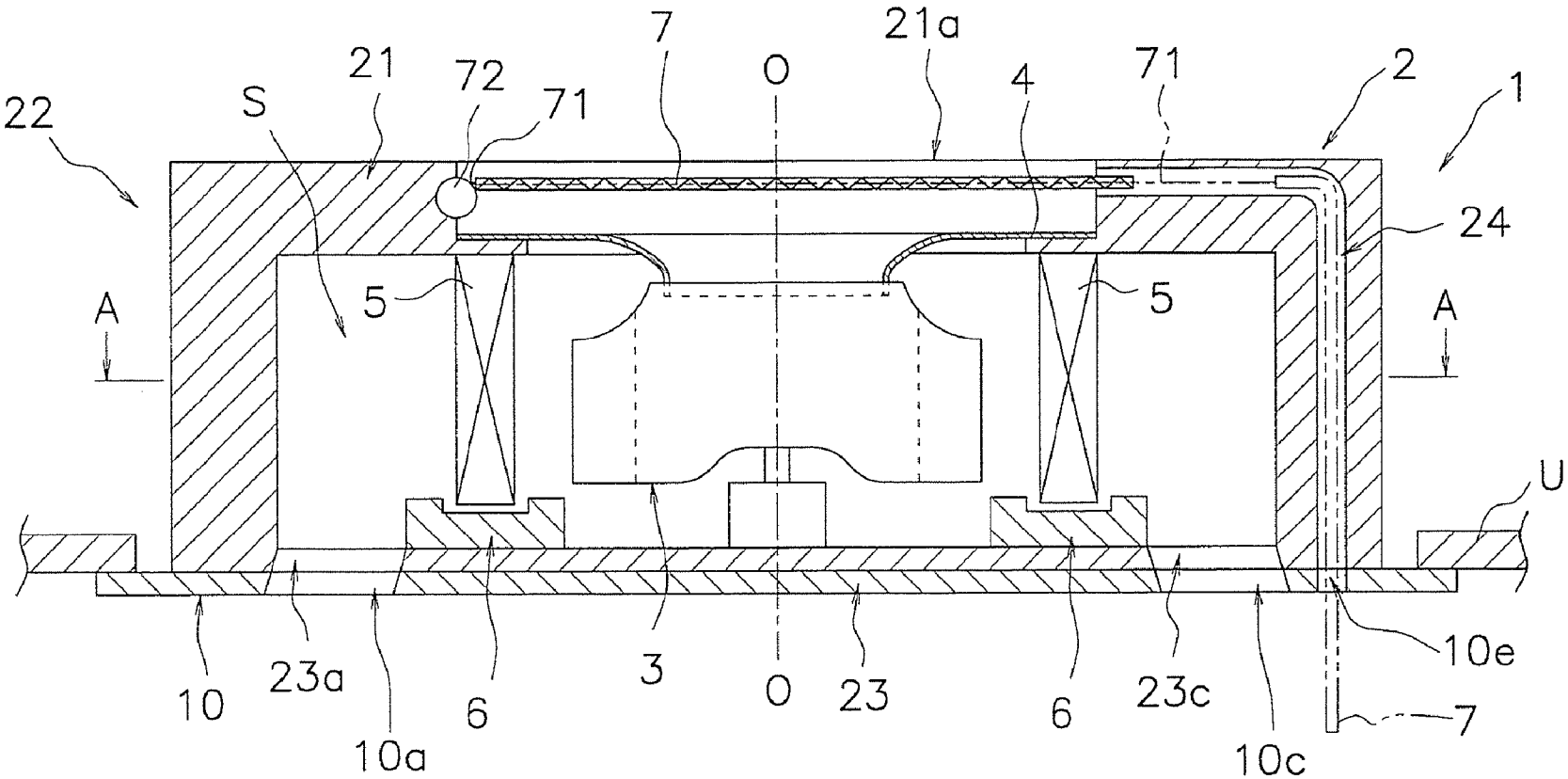
FIG. 5 is a view that corresponds to FIG. 1 and shows a state where the ceiling-mounted air conditioner pertaining to the first embodiment is given a ceiling-embedded configuration.

When the above-described ceiling-mounted air conditioner 1 is given a configuration where the portion excluding the bottom surface of the casing 2 is installed in a space on the backside of a ceiling of an air-conditioned room (called a "ceiling-embedded configuration" below), as shown in FIG. 5, the air conditioner 1 is installed such that the casing 2 is fitted into an opening in the ceiling surface U, and a thin blowout panel 10, in which are formed panel blowout openings 10*a*, 10*b*, 10*c* and 10*d* and a guide opening 10*e* that face the blowout openings 23*a*, 23*b*, 23*c* and 23*d* and the guide opening 24 in the bottom surface of the casing 2, is attached to the bottom surface of the casing 2 so as to cover from below a gap between the opening in the ceiling surface U and the casing 2.

In the air conditioner 1 that has been installed in a ceiling-embedded configuration in this manner, air in the space on the backside of the ceiling is sucked in from the suction opening 21*a* that is formed in the top surface (that is, the top plate 21) of the casing 2, passes through the blow fan 3 and the heat exchanger 5 that are disposed in the air flow path S, is heated or cooled, and is thereafter blown out from the blowout openings 23*a*, 23*b*, 23*c* and 23*d* that are formed in the bottom surface (that is, the bottom plate 23) of the casing 2 and the panel blowout openings 10*a*, 10*b*, 10*c* and 10*d* that are communicated with these blowout openings. That is, a ceiling chamber air conditioner that uses the space on the backside of the ceiling as an air supply chamber can be configured.

Further, when the air conditioner 1 is given a ceiling-embedded configuration and cleaning of the filter 7 is to be performed, the take-up motor of the take-up mechanism 72 is driven, whereby the filter 7 can be automatically caused to move downward through the guide opening 24 and the guide opening 10*e* (refer to the filter 7 and the connection member 71 represented by the two-dotted chain lines in FIG. 5).

(4) Characteristics of Air Conditioner of Present Embodiment

The air conditioner 1 of the present embodiment has the following characteristics.

(A)

In the air conditioner 1 of the present embodiment, it can be made difficult for short circuiting of air flow to occur because the air conditioner 1 is configured such that air is sucked in from the top surface (that is, the top plate 21) of the casing 2 and air is blown out from the bottom surface (that is, the bottom plate 23) of the casing 2. Further, when the air conditioner 1 is used in a ceiling-embedded configuration, the suction opening 21*a* is disposed in a space on the backside of a ceiling, and the blowout openings 23*a*, 23*b*, 23*c* and 23*d* are disposed in an indoor space, so a ceiling chamber air conditioner that uses the space on the backside of the ceiling as an air supply chamber can be configured. Moreover, because a suction opening is not present in the bottom surface of the casing 2, a ceiling-embedded configuration can be configured simply by attaching the thin blowout panel 10, in which are formed just blowout openings that are communicated with the blowout openings 23*a*, 23*b*, 23*c* and 23*d* in the casing 2, to the bottom surface of the casing 2.

(B)

In the air conditioner 1 of the present embodiment, a turbo fan is used as the blow fan 3, and the heat exchanger 5 is disposed on the downstream side of the turbo fan 3, so the air flow path S through which air that flows inside the casing 2 flows generally downward can be formed, and a situation where an air flow path that folds back in the vertical direction is formed inside the casing 2 can be avoided. Thus, ventilation resistance of air that flows in the air flow path S can be reduced, and compaction of the height direction dimension of the casing 2 can be realized.

(C)

In the air conditioner 1 of the present embodiment, the guide opening 24 that serves as a filter guide portion that holds the filter 7 such that the filter 7 is movable between the suction opening 21*a* and the bottom surface of the casing 2 is disposed in the casing 2, so the filter 7 can be easily attached and detached during cleaning even though the air conditioner has a configuration where the suction opening 21*a* is disposed in the top surface of the casing 2.

Moreover, the connection member 71 and the take-up mechanism 72 that serve as a filter drive mechanism for automatically causing the filter 7 to move downward through the guide opening 24 are disposed in the casing 2, so the filter 7 can be lowered while work in a high place is avoided.

(5) Modification 1

Figure 6:
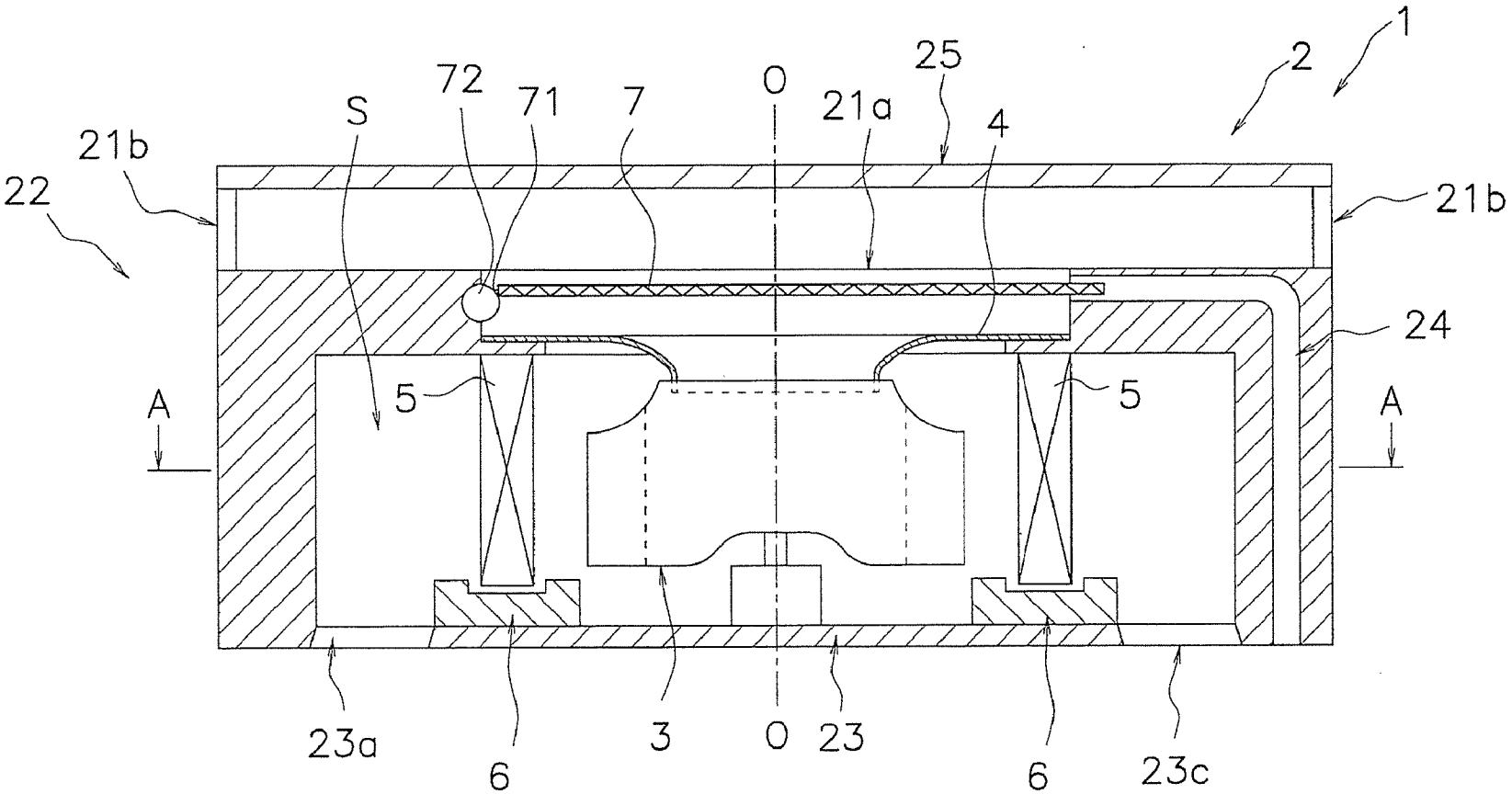
FIG. 6 is a general side sectional view (with a ceiling being omitted) of a ceiling-mounted air conditioner pertaining to modification 1 of the first embodiment.

In the air conditioner 1 pertaining to the preceding embodiment, the suction opening 21*a* is disposed in the top surface of the casing 2, but a suction opening may also be disposed in the side surface of the casing 2. For example, as shown in FIG. 6, in the air conditioner 1 pertaining to the preceding embodiment, the side plate 22 can be extended upward, another top plate 25 can be disposed so as to cover the opening formed by the top end portion of the side plate 22, and another suction opening 21*b* that is communicated with the suction opening 21*a* can be disposed in the portion of the side surface 22 that has been extended upward (that is, the upper portion of the side surface of the casing 2).

Additionally, the air conditioner 1 can be given a ceiling-suspended configuration by installing the air conditioner 1 such that the top surface (specifically, the top plate 25) of the casing 2 contacts the ceiling surface U. Further, the air conditioner 1 can be given a ceiling-embedded configuration (that is, a ceiling chamber configuration that uses the space on the backside of a ceiling as an air supply chamber) by installing the air conditioner 1 in an opening in the ceiling surface U such that the suction opening 21*b* is disposed in the space on the backside of the ceiling and attaching the blowout panel 10 (see FIG. 5) to the bottom surface of the casing 2.

In the air conditioner 1 pertaining to the present modification, similar to the preceding embodiment, it can be made difficult for short circuiting of air flow to occur because the air conditioner 1 is configured such that air is sucked in from the side surface (that is, the side plate 22) of the casing 2 and air is blown out from the bottom surface (that is, the bottom plate 23) of the casing 2, and when the air conditioner 1 is used in a ceiling-embedded configuration, a ceiling chamber air conditioner that uses the space on the backside of a ceiling as an air supply chamber can be configured, and moreover a ceiling-embedded configuration can be configured simply by attaching the thin blowout panel 10 (see FIG. 5), in which are formed just blowout openings that are communicated with the blowout openings 23*a*, 23*b*, 23*c* and 23*d* in the casing 2, to the bottom surface of the casing 2.

In the air conditioner 1 pertaining to the present modification, similar to the preceding embodiment, a turbo fan is used as the blow fan 3, and the heat exchanger 5 is disposed on the downstream side of the turbo fan 3, so the air flow path S through which air that flows inside the casing 2 flows generally downward can be formed, and a situation where an air flow path that folds back in the vertical direction is formed inside the casing 2 can be avoided.

Moreover, when the air conditioner 1 pertaining to the present modification is given a ceiling-suspended or ceiling-embedded configuration and cleaning of the filter 7 is to be performed, then similar to the preceding embodiment, the take-up motor of the take-up mechanism 72 is driven, whereby the filter 7 can be automatically caused to move downward through the guide opening 24 (see FIG. 4 and FIG. 5).

(6) Modification 2

Figure 7:
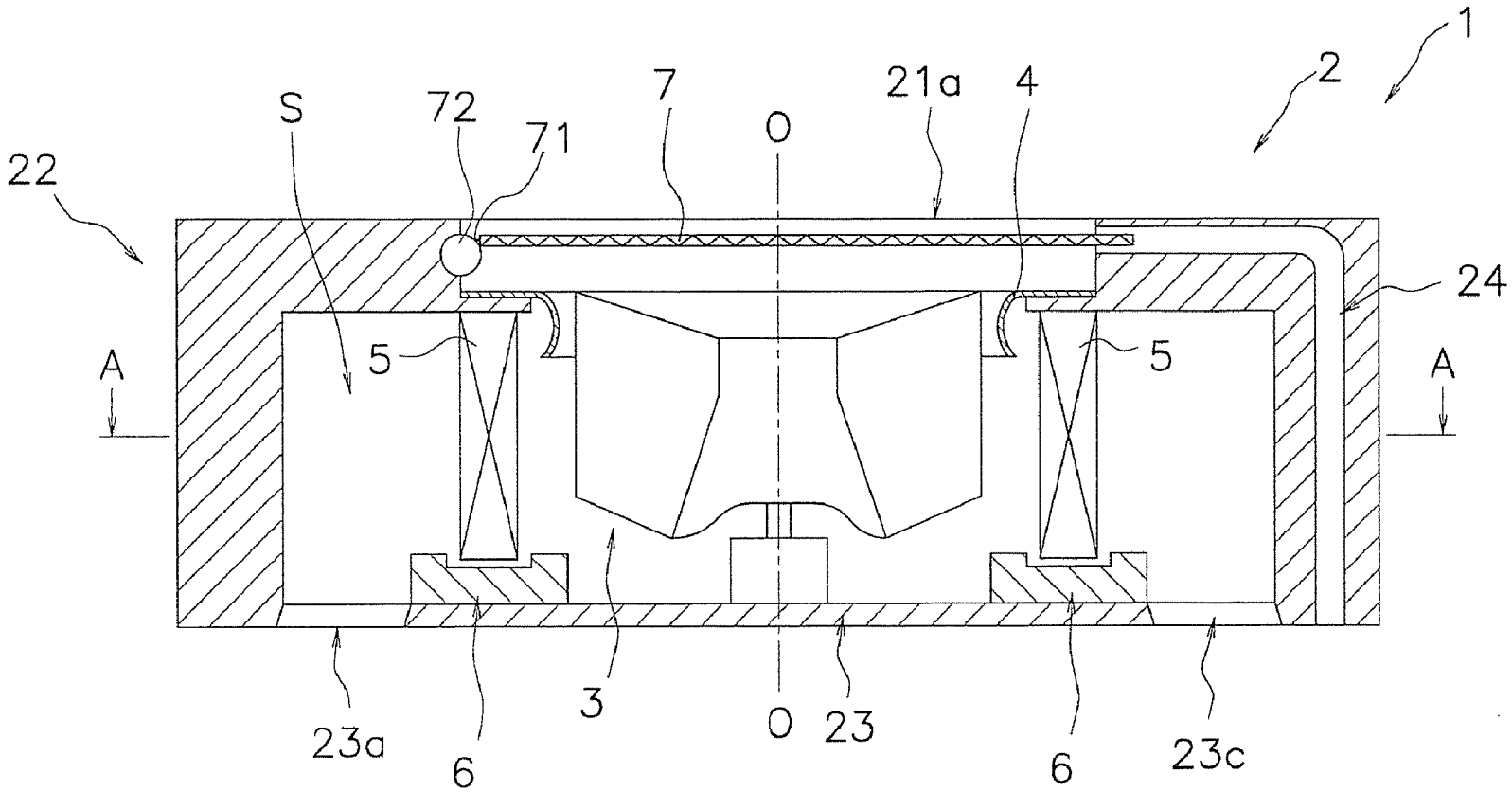
FIG. 7 is a general side sectional view (with a ceiling being omitted) of a ceiling-mounted air conditioner pertaining to modification 2 of the first embodiment.

In the air conditioner 1 pertaining to the preceding embodiment and modification 1, a turbo fan is used as the blow fan 3, but a blow fan of another configuration may also be used. For example, taking as an example a case where the suction opening is formed in the top surface of the casing 2, as shown in FIG. 7, a diagonal flow fan may also be used as the blow fan 3.

In the air conditioner 1 pertaining to the present modification also, the same action and effects as those of the air conditioner 1 pertaining to the preceding embodiment and modification 1 can be obtained.

(7) Modification 3

Figure 8:
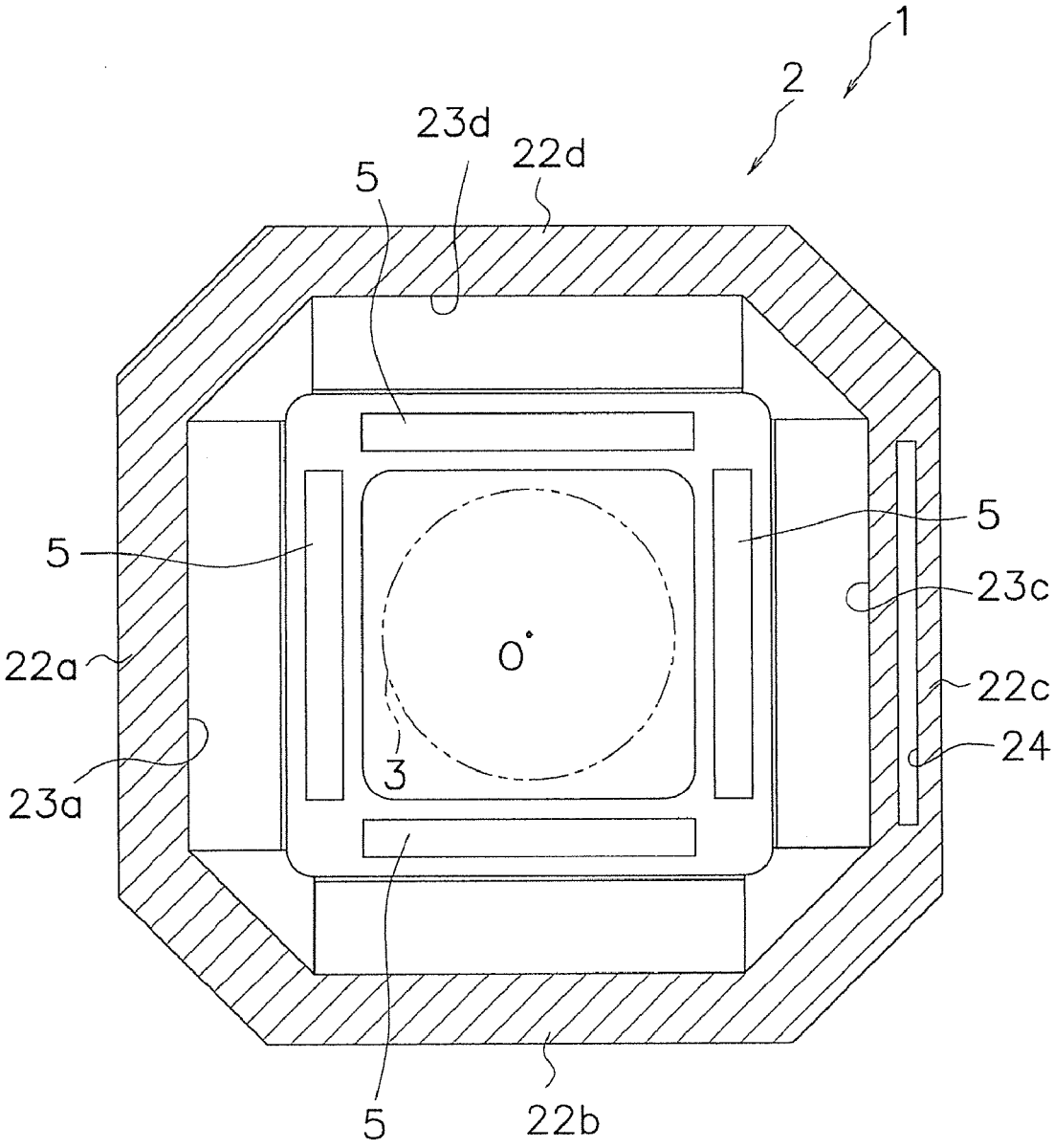
FIG. 8 is a view that corresponds to FIG. 2 and shows a ceiling-mounted air conditioner pertaining to modification 3 of the first embodiment.

In the air conditioner 1 pertaining to the preceding embodiment and modifications 1 and 2, the substantially rectangular annular single heat exchanger 5 is disposed so as to surround the outer peripheral portion of the blow fan 3 when the casing 2 is seen in a plan view, but the heat exchanger 5 may also be plurally disposed on the outer peripheral side of the blow fan 3. For example, taking as an example a case where the suction opening is formed in the top surface of the casing 2 and where a turbo fan is used as the blow fan 3, as shown in FIG. 8, four of the heat exchangers 5 can be disposed on the outer peripheral side of the blow fan 3 so as to be along the four blowout openings 23*a*, 23*b*, 23*c* and 23*c* (that is, the side plates 22*a*, 22*b*, 22*c* and 22*d*).

In the air conditioner 1 pertaining to the present modification, the heat exchanger 5 is plurally (here, four) disposed on the outer peripheral side of the blow fan 3 when the casing 2 is seen in a plan view, so compaction of the height direction dimension of the casing 2 can be promoted.

Figure 9:
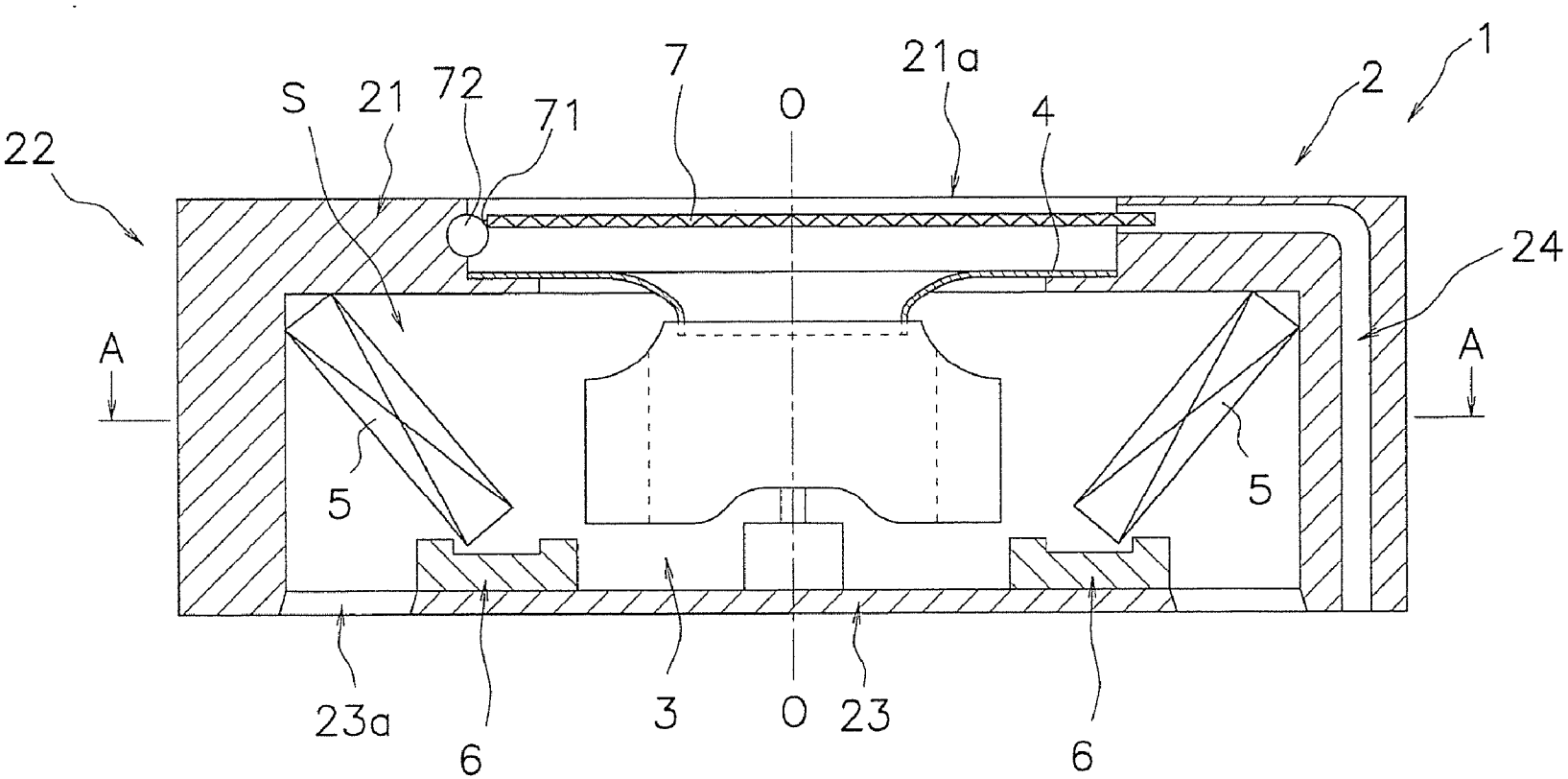
FIG. 9 is a general side sectional view (with a ceiling being omitted) of the ceiling-mounted air conditioner pertaining to modification 3 of the first embodiment.

Further, when the plural heat exchangers 5 are disposed on the outer peripheral side of the blow fan 3, as shown in FIG. 9, the heat exchangers 5 may be disposed such that their top portions slant away from their bottom portions with respect to the blow fan 3 when the casing 2 is seen in a side view (that is, when the heat exchangers 5 are seen from their longitudinal direction). In this case, compaction of the height direction dimension of the casing 2 can be further promoted and the heat transfer area of each of the heat exchangers 5 can be enlarged; further, the heat exchangers 5 can be disposed without interfering with the blowout openings 23*a*, 23*b*, 23*c* and 23*d* because the heat exchangers 5 are disposed such that their top portions slant away from their bottom portions with respect to the blow fan 3.

Figure 10:
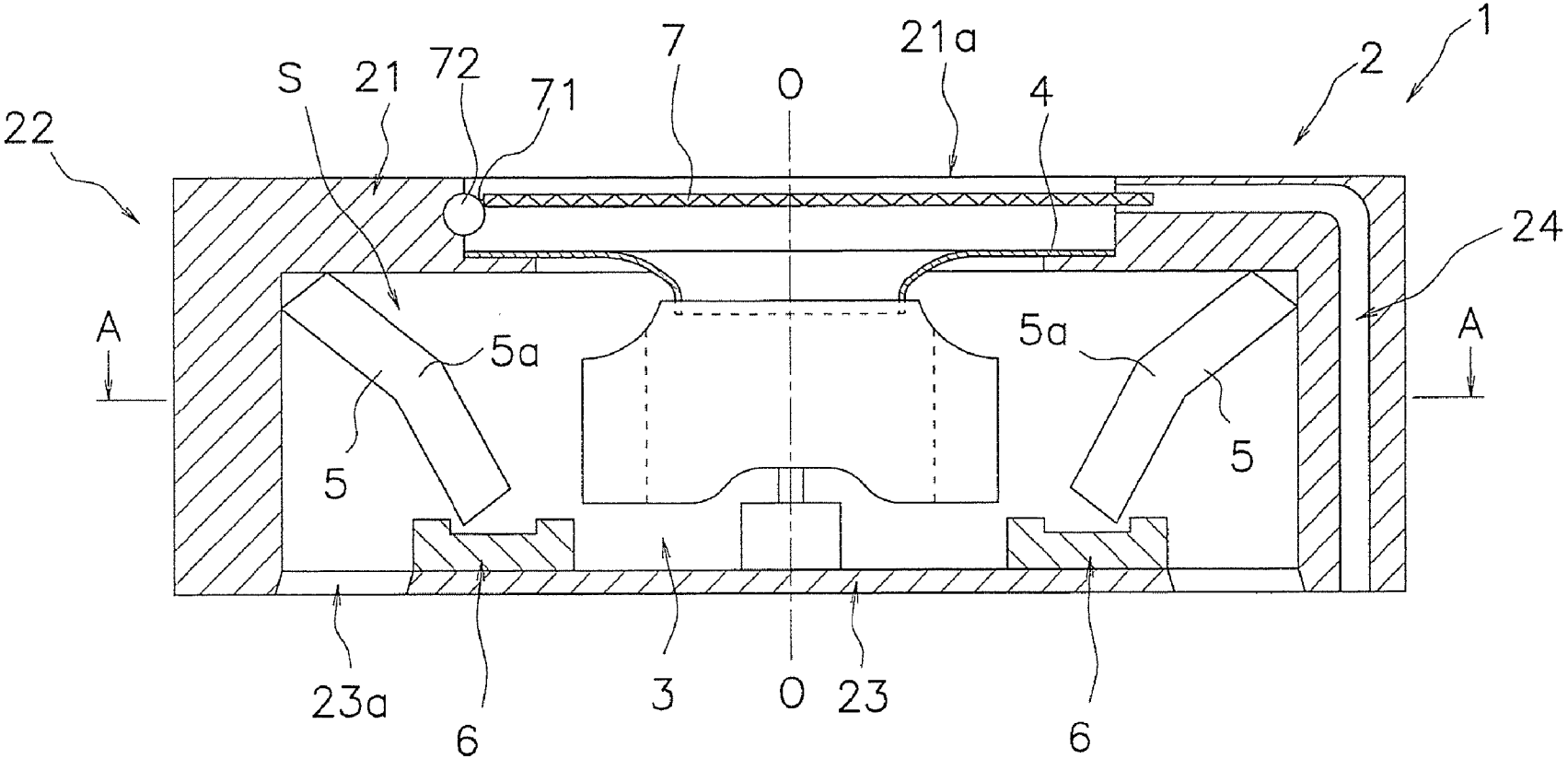
FIG. 10 is a general side sectional view (with a ceiling being omitted) of the ceiling-mounted air conditioner pertaining to modification 3 of the first embodiment.
Figure 11:
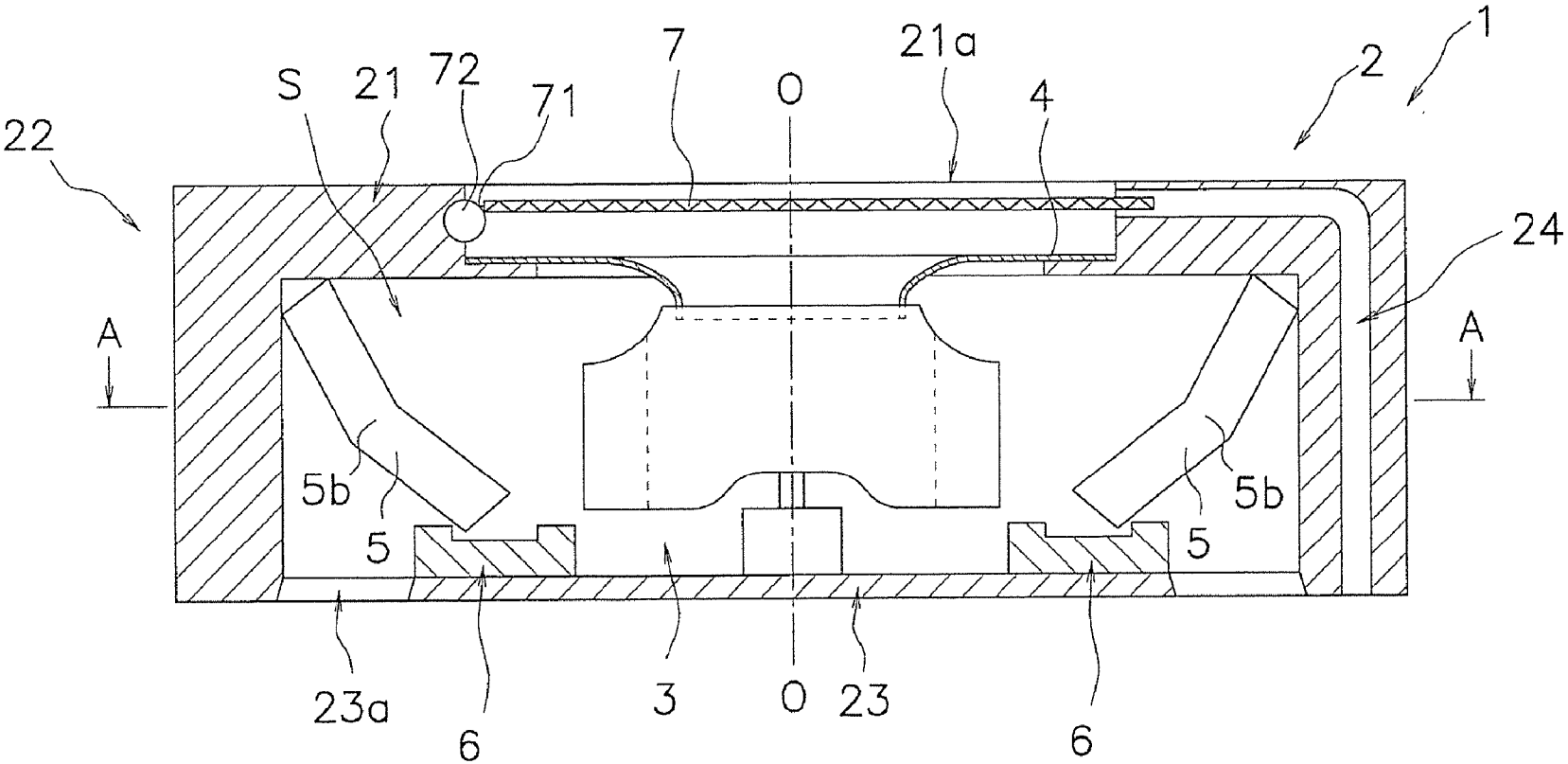
FIG. 11 is a general side sectional view (with a ceiling being omitted) of the ceiling-mounted air conditioner pertaining to modification 3 of the first embodiment.
Figure 12:
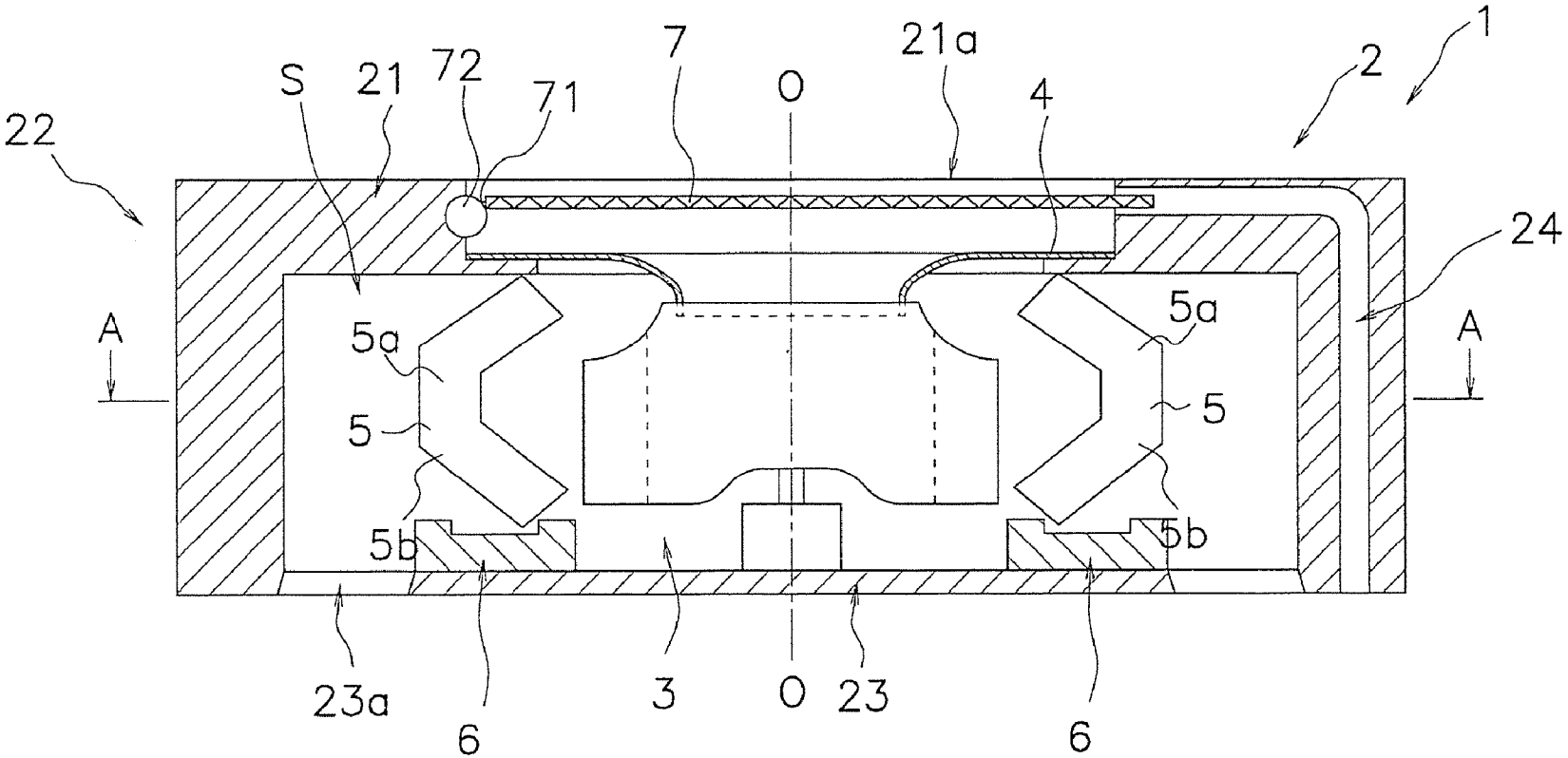
FIG. 12 is a general side sectional view (with a ceiling being omitted) of the ceiling-mounted air conditioner pertaining to modification 3 of the first embodiment.

Further, when the plural heat exchangers 5 are disposed on the outer peripheral side of the blow fan 3, the heat exchangers 5 may be given shapes that project sideways, diagonally upward, or diagonally downward when the casing 2 is seen in a side view (that is, when the heat exchangers 5 are seen from their longitudinal direction). For example, multiple stage bending work may be administered such that the heat exchangers 5 have shapes where part of the heat exchangers 5 projects. More specifically, as shown in FIG. 10 to FIG. 12, multiple stage bending work is administered such that projecting portions that project sideways, diagonally upward, or diagonally downward when the heat exchangers 5 are seen from their longitudinal direction (that is, the arrangement direction of their fins) are formed. Here, FIG. 10 is a general side sectional view of the air conditioner 1 pertaining to the present modification 3 and shows heat exchangers 5 in which are formed projecting portions 5*a* that project diagonally upward. FIG. 11 is a general side sectional view of the air conditioner 1 pertaining to the present modification 3 and shows heat exchangers 5 in which are formed projecting portions 5*b* that project diagonally downward. FIG. 12 is a general side sectional view of the air conditioner 1 pertaining to the present modification 3 and shows heat exchangers 5 where the projecting portions 5*b* that project diagonally downward are formed in the lower portions of the heat exchangers 5 and the projecting portions 5*a* that project diagonally upward are formed in the upper portions of the heat exchangers 5. In this case also, compaction of the height direction dimension of the casing 2 can be further promoted and the heat transfer area of each of the heat exchangers 5 can be enlarged.

(8) Modification 4

Figure 13:
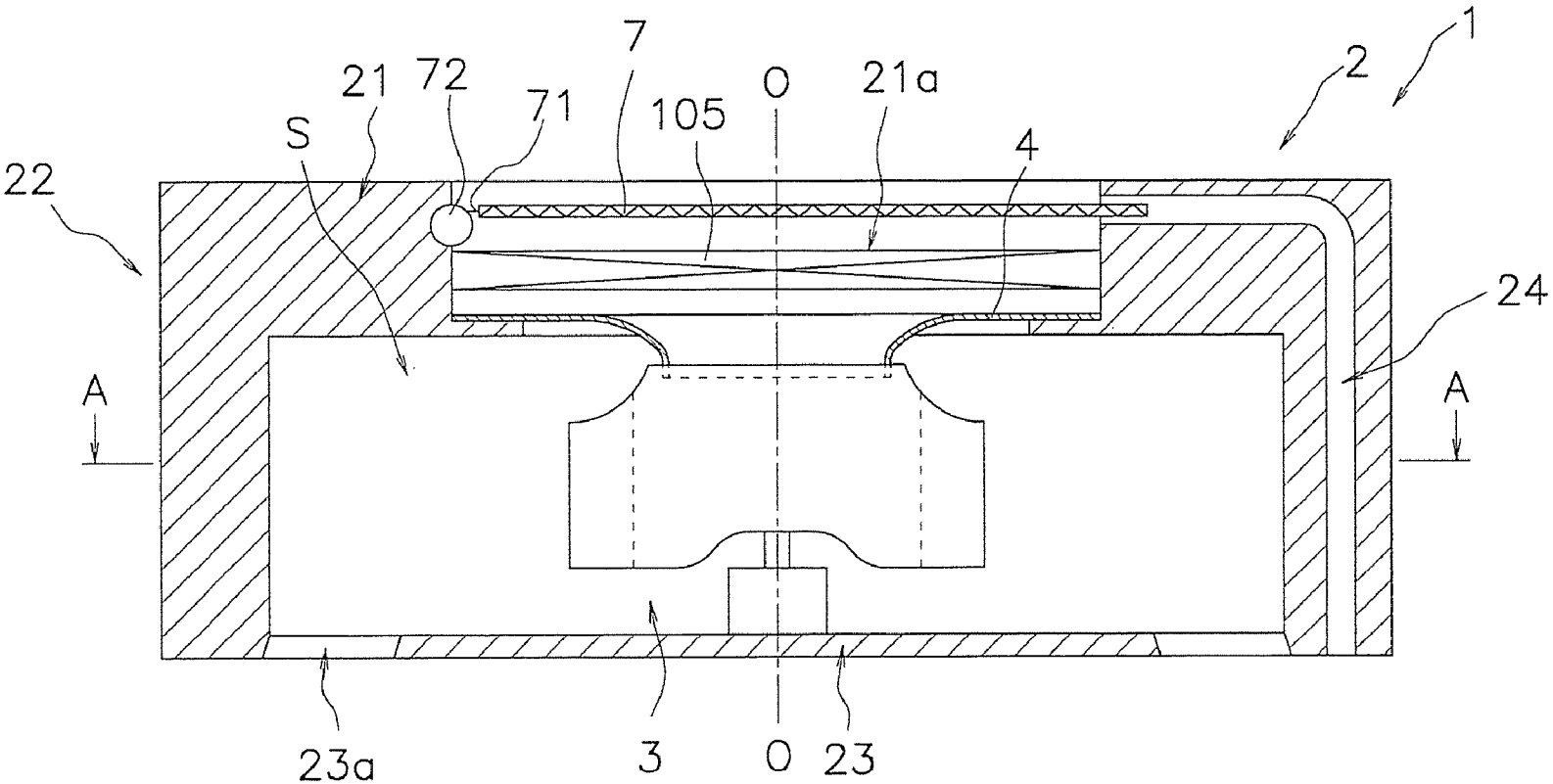
FIG. 13 is a general side sectional view (with a ceiling being omitted) of a ceiling-mounted air conditioner pertaining to modification 4 of the first embodiment.
Figure 14:
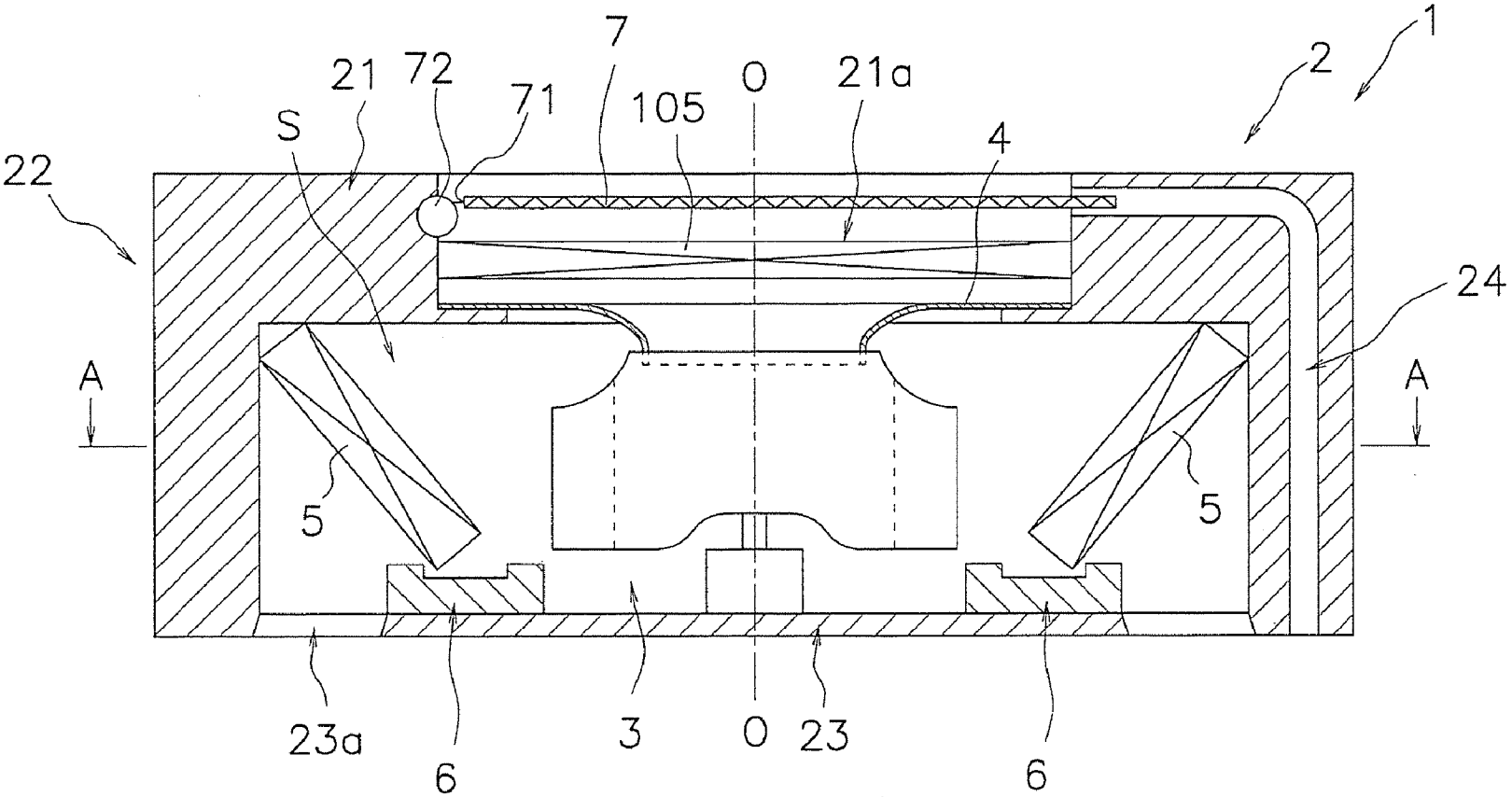
FIG. 14 is a general side sectional view (with a ceiling being omitted) of the ceiling-mounted air conditioner pertaining to modification 4 of the first embodiment.

In the air conditioner 1 pertaining to the preceding embodiment and modifications 1 to 3, a heat exchanger is disposed on the downstream side of the blow fan 3 in the air flow path S, but instead of disposing a heat exchanger on the downstream side of the blow fan 3, a heat exchanger may be disposed on the upstream side, or a heat exchanger may be disposed on the downstream side of the blow fan 3 and a heat exchanger may be disposed on the upstream side. For example, taking as an example the case of the configuration in modification 3 (see FIG. 8 and FIG. 9), as shown in FIG. 13, a heat exchanger 105 can be disposed on the upstream side of the blow fan 3 between the filter 7 and the bellmouth 4 instead of the heat exchangers 5 that are disposed on the downstream side of the blow fan 3, or, as shown in FIG. 14, the heat exchanger 105 can be disposed on the upstream side of the blow fan 3 between the filter 7 and the bellmouth 4 in addition to the heat exchangers 5 that are disposed on the downstream side of the blow fan 3. It will be noted that, similar to the aforementioned heat exchangers 5, a cross fin heat exchanger panel can be employed as the heat exchanger 105.

In the air conditioner 1 pertaining to the present modification, the heat exchanger 105 that is separate from the heat exchangers 5 is disposed on the upstream side of the blow fan 3 instead of the heat exchangers 5 that are disposed on the downstream side of the blow fan 3 or in addition to the heat exchangers 5 that are disposed on the downstream side of the blow fan 3, so the heat exchanger 105 can be disposed substantially flatly, and thus the heat transfer area of the heat exchanger of the overall device can be enlarged.

(9) Modification 5

In the air conditioner 1 pertaining to the preceding embodiment and modifications 1 to 4, cross fin heat exchanger panels are used as the heat exchangers 5 and 105, but another type of heat exchanger may also be used. For example, taking as an example the case of the configuration in modification 3 (see FIG. 8 and FIG. 9), stacked heat exchangers can be employed as the heat exchangers 5. Here, a heat exchanger where heat transfer tubes that comprise flat tubes and fins that comprise corrugated fins made of aluminum are alternately stacked and where both ends of the heat transfer tubes are interconnected by header tubes can be employed as the stacked heat exchangers.

In the air conditioner 1 pertaining to the present modification, stacked heat exchangers are employed as the heat exchangers 5, heat exchange efficiency is high and compaction is possible, so the height direction dimension of the casing 2 can be made compact. Moreover, in this case, the heat exchangers 5 are given a configuration where the heat transfer tubes that configure the heat exchangers 5 are disposed so as to extend in the vertical direction, so that when condensation forms on the surfaces of the heat exchangers 5, that condensation water can be quickly guided downward mainly via the heat transfer tubes.

It will be noted that when the second heat exchanger 105 that is separate from the heat exchangers 5 is disposed on the upstream side of the blow fan 3 as in the air conditioner 1 pertaining to modification 4, a stacked heat exchanger may also be employed as the heat exchanger 105.

(10) Modification 6

Figure 15:
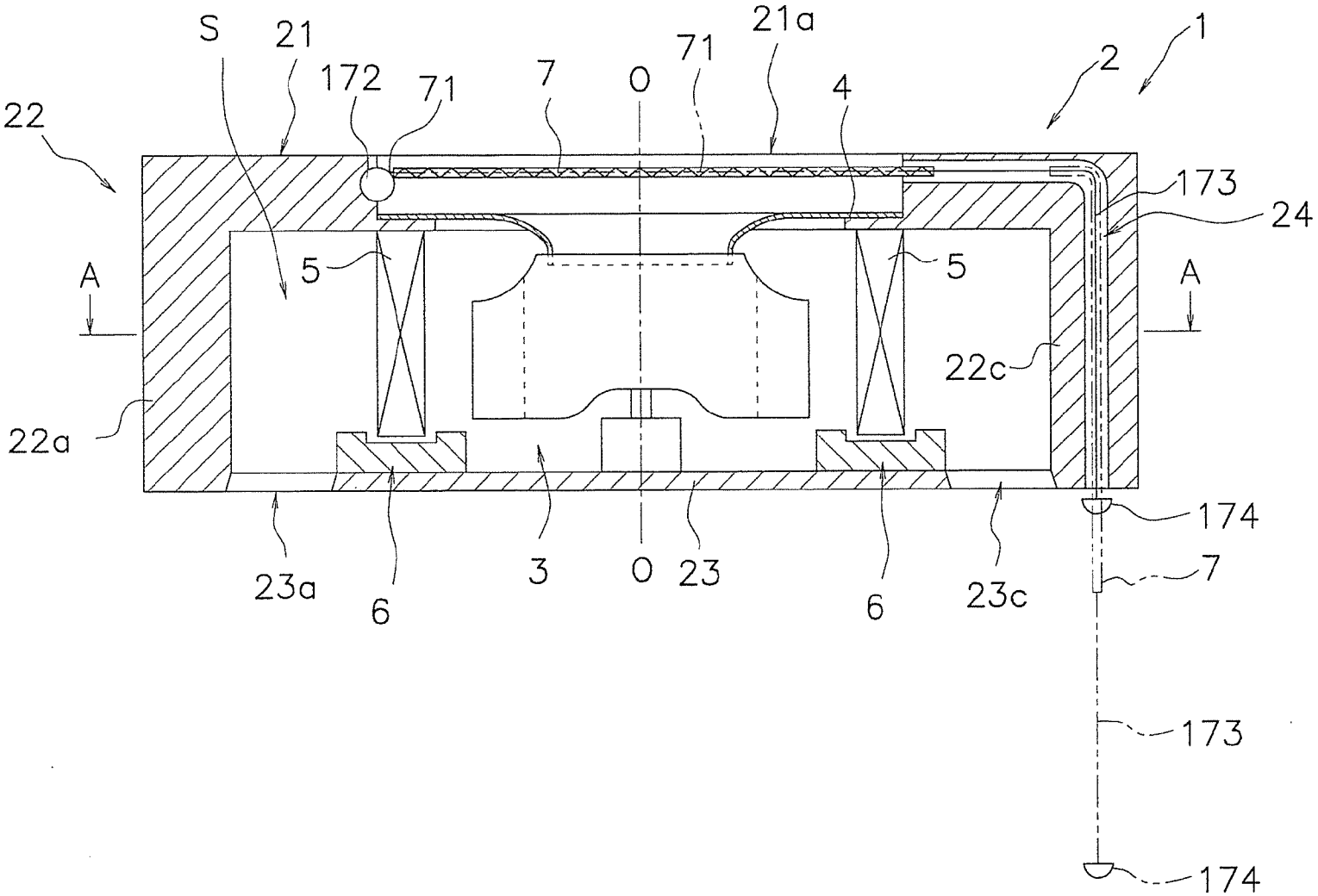
FIG. 15 is a general side sectional view (with a ceiling being omitted) of a ceiling-mounted air conditioner pertaining to modification 6 of the first embodiment.
Figure 16:
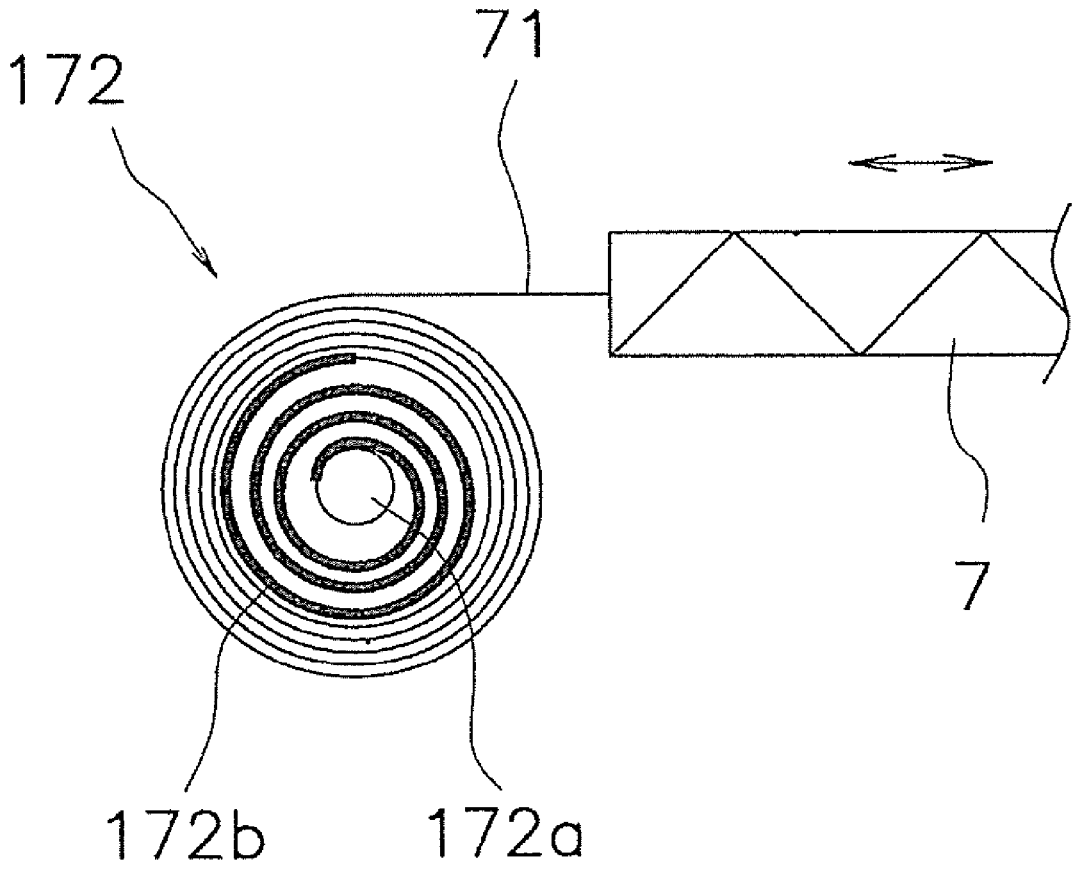
FIG. 16 is a general cross-sectional view showing the structure of a filter drive mechanism pertaining to modification 6 of the first embodiment.

In the air conditioner 1 pertaining to the preceding embodiment and modifications 1 to 5, the connection member 71 and the take-up mechanism 72 that serve as a filter drive mechanism for automatically causing the filter 7 to move downward through the guide opening 24 are disposed in the casing 2, but a filter drive mechanism for manually causing the filter 7 to move downward may also be disposed. For example, taking as an example the case of the preceding embodiment, a filter drive mechanism that comprises the connection member 71, a take-up mechanism 172, a cord-like member 173 and a handle 174 such as shown in FIG. 15 and FIG. 16 can be used.

More specifically, the end portion of the filter 7 near the side plate 22*a* is, similar to the preceding embodiment, connected to the connection member 71 such as a plate or a wire that has the same degree of elasticity and rigidity as the filter 7, and the connection member 71 is taken up by the take-up mechanism 172 that is disposed in a portion of the top plate 21 near the side plate 22*a*. The take-up mechanism 172 includes a shaft portion 172*a* that is supported on the casing 2 (specifically, the top plate 21) such that the shaft portion 172*a* is incapable of rotating, and a spiral spring 172*b* that is disposed around the shaft portion 172*a*. The other end of the connection member 71 (that is, the end portion on the opposite side of the end portion connected to the end portion of the filter 7 near the side plate 22*a*) is connected to the spiral spring 172*b*. The spiral spring 172*b* is set such that, when the spiral spring 172*b* is in a free state, the connection member 71 is taken up and the filter 7 is disposed in the suction opening 21*a*, and in a state where the connection member 71 is fed out, spring force acts to try to take up the connection member 71. Additionally, one end of the cord-like member 173 is connected to the end portion of the filter 7 near the side plate 22*c* (that is, the end portion on the side not connected to the connection member 71), and in a state where the filter 7 is disposed in the suction opening 21*a*, the other end of the cord-like member 173 extends as far as the bottom surface (that is, the bottom plate 23) of the casing 2 through the guide opening 24. The handle 174 is a member that is disposed on the other end of the cord-like member 173 (that is, the end portion on the bottom surface side of the casing 2), and the handle 174 is used to manually cause the filter 7 to move downward through the guide opening 24.

In this filter drive mechanism that comprises the connection member 71, the take-up mechanism 172, the cord-like member 173 and the handle 174, first, when the handle 174 is pulled downward using a grappling rod or the like on whose distal end is formed a claw or the like, the connection member 71 is pulled out from the shaft portion 172*a* overcoming the spring force of the spiral spring 172*b*. Then, the filter 7 is caused to move downward through the guide opening 24, so that when cleaning of the filter 7 is to be performed, for example, the filter 7 can be lowered as far as a position reachable by the hands of a worker, and cleaning of the filter 7 can be performed thereafter. Then, when the force acting on the spiral spring 172*b* is eased after cleaning of the filter 7 has been performed, the connection member 71 that had been pulled out from the shaft portion 172*a* is taken up onto the shaft portion 172*a* by the spring force of the spiral spring 172*b*, whereby the filter 7 can again be installed in the suction opening 21*a* (refer to the filter 7 and the connection member 71 represented by two-dotted chain lines in FIG. 15).

In the air conditioner 1 pertaining to the present modification, the connection member 71, the take-up mechanism 172, the cord-like member 173 and the handle 174 that serve as a filter drive mechanism for manually causing the filter 7 to move downward through the guide opening 24 are disposed in the casing 2, so the filter 7 can be lowered while work in a high place is avoided.

(11) Modification 7

Figure 17:
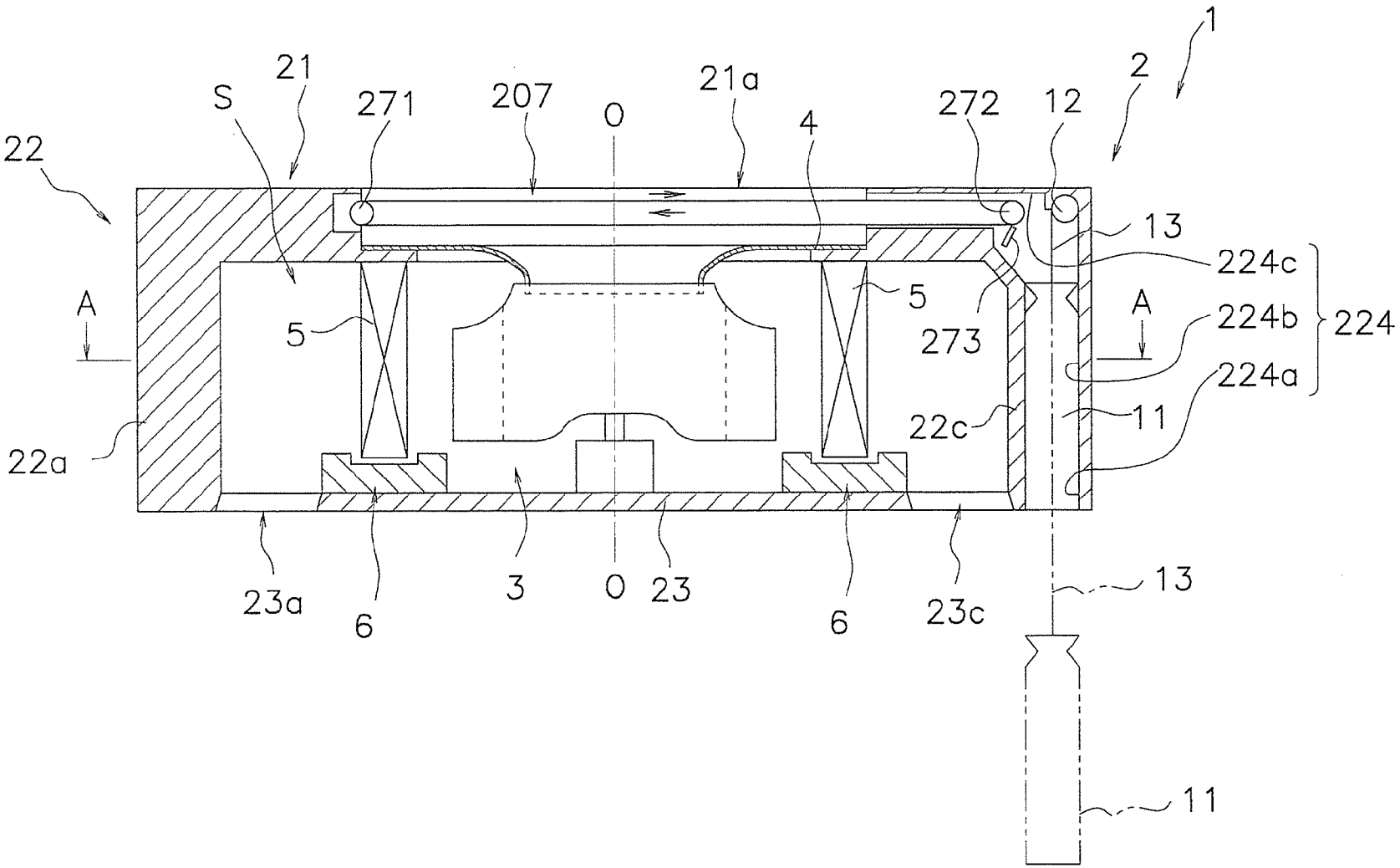
FIG. 17 is a general side sectional view (with a ceiling being omitted) of a ceiling-mounted air conditioner pertaining to modification 7 of the first embodiment.

In the air conditioner 1 pertaining to the preceding embodiment and modifications 1 to 6, a filter configured by a frame member that comprises a soft resin material and a net-like member that is formed integrally with the frame member is used as the filter, and the filter can be caused to move downward from the bottom surface of the casing 2 through the guide opening 24 that serves as a filter guide portion, whereby a structure that is capable of easily attaching and detaching the filter 7 during cleaning is obtained even though the air conditioner has a configuration where the suction opening 21*a* is disposed in the top surface of the casing 2, but instead of a structure that causes the filter itself to move downward, a cleaning mechanism that removes dust that the filter disposed in the suction opening 21*a* has trapped from the filter and a dust box that collects dust removed by the cleaning mechanism may also be disposed. For example, taking as an example the case of the preceding embodiment, as shown in FIG. 17, a filter 207 that comprises a roll filter can be disposed in the suction opening 21*a*, and a brush 273 that serves as a cleaning mechanism that removes dust that the filter 207 has trapped from the filter 207 and a dust box 11 that collects dust brushed off by the brush 273 can be disposed.

More specifically, a housing opening 224*a* is formed between one of the blowout openings (here, the blowout opening 23*c*) in the bottom plate 23 and the long side that corresponds to this blowout opening 23*c*, and the housing opening 224*a* extends upward and reaches as far as the bottom end of the side plate 22*c*. Additionally, a housing opening 224*b* that is communicated with the housing opening 224*a* is formed in the side plate 22*c*, and the housing opening 224*b* extends upward and reaches as far as the bottom end of the top plate 21. Additionally, a housing opening 224*c* that is communicated with the housing opening 224*b* is formed in the top plate 21, and the housing opening 224*c* extends upward as far as the vicinity of the top end of the top plate 21, thereafter extends horizontally toward the portion of the peripheral edge portion of the suction opening 21*a* that is near the side plate 22*c*, and penetrates to the suction opening 21*a*.

A first roller 271 that is supported on the casing 2 such that the first roller 271 may freely rotate and which is driven to rotate by a drive motor (not shown) is disposed in a portion of the peripheral edge portion of the suction opening 21*a* that is near the side plate 22*a*. Further, a second roller 272 that is supported on the casing 2 such that the second roller 272 may freely rotate is disposed inside the housing opening 224*c*. Additionally, the filter 207 is wound around these rollers 271 and 272 and moves in the direction of the arrows in FIG. 17 as a result of the drive motor being driven.

The brush 273 that serves as a cleaning mechanism is disposed in the vicinity of the second roller 272 in the housing opening 224*c* so as to contact the filter 207, and the brush 273 can remove dust that the filter 207 has trapped from the filter 207. Dust that has been brushed off of the filter 207 falls downward inside the housing openings 224*a* and 224*b*.

The dust box 11 is housed in the housing openings 224*a* and 224*b* in a state where the dust box 11 is movable in the vertical direction inside the housing openings 224*a* and 224*b*. That is, the dust box 11 is disposed in the side portion of the casing 2 on the side plate 22*c* side. Thus, dust that has been brushed off of the filter 207 by the brush 273 and falls downward inside the housing openings 224*a* and 224*b* collects inside the dust box 11. Additionally, a shaft portion 12 that is supported on the casing 2 such that the shaft portion 12 may freely rotate and which is driven to rotate by a take-up motor (not shown) is disposed in the top end of the housing opening 224*c*. The shaft portion 12 is connected to the top end of the dust box 11 by a cord-like member 13, and the shaft portion 12 can automatically cause the dust box 11 to move downward as a result of the take-up motor being driven. That is, a dust box drive mechanism for automatically causing the dust box II to move downward is configured by the shaft portion 12, the take-up motor that drives the shaft portion 12, and the cord-like member 13.

Cleaning of the filer 207 that uses the brush 273 that serves as a cleaning mechanism that removes dust that the filter 207 disposed in the suction opening 21*a* has trapped from the filter 207 and the dust box 11 that collects dust removed by the brush 273 will be described.

First, the drive motor of the filter 207 is driven to cause the filter 207 to move between the rollers 271 and 272. Then, dust that the filter 207 has trapped is brushed off of the filter 207 by the brush 273. Dust that has been brushed off is guided to the dust box 11 through the housing openings 224*c* and 224*b* and is collected inside the dust box 11. Thereafter, the cord-like member 13 is pulled out from the shaft portion 12 as a result of the take-up motor being driven, and the dust box 11 in which dust has collected is caused to move downward. For example, the dust box 11 is lowered as far as a position reachable by the hands of a worker, and dust is thereafter removed from the inside of the dust box 11. Then, after dust has been removed from the inside of the dust box 11, the cord-like member 13 is taken up onto the shaft portion 12 as a result of the take-up motor being driven, and the dust box 11 can again be installed inside the housing openings 224*a* and 224*b* (refer to the dust box 11 and the cord-like member 13 represented by the two-dotted chain lines in FIG. 17).

In the air conditioner 1 pertaining to the present modification, the brush 273 that serves as a cleaning mechanism that cleans the filter 207 disposed in the suction opening 21*a* is disposed, so dust can be removed from the filter 207 without having to remove the filter 207 from the suction opening 21*a*, and dust that has been removed by the brush 273 can be collected in the dust box 11. Thus, labor required to clean the filter 207 that is disposed in the suction opening 21*a* can be reduced.

Further, in the air conditioner 1 pertaining to the present modification, the shaft portion 12, the take-up motor that drives the shaft portion 12, and the cord-like member 13, which serve as a dust box drive mechanism for automatically causing the dust box 11 in which dust has been collected to move downward, are disposed, so the dust box 11 can be lowered while work in a high place can be avoided.

(12) Modification 8

Figure 18:
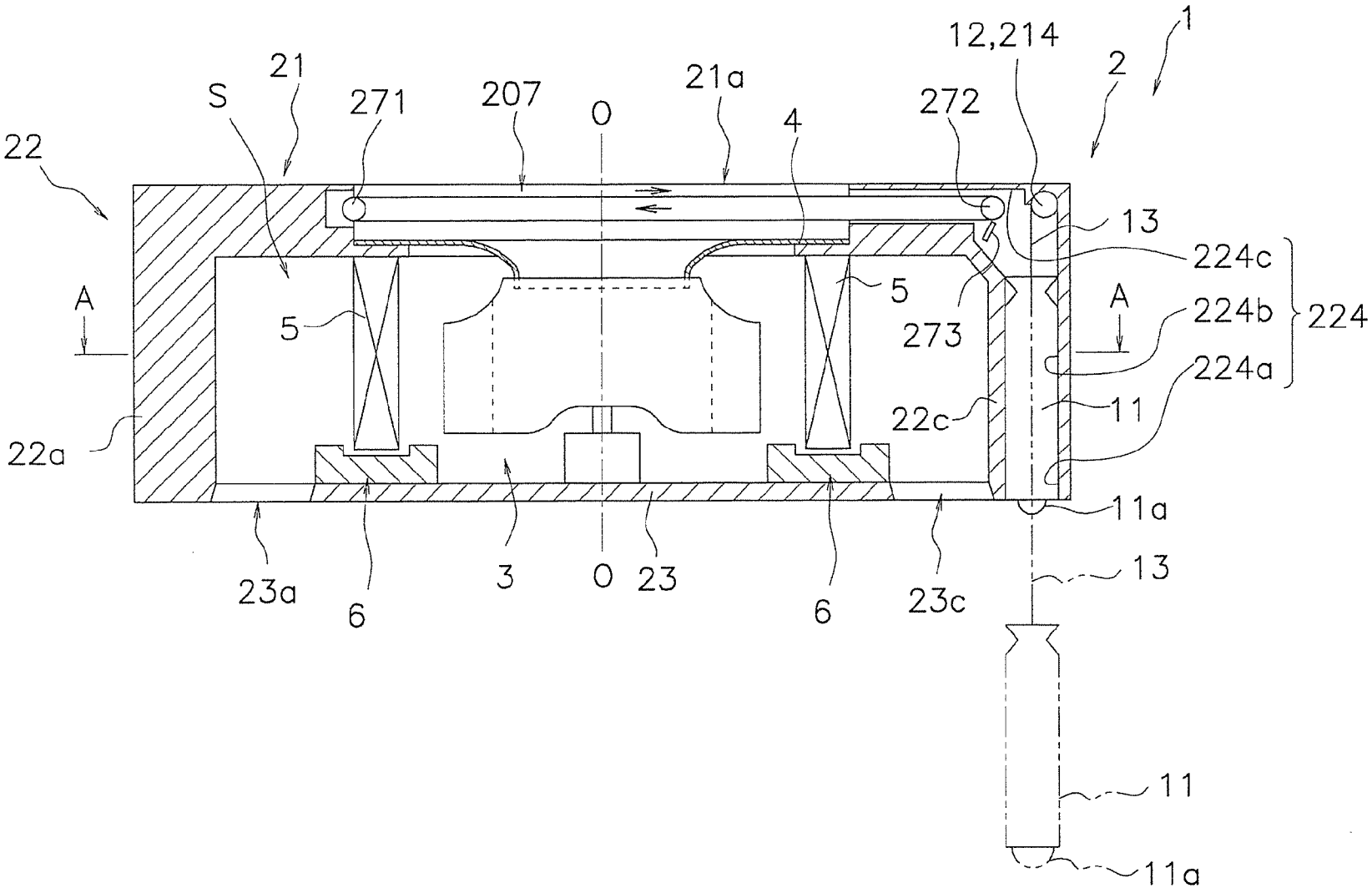
FIG. 18 is a general side sectional view (with a ceiling being omitted) of a ceiling-mounted air conditioner pertaining to modification 8 of the first embodiment.
Figure 19:
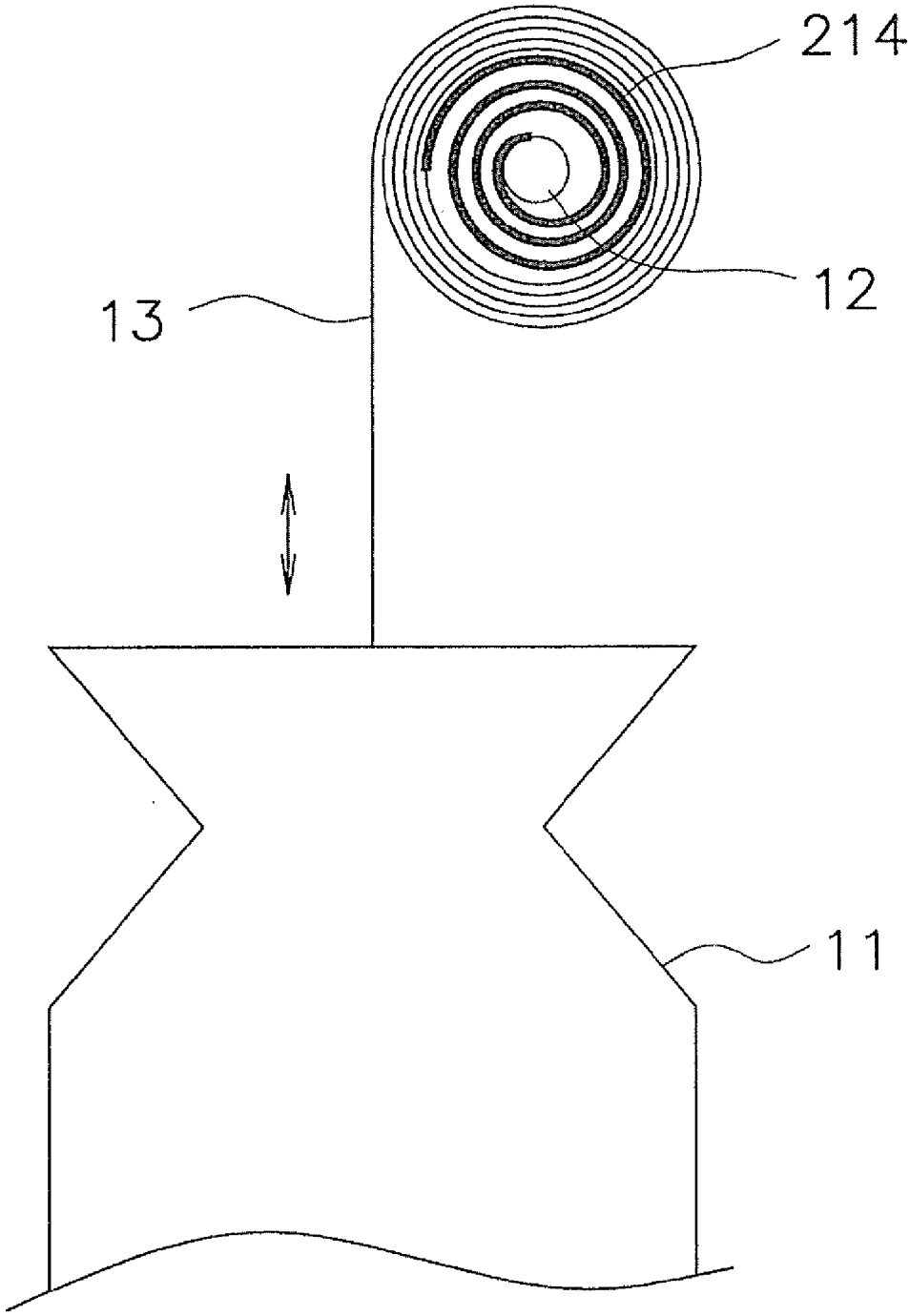
FIG. 19 is a general cross-sectional view showing the structure of a dust box drive mechanism pertaining to modification 8 of the first embodiment.

In the air conditioner 1 pertaining to modification 7, the shaft portion 12, the take-up motor that drives the shaft portion 12, and the cord-like member 13, which serve as a dust box drive mechanism for automatically causing the dust box 11 to move downward, are disposed, but a dust box drive mechanism for manually causing the dust box 11 to move downward may also be disposed. For example, taking as an example the case of modification 7, a dust box drive mechanism that comprises the shaft portion 12, a spiral spring 214, the cord-like member 13 and a handle 11*a* such as shown in FIG. 18 and FIG. 19 can be used.

More specifically, one end of the cord-like member 13 is, similar to modification 7, connected to the top end of the dust box 11. The shaft portion 12 is supported on the casing 2 such that the shaft portion 12 is incapable of rotating, and the spiral spring 214 is disposed around the shaft portion 12. Additionally, one end of the spiral spring 214 is connected to the shaft portion 12, and the other end of the spiral spring 214 is connected to the other end of the cord-like member 13. The spiral spring 214 is set such that, when the spiral spring 214 is in a free state, the cord-like member 13 is taken up and the dust box 11 is disposed inside the housing openings 224*a* and 224*b*, and in a state where the cord-like member 13 is fed out, spring force acts to try to take up the cord-like member 13. Additionally, the handle 11*a* is a member that is disposed on the bottom end of the dust box 11, and the handle 11*a* is used to manually cause the dust box 11 to move downward.

In this dust box drive mechanism that comprises the shaft portion 12, the spiral spring 214, the cord-like member 13 and the handle 11*a*, when the handle 11*a* is pulled downward using a grappling rod or the like on whose distal end is formed a claw or the like, the cord-like member 13 is pulled out from the shaft portion 12 overcoming the spring force of the spiral spring 214. Then, the dust box 11 is caused to move downward so that, for example, when removal of dust that has been collected in the dust box 11 is to be performed, the dust box 11 is lowered as far as a position reachable by the hands of a worker, and dust is thereafter removed from the inside of the dust box 11. Then, when the force acting on the spiral spring 214 is eased after dust has been removed from the inside of the dust box 11, the cord-like member 13 that had been pulled out from the shaft portion 12 is taken up onto the shaft portion 12 by the spring force of the spiral spring 214, whereby the dust box 11 can again be installed inside the housing openings 224*a* and 224*b* (refer to the dust box 11 and the cord-like member 13 represented by two-dotted chain lines in FIG. 18).

In the air conditioner 1 pertaining to the present modification, the shaft portion 12, the spiral spring 214, the cord-like member 13 and the handle 11*a* that serve as a dust box drive mechanism for manually causing the dust box 11 in which dust has been collected to move downward are disposed, so the dust box 11 can be lowered while work in a high place is avoided.

(13) Modification 9

Figure 20:
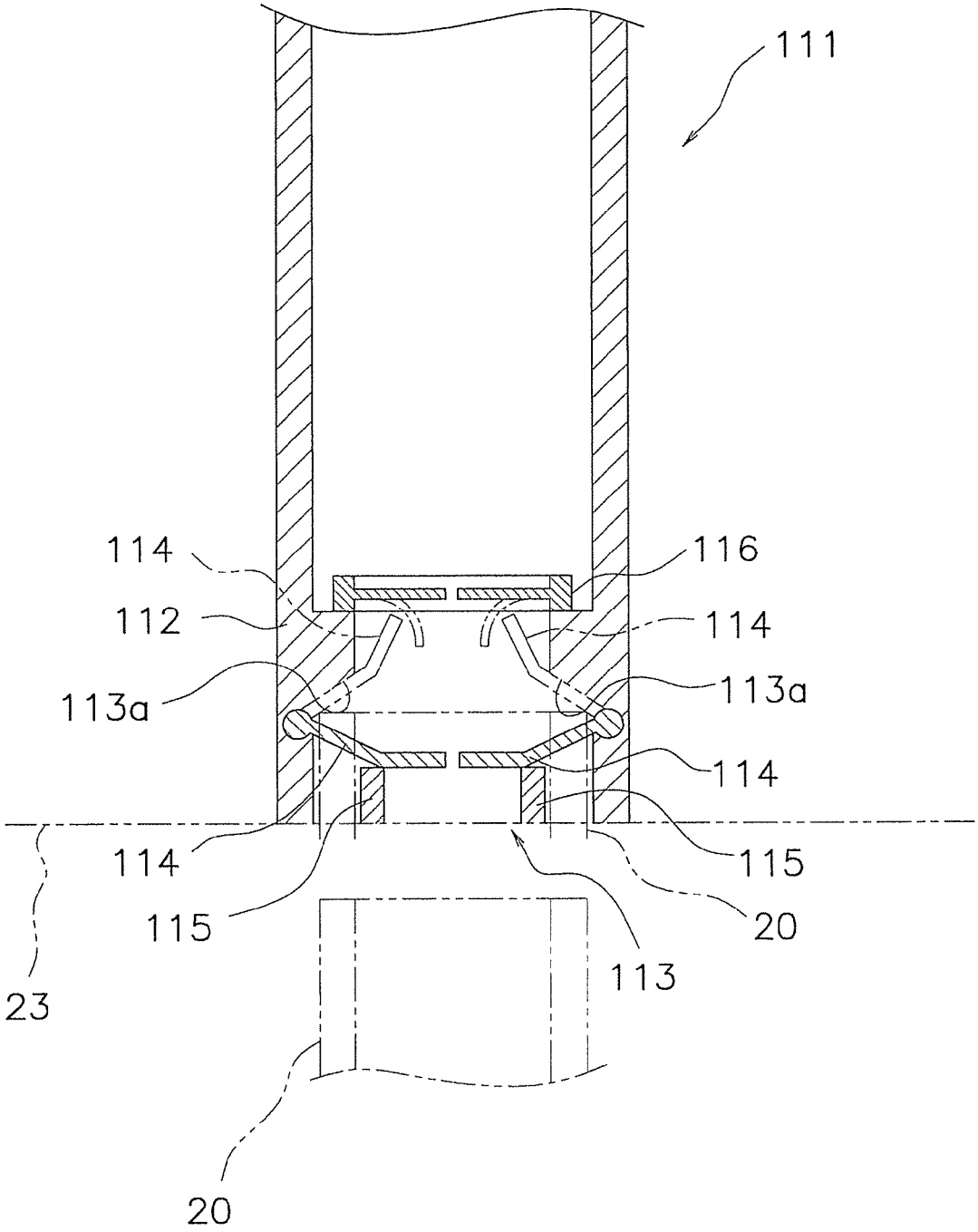
FIG. 20 is a general side sectional view showing the structure of a dust box pertaining to modification 9 of the first embodiment.

In the air conditioner 1 pertaining to modifications 7 and 8, a structure is employed where, by disposing a dust box drive mechanism, the dust box 11 is caused to move downward, the dust box 11 is taken out from the inside of the casing 2, and dust that has collected inside the dust box 11 is removed, but instead of a structure that causes the dust box itself to move downward, a structure where dust that has collected inside the dust box 11 is sucked and removed with a vacuum cleaner may also be employed. For example, taking as an example the cases of modifications 7 and 8, as shown in FIG. 20, a nozzle insertion opening 113, into which a nozzle 20 of a vacuum cleaner is capable of being inserted, can be formed facing down in a dust box 111.

More specifically, the nozzle insertion opening 113, into which the nozzle 20 of the vacuum cleaner is capable of being inserted, is formed facing down in a first wall portion 112 that configures the bottom surface of the dust box 111. Open/close lids 114 that open as a result of the nozzle 20 of the vacuum cleaner being inserted into the nozzle insertion opening 113 and close as a result of the nozzle 20 of the vacuum cleaner being removed from the nozzle insertion opening 113 are disposed in the nozzle insertion opening 113. The open/close lids 114 are a pair of plate-like members that are pivotally supported on the first wall portion 112 of the dust box 111 so as to be capable of opening and closing in the vertical direction, the open/close lids 114 are pushed upward by the distal end of the nozzle 20 of the vacuum cleaner and opens as a result of the nozzle 20 of the vacuum cleaner being inserted from below into the nozzle insertion opening 113, the open/close lids 114 close by their own weight when the force by which the open/close lids 114 are pushed upward by the distal end of the nozzle 20 of the vacuum cleaner is released as a result of the nozzle 20 of the vacuum cleaner being removed downward from the nozzle insertion opening 113, and the open/close lids 114 contact stopper portions 115 that are disposed below the open/close lids 114 in the nozzle insertion opening 113. The stopper portions 115 are formed in the lowermost portion of the nozzle insertion opening 113 so as to fit into the inner surface of the nozzle of the vacuum cleaner. Further, an inner valve 116 that comprises a material that is elastically deformable by the suction force of the vacuum cleaner is disposed in the dust box 111. The inner valve 116 is disposed above the open/close lids 114. A soft gum or rubber can be used as the material of the inner valve 116.

In the dust box 111 having this structure, when dust has collected in the dust box 111, the nozzle 20 of the vacuum cleaner is inserted from below into the nozzle insertion opening 113, whereby the open/close lids 114 are pushed upward by the distal end of the nozzle 20 of the vacuum cleaner and open, and the vacuum cleaner is operated to suck the dust that has collected inside the dust box 111 into the vacuum cleaner from the inside of the dust box 111. At this time, the inner valve 116 is elastically deformed by the suction force of the vacuum cleaner (see FIG. 20), so dust that has collected inside the dust box 111 is quickly removed from the inside of the dust box 111 and sucked into the vacuum cleaner. Then, when the work of removing the dust that has collected inside the dust box 111 from the inside of the dust box 111 and sucking the dust into the vacuum cleaner ends, operation of the vacuum cleaner is stopped, and the nozzle 20 of the vacuum cleaner is removed from the nozzle insertion opening 113. Thus, the suction force of the vacuum cleaner no longer acts on the inner valve 116, and the inner valve 116 is closed. Further, the force by which the open/close lids 114 are pushed up by the nozzle 20 of the vacuum cleaner no longer acts, so the open/close lids 114 are closed by their own weight.

In the air conditioner 1 pertaining to the present modification, the nozzle insertion opening 113, into which the nozzle 20 of the vacuum cleaner is capable of being inserted, is formed facing down in the dust box 111, so dust that has been collected in the dust box 111 can be sucked into the vacuum cleaner from the inside of the dust box 111 and removed by the simple work of inserting the nozzle 20 of the vacuum cleaner into the nozzle insertion opening 113 from the underside of the air conditioner 1. Thus, in this air conditioner, labor required to clean the filter can be further reduced.

Further, the open/close lids 114 that open as a result of the nozzle 20 of the vacuum cleaner being inserted into the nozzle insertion opening 113 are disposed in the nozzle insertion opening 113, so until the work of sucking the dust that has been collected in the dust box 111 with the vacuum cleaner is performed, dust that has been collected in the dust box 111 by the cleaning mechanism (specifically, the brush 273 of FIG. 17 or FIG. 18) can be prevented from falling out from the nozzle insertion opening 113, and work in a high place for opening the open/close lids 114 can be avoided. Further, because the open/close lids 114 close by their own weight, the open/close lids 114 can be closed by removing the nozzle 20 of the vacuum cleaner from the nozzle insertion opening 113.

Moreover, the inner valve 116 that comprises a material (e.g., a soft gum or rubber) that is elastically deformable by the suction force of the vacuum cleaner is disposed in the dust box 111, so dust that has been collected in the dust box 111 by the cleaning mechanism (specifically, the brush 273 of FIG. 17 or FIG. 18) can be prevented from falling out from the nozzle insertion opening 113, and the work of sucking dust that has been collected in the dust box 111 into the vacuum cleaner from the inside of the dust box 111 and removing the dust can be performed easily.

(14) Modification 10

Figure 21:
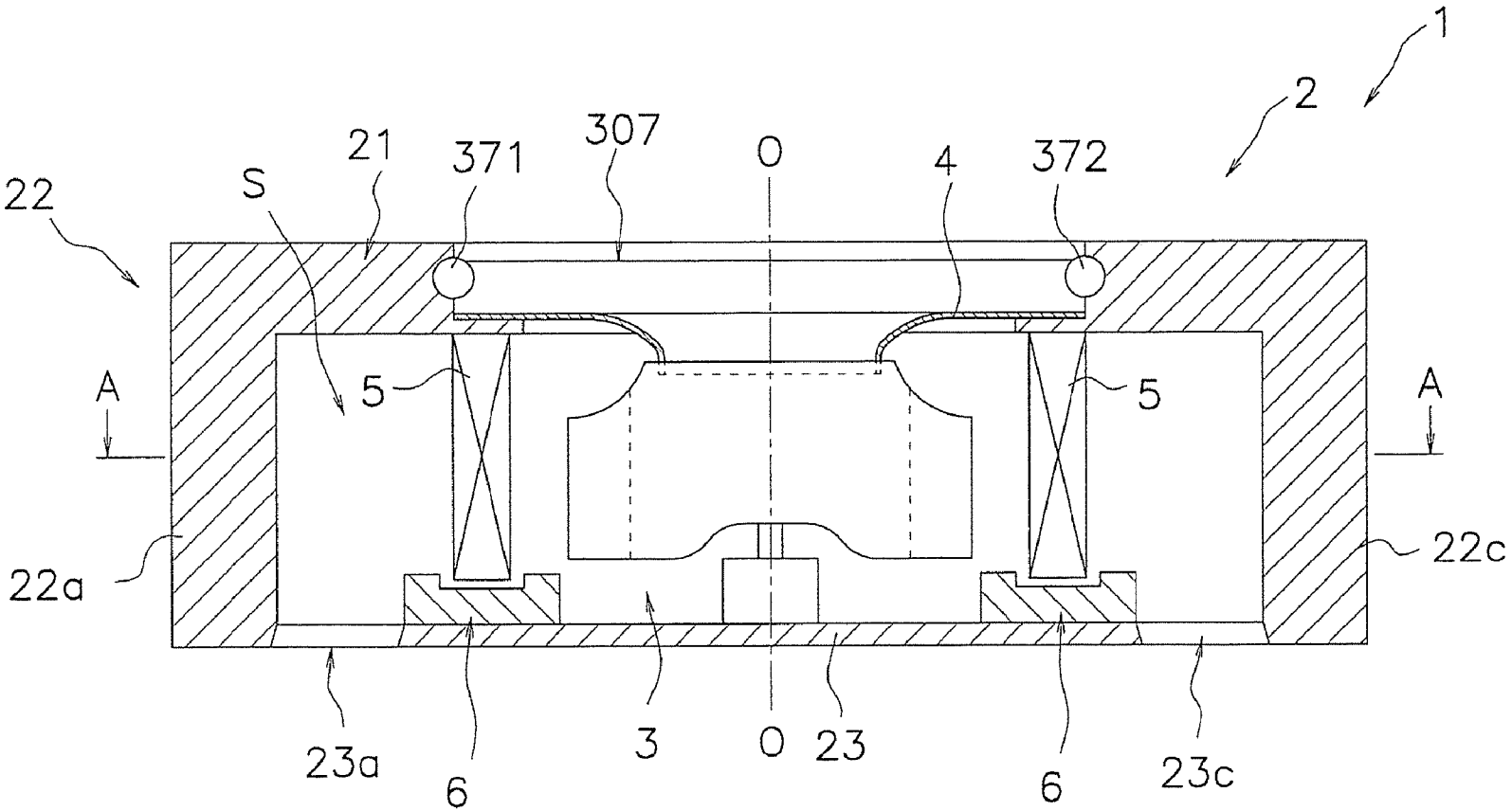
FIG. 21 is a general side sectional view (with a ceiling being omitted) of a ceiling-mounted air conditioner pertaining to modification 10 of the first embodiment.

In the air conditioner 1 pertaining to the preceding embodiment and modifications 1 to 9, a configuration is employed where, with the purpose of cleaning and reusing the filter, cleaning is performed by pulling out and removing the filter from the bottom surface of the casing 2, or, rather than removing the filter, dust that the filter has trapped is removed and collected in a dust box, but a take-up filter may also be employed and, without performing cleaning of the filter, replaced with a new take-up filter just when taking-up of the filter ends. For example, using the preceding embodiment as an example, as shown in FIG. 21, the air conditioner can be configured such that a first roller 371 that is driven to rotate by a take-up motor is disposed in a portion of the top plate 21 near the side plate 22*a*, a second roller 372 onto which an elongate cloth-like filter 307 is taken up is disposed in a portion of the top plate 21 near the side plate 22*c*, the filter 307 is stretched between the rollers 371 and 372 so as to face the suction opening 21*a*, and the take-up motor is periodically driven so that the filter 307 is taken up onto the first roller 371.

In the air conditioner 1 pertaining to the present modification, the take-up filter 307 is disposed in the suction opening 21*a*, so it is not necessary to perform cleaning of the filter 307, and it suffices for the take-up filter 307 to be replaced with a new take-up filter 307 just when the taking-up of the filter 307 ends, so effort to clean the filter can be spared.

(15) Modification 11

Figure 22:
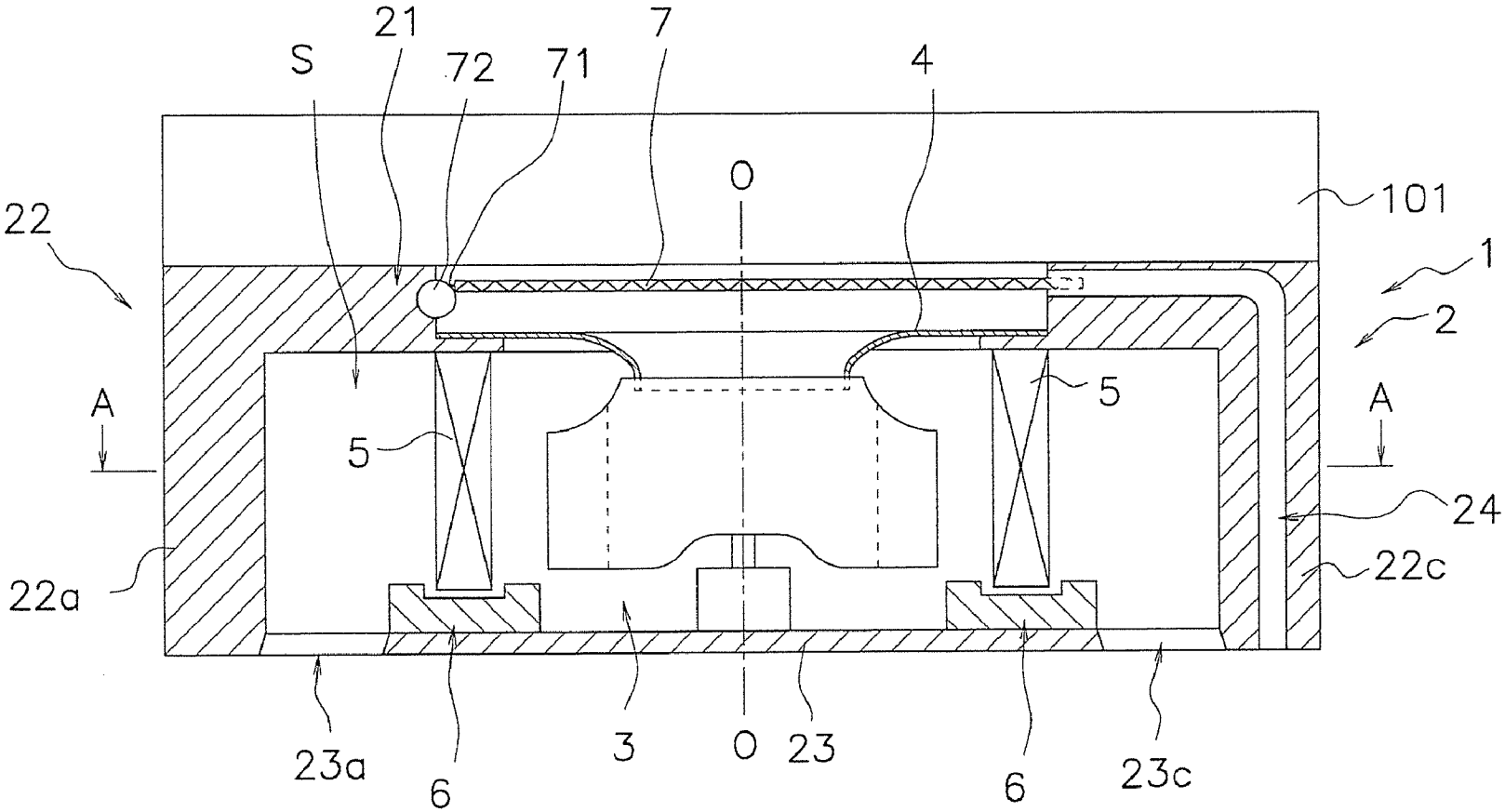
FIG. 22 is a general side sectional view (with a ceiling being omitted) of a ceiling-mounted air conditioner pertaining to modification 11 of the first embodiment.

In the air conditioner 1 pertaining to the preceding embodiment and modifications 1 to 10, as shown in FIG. 22, a so-called additional function unit 101 such as an air purifying unit, a deodorizing unit or a humidity controlling unit may also be installed on the top surface (that is, the top plate 21) of the casing 2 (as an example, a case is shown where the additional function unit 101 is installed on the air conditioner of the preceding embodiment). In this case, in comparison to a ceiling-mounted air conditioner where a suction opening and a blowout opening are formed in the bottom surface of the casing 2, placement of parts inside the additional function unit 101 can be performed without having to take into consideration interference with the blowout openings 23*a*, 23*b*, 23*c* and 23*d*, so compaction of the height direction dimension of the additional function unit 101 itself becomes possible and, resultantly, compaction of the overall height direction dimension of the air conditioner 1 disposed with the additional function unit 101 is also realized.

(16) Modification 12

Figure 23:
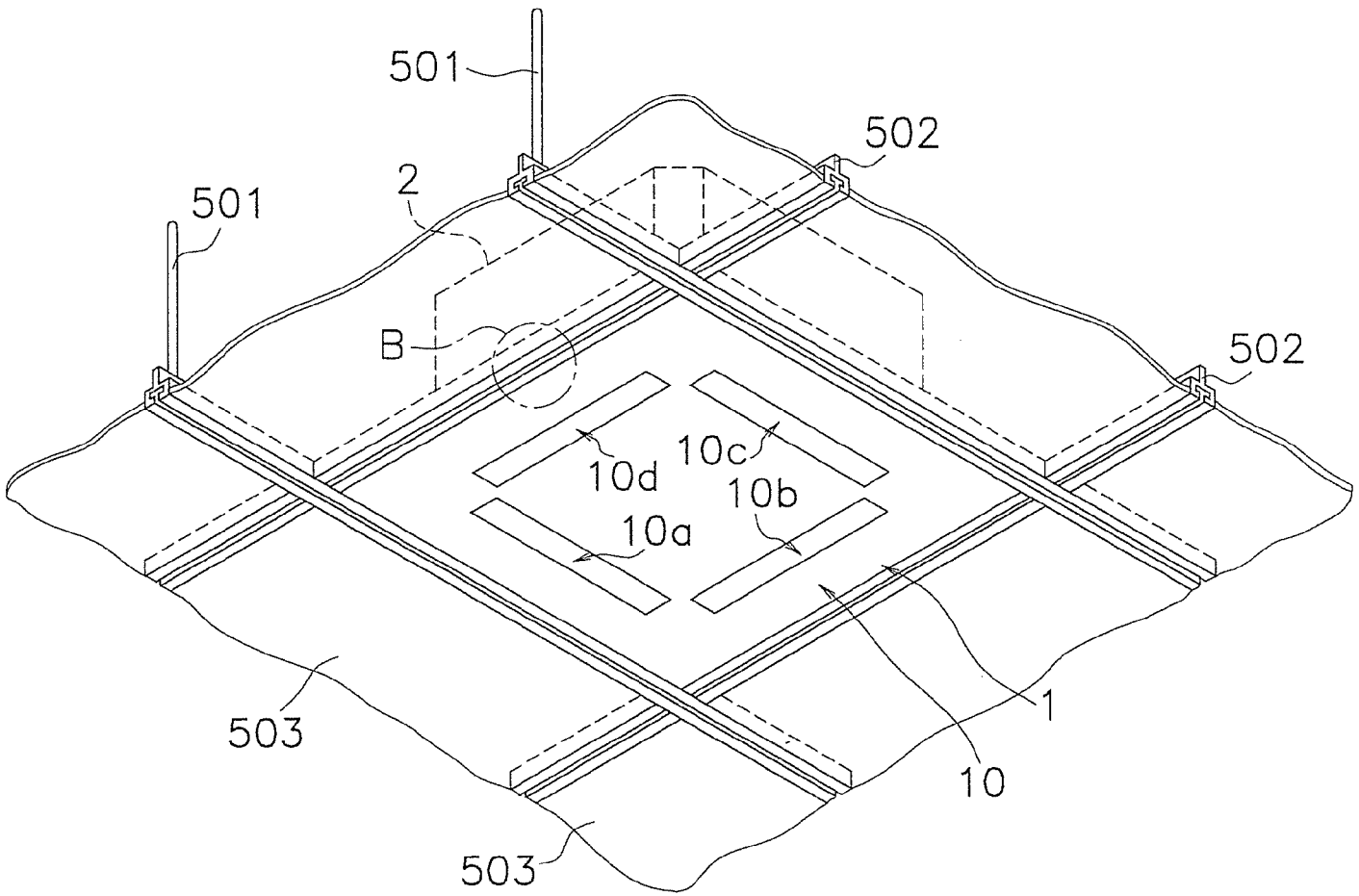
FIG. 23 is a general perspective view showing a state where a ceiling-mounted air conditioner pertaining to modification 12 of the first embodiment is installed in a grid system ceiling in a ceiling-embedded configuration.

There are cases where the air conditioner 1 pertaining to the preceding embodiment and modifications 1 to 11 is installed in a ceiling-embedded configuration in a grid system ceiling. Here, a grid system ceiling is, as shown in FIG. 23, a form of ceiling that mainly comprises T bars 502 that are suspended from above using hoisting accessories 501 and ceiling panels 503 that are supported by the T bars 502.

Figure 24:
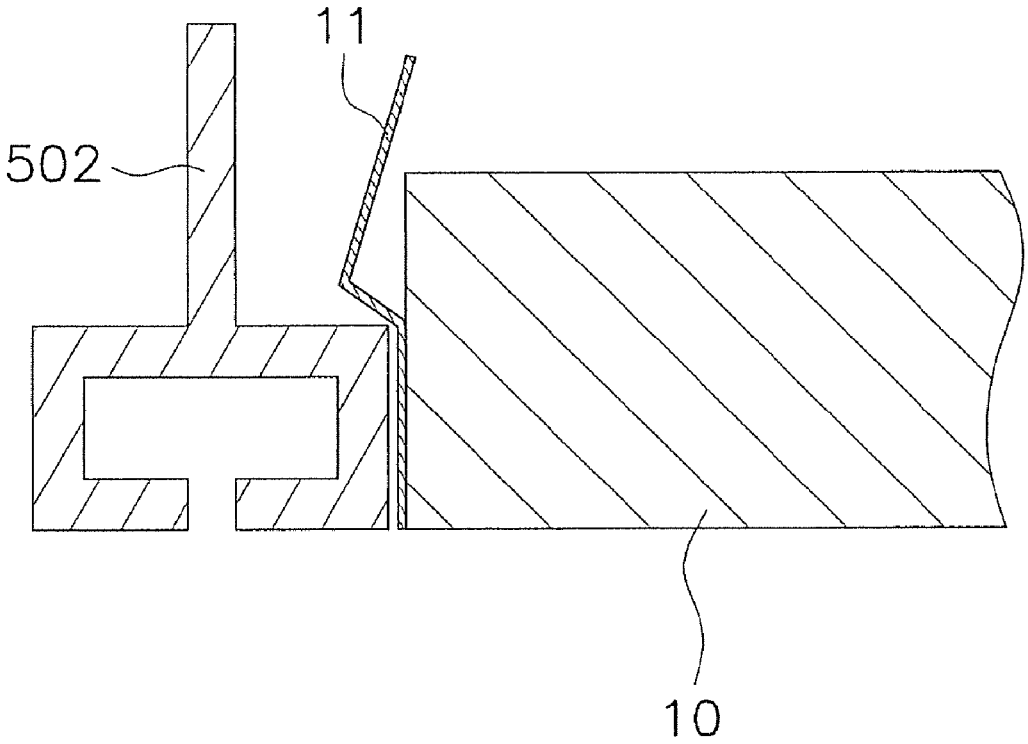
FIG. 24 is an enlarged cross-sectional view of portion B of FIG. 23.

In the present modification, taking into consideration workability when the air conditioner 1 is installed in a ceiling-embedded configuration in such a grid system ceiling and design after installation, the blowout panel 10 that is attached to the bottom surface of the casing 2 is given a size that is capable of being housed inside a rectangular frame formed by the T bars 502. Thus, by attaching the blowout panel 10, rather than a ceiling panel 503, to the T bars 502, the blowout panel 10 can be installed so as to become substantially flat with a ceiling surface that comprises a grid system ceiling. Here, for example, as shown in FIG. 24, attachment of the blowout panel 10 to the T bars 502 can be performed by disposing plate springs 11 on the outer peripheral edges of the blowout panel 10, fitting the blowout panel 10 from below inside a rectangular frame formed by the T bars 502, and locking the blowout panel 10 to the T bars 502 utilizing the elastic deformation of the plate springs 11.

(17) Modification 13

When the air conditioner 1 pertaining to the preceding embodiment and modifications 1 to 12 is installed in a ceiling-suspended configuration, the air flow path S that leads from the suction opening 21*a* that is formed in the top surface of the casing 2 or the suction opening 21*b* that is formed in the side surface of the casing 2 to the blowout openings 23*a* to 23*d* that are formed in the bottom surface of the casing 2 is formed, and a wide region that is utilizable in comparison to a conventional air conditioner of a configuration where a suction opening is formed on the inner peripheral side of a blowout opening is present on the inner peripheral side of the blowout openings 23*a* to 23*d* when the casing 2 is seen in a plan view.

Figure 25:
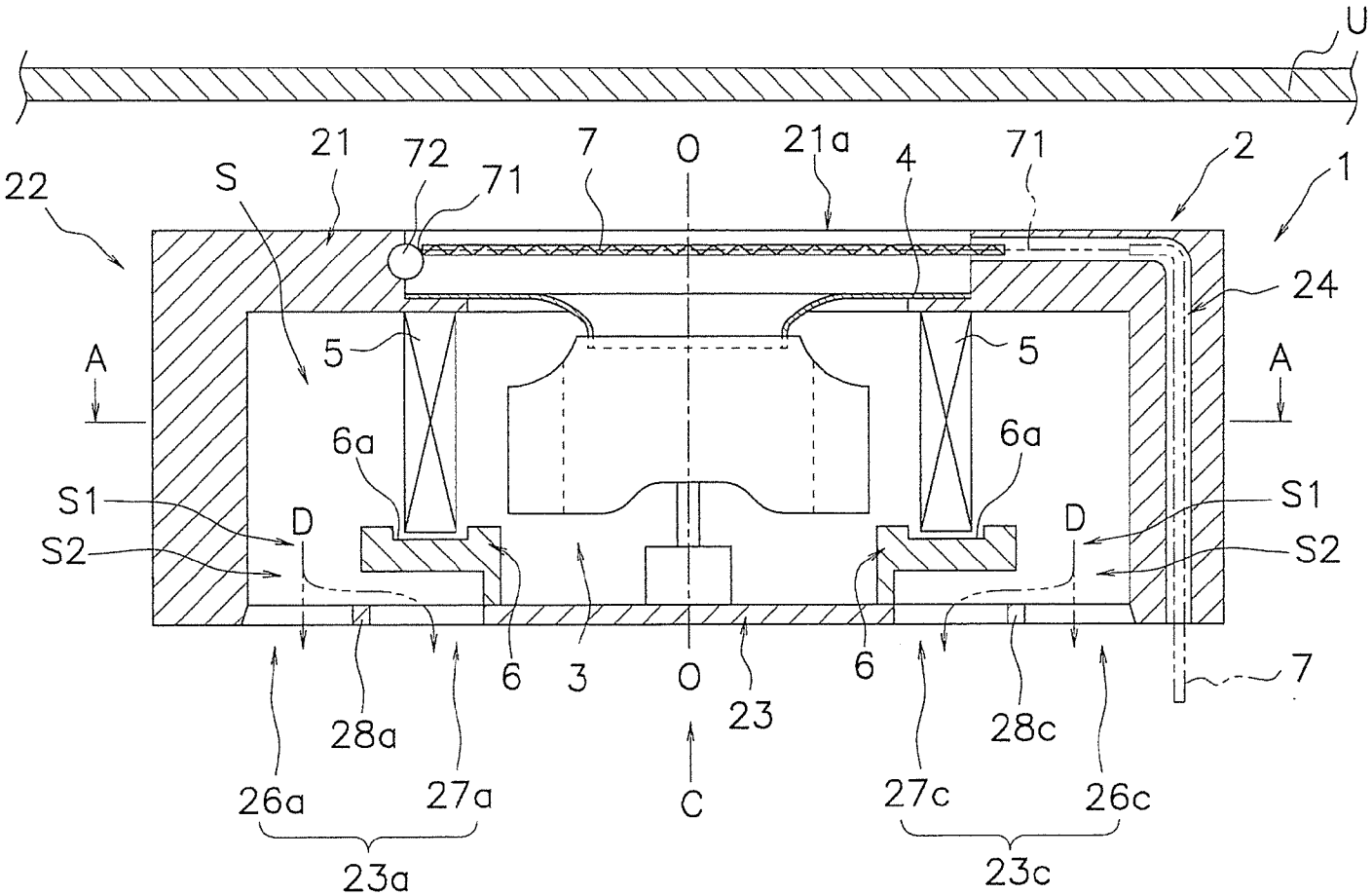
FIG. 25 is a view that corresponds to FIG. 4 and shows a state where a ceiling-mounted air conditioner pertaining to modification 13 of the first embodiment is given a ceiling-suspended configuration.
Figure 26:
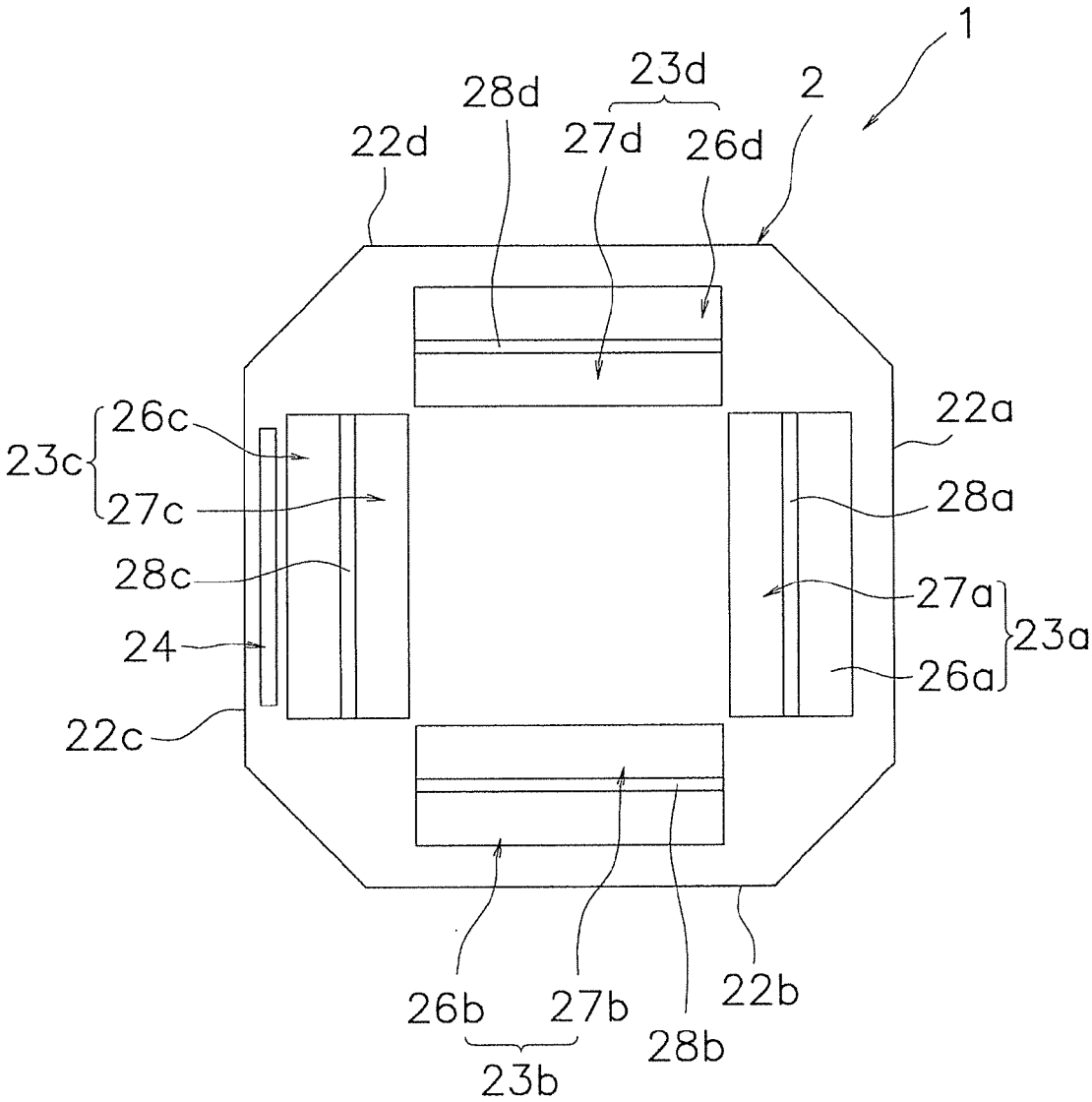
FIG. 26 is a view seen from arrow C of FIG. 25.

Utilizing this fact, in the present modification, for example, as shown in FIG. 25 and FIG. 26, in a blowout flow path S1 through which air that has passed through the heat exchanger 5 flows toward the blowout openings 23*a*, 23*b*, 23*c* and 23*d* is formed in the air flow path S between the outer peripheral portion of the drain pan 6 and the side plate 22 (specifically, the side plates 22*a*, 22*b*, 22*c* and 22*d*) of the casing 2, an expanded flow path S2 that expands toward the inner peripheral side when the casing 2 is seen in a plan view is formed, and the opening area of each of the blowout openings 23*a*, 23*b*, 23*c* and 23*d* is also expanded in response to the flow path area of the expanded flow path S2. In the present modification, the expanded flow path S2 expands toward the inner peripheral side until it reaches directly below the drain receiving portion 6*a* of the drain pan 6 when the casing 2 is seen in a plan view. Further, partition portions 28*a*, 28*b*, 28*c* and 28*d* that partition each of the blowout openings 23*a*, 23*b*, 23*c* and 23*d* into outer blowout openings 26*a*, 26*b*, 26*c* and 26*d* that are portions on the outer peripheral side and inner blowout openings 27*a*, 27*b*, 27*c* and 27*d* that are portions on the inner peripheral side are disposed in the bottom surface of the casing 2.

In the air conditioner 1 in the present modification, the blowout openings 23*a* to 23*d* are formed along the outer peripheral edge of the bottom surface of the casing 2 (more specifically, along the long sides of the bottom plate 23), and the expanded flow path S2 that expands toward the inner peripheral side when the casing 2 is seen in a plan view is formed in the blowout flow path S1, so when the air conditioner 1 is installed in a ceiling-suspended configuration, drafts can be controlled and silencing can be achieved when air is blown out into the air-conditioned room from the blowout openings 23*a* to 23*d* (refer to arrows D in FIG. 25). In particular, in the air conditioner 1 in the present modification, the suction opening 21*a* or 21*b* is formed in the top surface or the side surface of the casing 2, so it becomes possible to enlarge the expanded flow path in comparison to a conventional air conditioner of a configuration where the suction opening is formed on the inner peripheral side of the blowout opening, and thus the effects of control of drafts and silencing when air is blown out into the air-conditioned room from the blowout openings 23*a* to 23*d* can be sufficiently obtained.

(18) Modification 14

When the air conditioner 1 pertaining to the preceding embodiment and modifications 1 to 12 is installed in a ceiling-embedded configuration, similar to when the air conditioner 1 is installed in a ceiling-suspended configuration, the air flow path S that leads from the suction opening 21*a* that is formed in the top surface of the casing 2 or the suction opening 21*b* that is formed in the side surface of the casing 2 to the panel blowout openings 10*a* to 10*d* that are formed in the blowout panel 10 is formed, and a wide region that is utilizable in comparison to a conventional air conditioner of a configuration where a suction opening is formed on the inner peripheral side of a blowout opening is present on the inner peripheral side of the panel blowout openings 10*a* to 10*d* when the blowout panel 10 is seen in a plan view.

Figure 27:
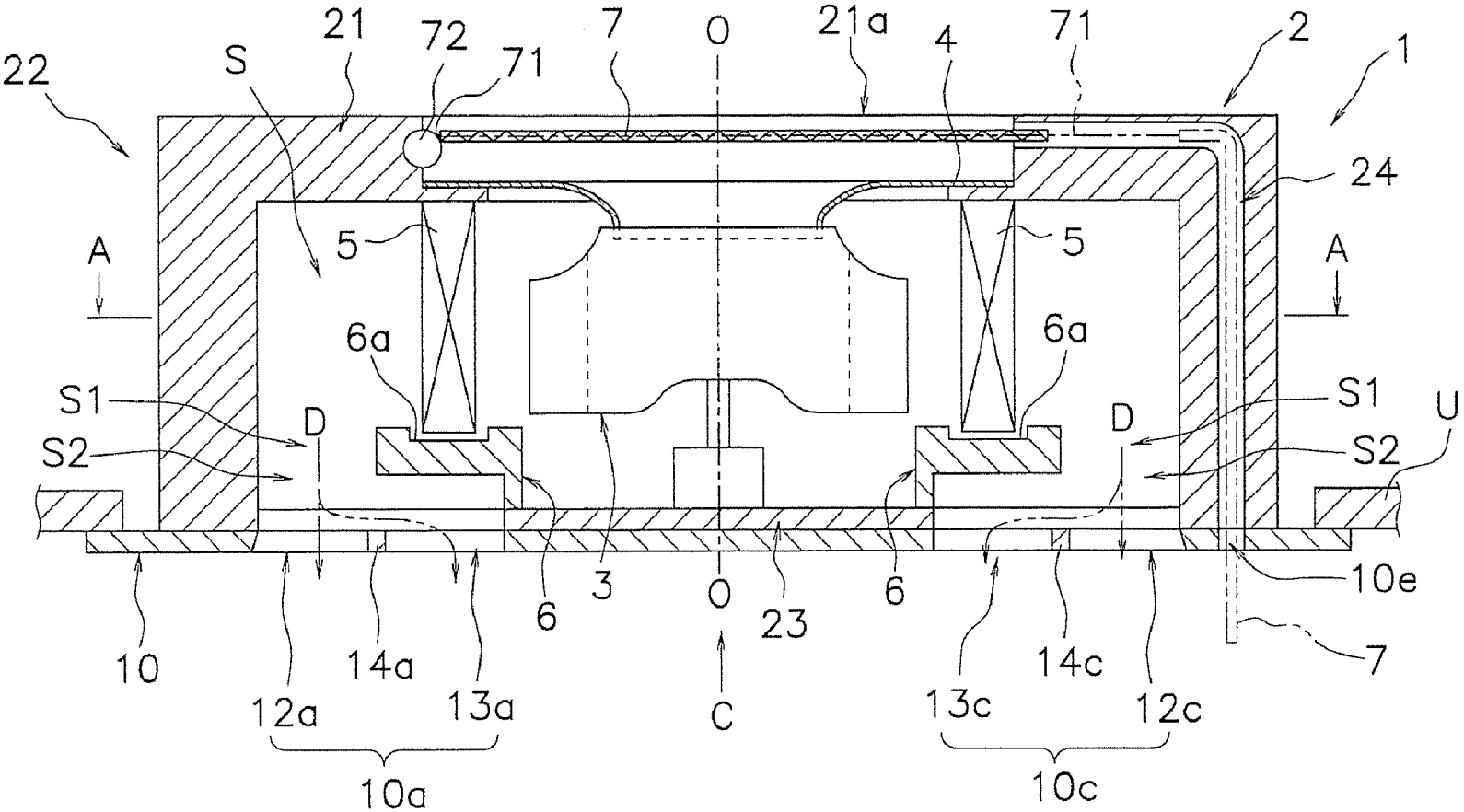
FIG. 27 is a view that corresponds to FIG. 5 and shows a state where a ceiling-mounted air conditioner pertaining to modification 14 of the first embodiment is given a ceiling-embedded configuration.
Figure 28:
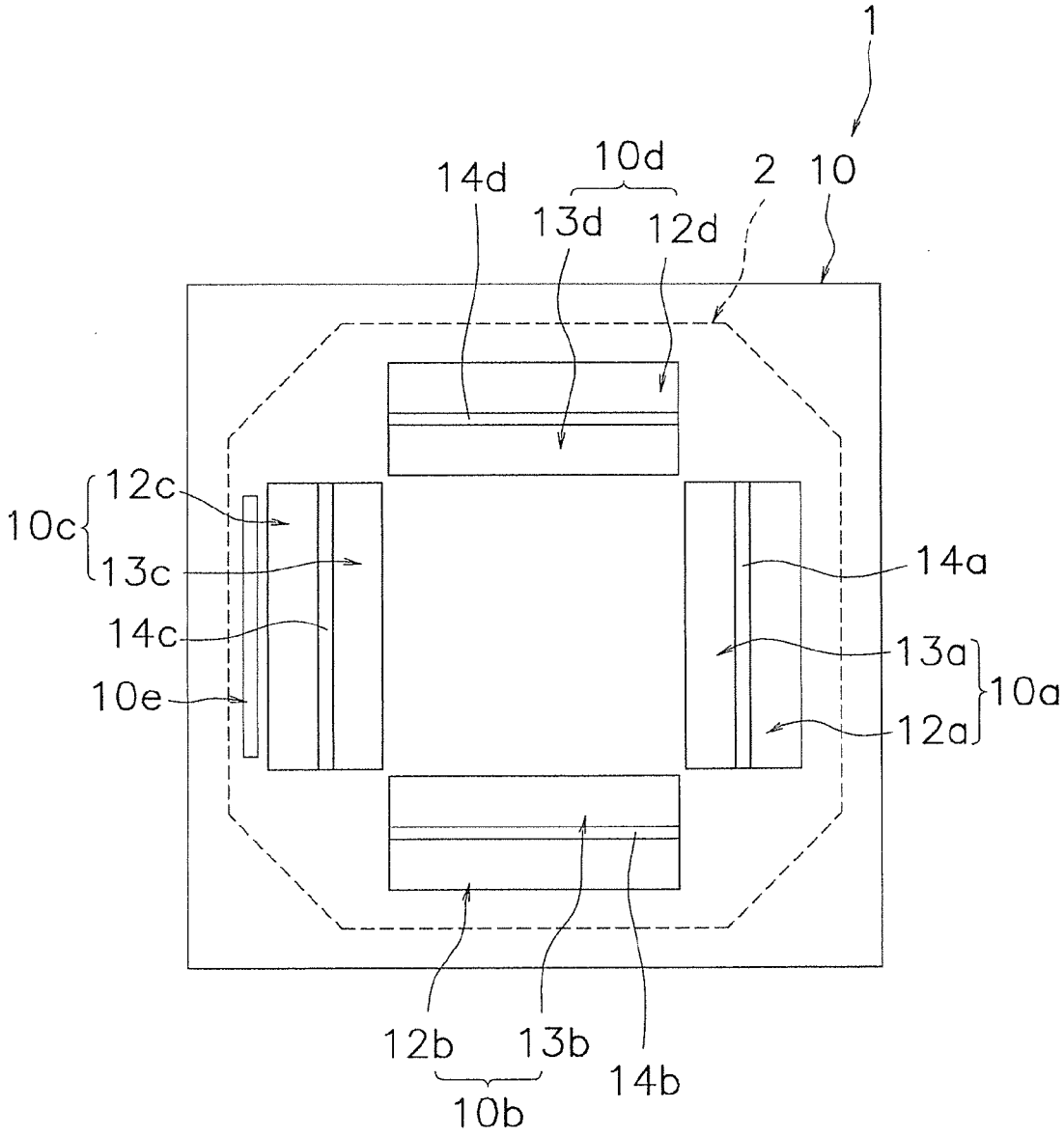
FIG. 28 is a view seen from arrow C of FIG. 27.

Utilizing this fact, in the present modification, for example, as shown in FIG. 27 and FIG. 28, in a blowout flow path S1 through which air that has passed through the heat exchanger 5 flows toward the panel blowout openings 10*a*, 10*b*, 10*c* and 10*d* is formed in the air flow path S between the outer peripheral portion of the drain pan 6 and the side plate 22 (specifically, the side plates 22*a*, 22*b*, 22*c* and 22*d*) of the casing 2, an expanded flow path S2 that expands toward the inner peripheral side when the casing 2 is seen in a plan view is formed, and the opening area of each of the panel blowout openings 10*a*, 10*b*, 10*c* and 10*d* is also expanded in response to the flow path area of the expanded flow path S2. In the present modification, the expanded flow path S2 expands toward the inner peripheral side until it reaches directly below the drain receiving portion 6*a* of the drain pan 6 when the casing 2 is seen in a plan view. Further, partition portions 14*a*, 14*b*, 14*c* and 14*d* that partition each of the panel blowout openings 10*a*, 10*b*, 10*c* and 10*d* into outer panel blowout openings 12*a*, 12*b*, 12*c* and 12*d* that are portions on the outer peripheral side and inner panel blowout openings 13*a*, 13*b*, 13*c* and 13*d* that are portions on the inner peripheral side are disposed in the blowout panel 10.

In the air conditioner 1 in the present modification, the panel blowout openings 10*a* to 10*d* are formed along the bottom surface of the casing 2 and the outer peripheral edge of the blowout panel 10, and the expanded flow path S2 that expands toward the inner peripheral side when the casing 2 is seen in a plan view is formed in the blowout flow path S1, so when the air conditioner 1 is installed in a ceiling-embedded configuration, similar to when the air conditioner 1 is installed in the ceiling-suspended configuration of modification 13, drafts can be controlled and silencing can be achieved when air is blown out into the air-conditioned room from the panel blowout openings 10*a* to 10*d* (refer to arrows D in FIG. 27). In particular, in the air conditioner 1 in the present modification, the suction opening 21*a* or 21*b* is formed in the top surface or the side surface of the casing, so it becomes possible to enlarge the expanded flow path in comparison to a conventional air conditioner of a configuration where the suction opening is formed on the inner peripheral side of the panel blowout opening, and thus the effects of control of drafts and silencing when air is blown out into the air-conditioned room from the panel blowout openings 10*a* to 10*d* can be sufficiently obtained.

Figure 29:
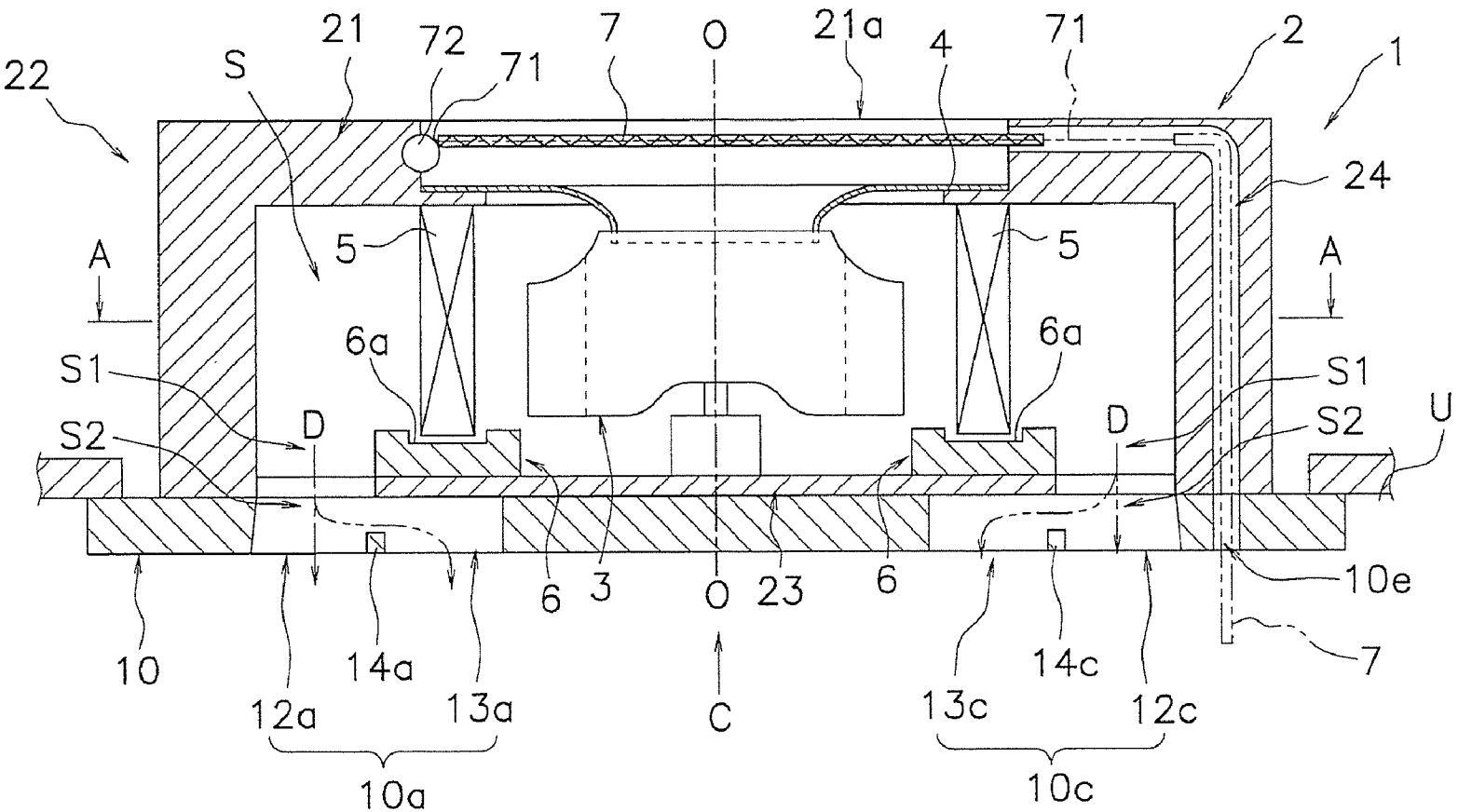
FIG. 29 is a view that corresponds to FIG. 5 and shows a state where the ceiling-mounted air conditioner pertaining to modification 14 of the first embodiment is given a ceiling-embedded configuration.

Further, in the air conditioner 1 shown in FIG. 27, the expanded flow path S2 is formed in the bottom portion of the casing 2, and an increase in the height direction dimension of the blowout panel 10 is prevented, but as shown in FIG. 29, the expanded flow path S2 may also be formed in the blowout panel 10. In this case, an increase in the height direction dimension of the casing 2 can be prevented.

(19) Modification 15

In the air conditioner 1 pertaining to the preceding modifications 13 and 14, a flow path area changing mechanism for changing the flow path areas of the expanded flow path S2 may also be disposed. Thus, by changing the flow path area of the expanded flow path S2 such that the flow path area of the expanded flow path S2 becomes smaller, air that is blown out from the blowout openings 23*a* to 23*d* or the panel blowout openings 10*a* to 10*d* can be caused to reach a place away from the blowout openings 23*a* to 23*d* or the panel blowout openings 10*a* to 10*d*.

Figure 30:
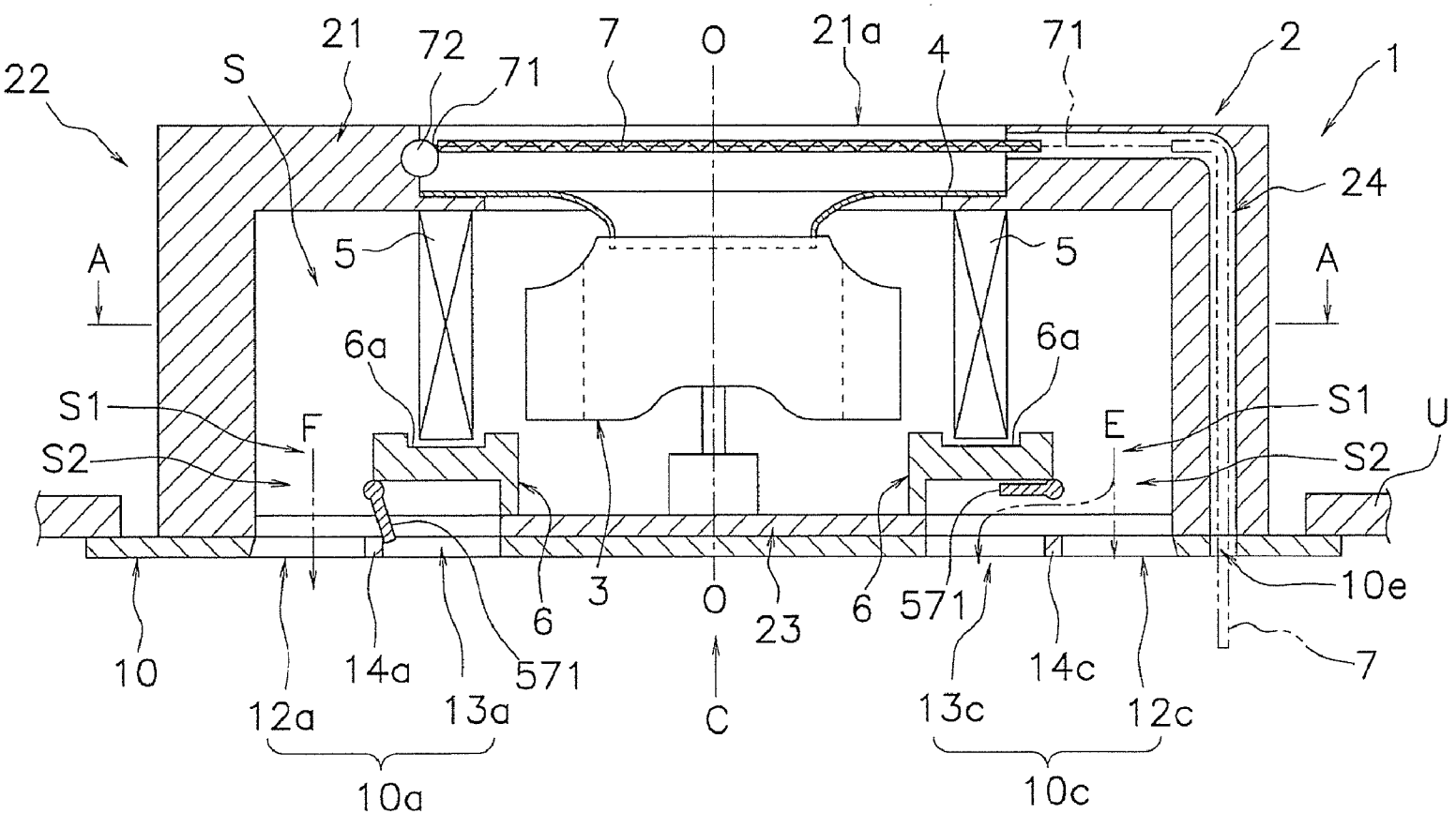
FIG. 30 is a view that corresponds to FIG. 5 and shows a state where a ceiling-mounted air conditioner pertaining to modification 15 of the first embodiment is given a ceiling-embedded configuration.

For example, as shown in FIG. 30, when the air conditioner 1 is installed in a ceiling-embedded configuration, dampers 571 that serve as a flow path area changing mechanism can be disposed in each of the blowout flow paths S1. Here, the dampers 571 are driven by an unillustrated motor or the like. Additionally, in the present modification, the dampers 571 are controlled such that, like the damper 571 disposed on the panel blowout opening 10*c* side in FIG. 30, the flow path area of the expanded flow path S2 becomes large during cooling operation and such that, like the damper 571 disposed on the panel blowout opening 10*a* side in FIG. 30, the flow path area of the expanded flow path S2 becomes small during heating operation. Thus, during cooling operation, cold drafts can be controlled and silencing can be achieved because air is blown out so as to disperse into the entire air-conditioned room from the entire panel blowout openings 10*a* to 10*d* (refer to arrow E in FIG. 30), and during heating operation, warm air that is blown out from the panel blowout openings 10*a* to 10*d* can be caused to reach the lower portion of the air-conditioned room because air is blown out with good momentum in a predetermined direction in the air-conditioned room from the outer panel blowout openings 12*a* to 12*d* of the panel blowout openings 10*a* to 10*d* (refer to arrow F in FIG. 30).

(20) Modification 16

In the air conditioner 1 pertaining to the preceding first embodiment and modifications 1 to 6 and 11 to 15, in the ceiling-mounted air conditioner 1 of a configuration disposed with the casing 2 in whose top surface or side surface is disposed the suction opening 21*a* or the suction opening 21*b*, the blow fan 3 that comprises a turbo fan or a diagonal flow fan disposed inside the casing 2, and the heat exchanger 5 that is disposed on the downstream side of the blow fan 3 in the air flow path S, the filter 7 that traps dust in air that is sucked in from the suction opening 21*a* or the suction opening 21*b* is disposed in the suction opening 21*a* or the suction opening 21*b*, and the filter 7 can be taken out through the bottom surface of the casing 2 by disposing the guide opening 24 that serves as a filter guide portion in the casing 2 (or the blowout panel 10 when the air conditioner 1 is used in a ceiling-embedded configuration) so that the filter 7 can be easily taken out, but the invention is not limited to this and may also be given a structure where the filter can be taken out from the bottom surface of the casing 2 by disposing the filter between the blow fan 3 and the heat exchanger 5.

Figure 31:
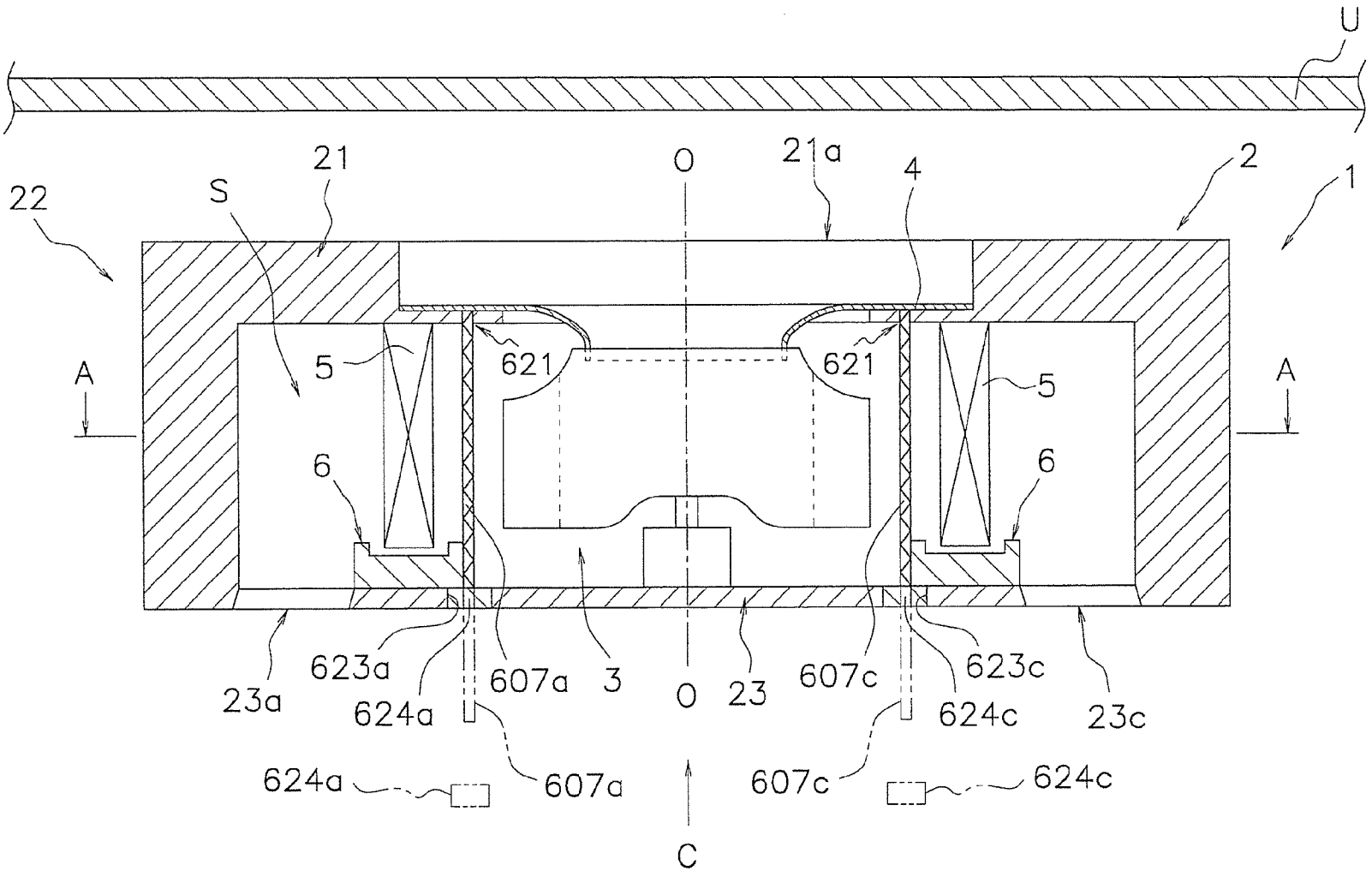
FIG. 31 is a view that corresponds to FIG. 4 and shows a state where a ceiling-mounted air conditioner pertaining to modification 16 of the first embodiment is given a ceiling-suspended configuration.
Figure 32:
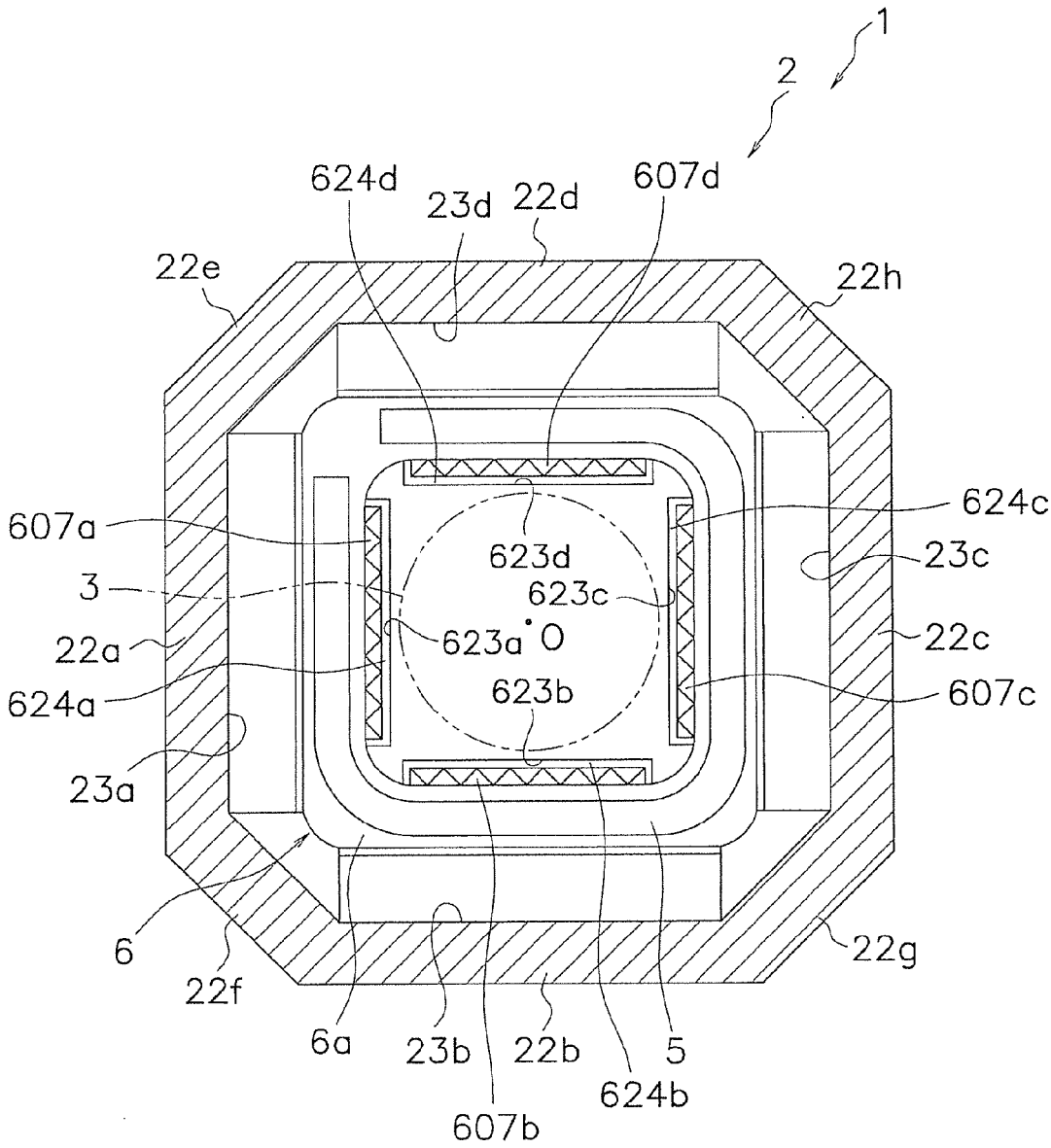
FIG. 32 is a view that corresponds to FIG. 2 and shows the ceiling-mounted air conditioner pertaining to modification 16 of the first embodiment.
Figure 33:
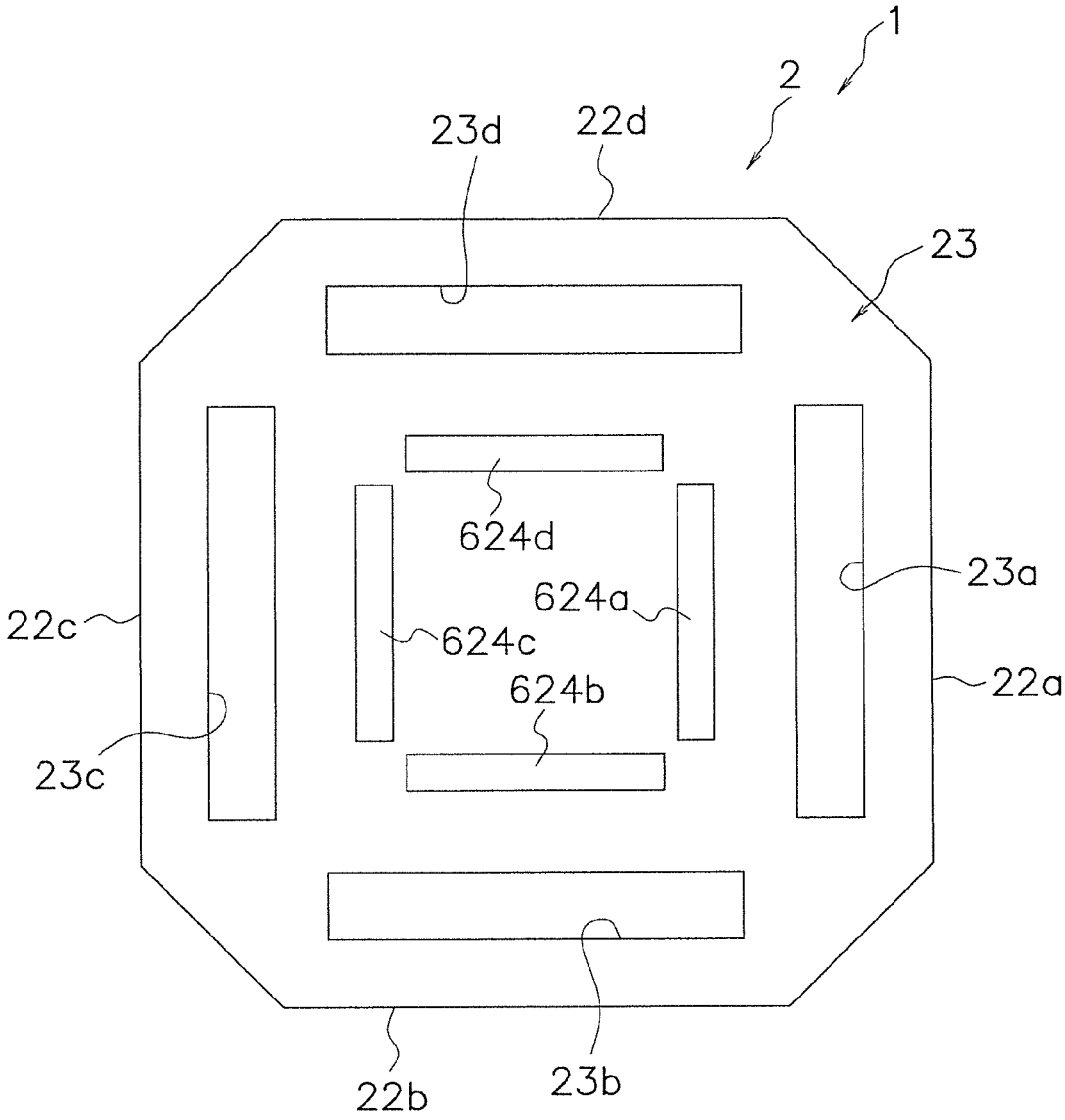
FIG. 33 is a view seen from arrow C of FIG. 31.

In the present modification, for example, as shown in FIG. 31 to FIG. 33, when the air conditioner 1 where the suction opening 21*a* is formed in the top surface of the casing 2 is installed in a ceiling-suspended configuration, instead of disposing a filter in the suction opening 21*a*, filters 607*a* to 607*d* are disposed between the blow fan 3 and the heat exchanger 5 so as to surround the outer periphery of the blow fan 3 when the casing 2 is seen in a plan view. The filters 607*a* to 607*d* are disposed so as to extend in the vertical direction and so as to face the side plates 22*a*, 22*b*, 22*c* and 22*d* of the casing 2, with the heat exchanger 5 being interposed between the filters 607*a* to 607*d* and the side plates 22*a*, 22*d*, 22*c* and 22*d*. Additionally, the top ends of the filters 607*a* to 607*d* are supported in, so as to be attachable to and detachable from, support portions 621 that are disposed in the top plate 21 of the casing 2. For example, concave portions or the like, into which the top ends of the filters 607*a* to 607*d* are capable of being fitted, can be employed as the support portions 621. Further, the bottom ends of the filters 607*a* to 607*d* are in proximity to the bottom plate 23 of the casing 2. Additionally, filter takeout holes 623*a* to 623*d* are formed in portions of the bottom plate 23 that face the bottom ends of the filters 607*a* to 607*d*. The filter takeout holes 623*a* to 623*d* are opened when the filters 607*a* to 607*d* are to be taken out from the inside of the casing 2, and ordinarily, cover members 624*a* to 624*d* that are part of the bottom plate 23 are detachably attached in the filter takeout holes 623*a* to 623*d*. It will be noted that, similar to the filter 7 pertaining to the first embodiment and modifications 1 to 6 and 11 to 15, filters configured by a frame member that comprises a resin material and a net-like member that is formed integrally with the frame member are capable of being used as the filters 607*a* to 607*d*, but it is preferable to use a frame member whose rigidity is high in comparison to that of the filter 7.

In the air conditioner 1 in the present modification, the filters 607*a* to 607*d* are disposed between the blow fan 3 and the heat exchanger 5, so the filters 607*a* to 607*d* can be taken out from the bottom surface of the casing 2 through the filter takeout holes 623*a* to 623*d* (refer to the filters 607*a* and 607*c* represented by the two-dotted chain lines in FIG. 31) by removing the cover members 624*a* to 624*d* (refer to the cover members 624*a* and 624*c* represented by the two-dotted chain lines in FIG. 31) that are part of the bottom surface (that is, the bottom plate 23) of the casing 2, and thus maintenance of the filters 607*a* to 607*d* can be performed easily even though the suction opening 21*a* or 21*b* is formed in the top or side surface of the casing 2.

Figure 34:
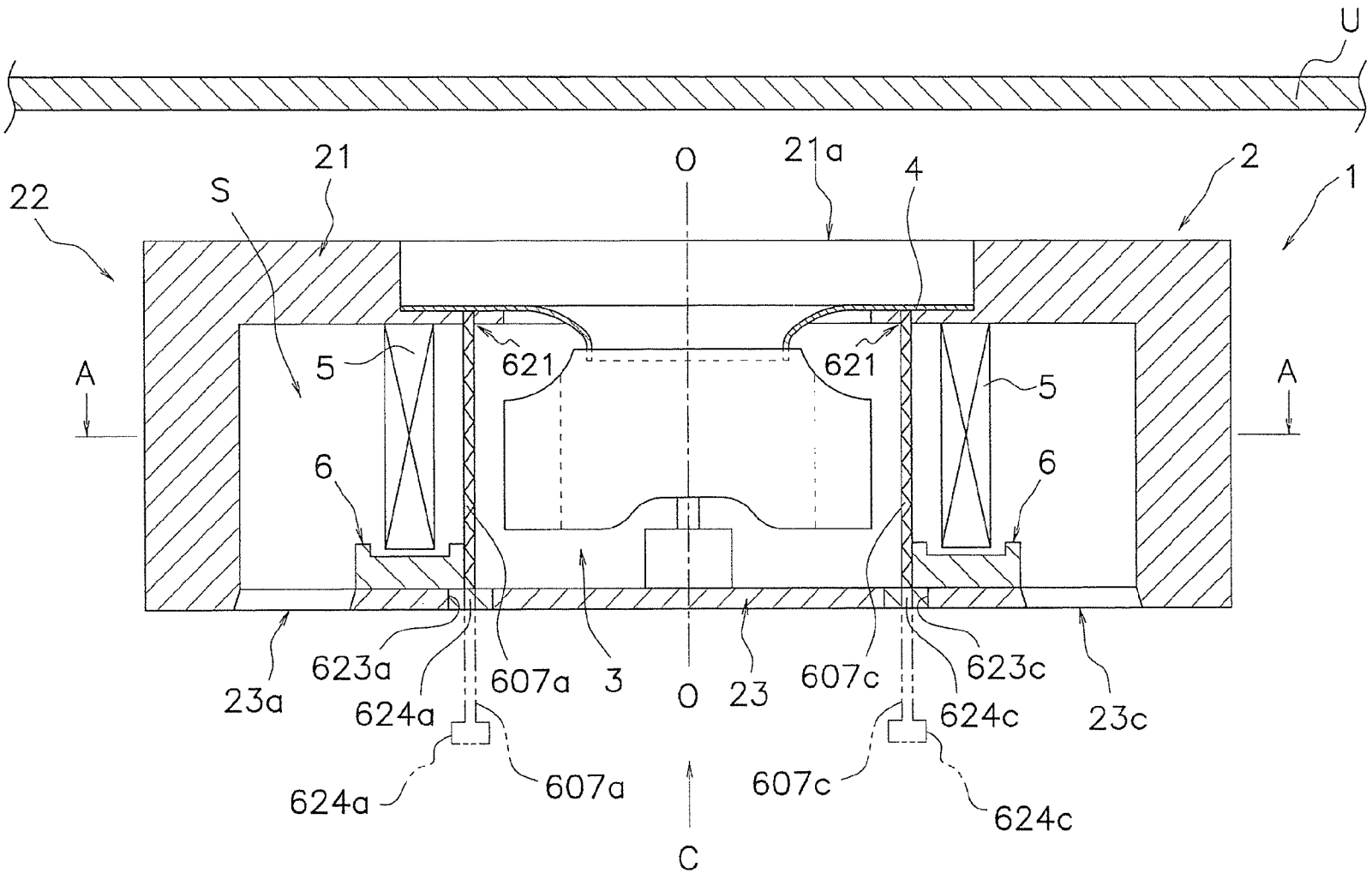
FIG. 34 is a view that corresponds to FIG. 4 and shows a state where the ceiling-mounted air conditioner pertaining to modification 16 of the first embodiment is given a ceiling-suspended configuration.

Further, as shown in FIG. 34, the bottom ends of the filters 607*a* to 607*d* may also be fixed to the top surfaces of the cover members 624*a* to 624*d*. In this case, the filters 607*a* to 607*d* can be taken out from the bottom surface of the casing 2 at the same time that the cover members 624*a* to 624*d* are removed (refer to the cover members 624*a* and 624*c* and the filters 607*a* and 607*c* represented by the two-dotted chain lines in FIG. 34).

Figure 35:
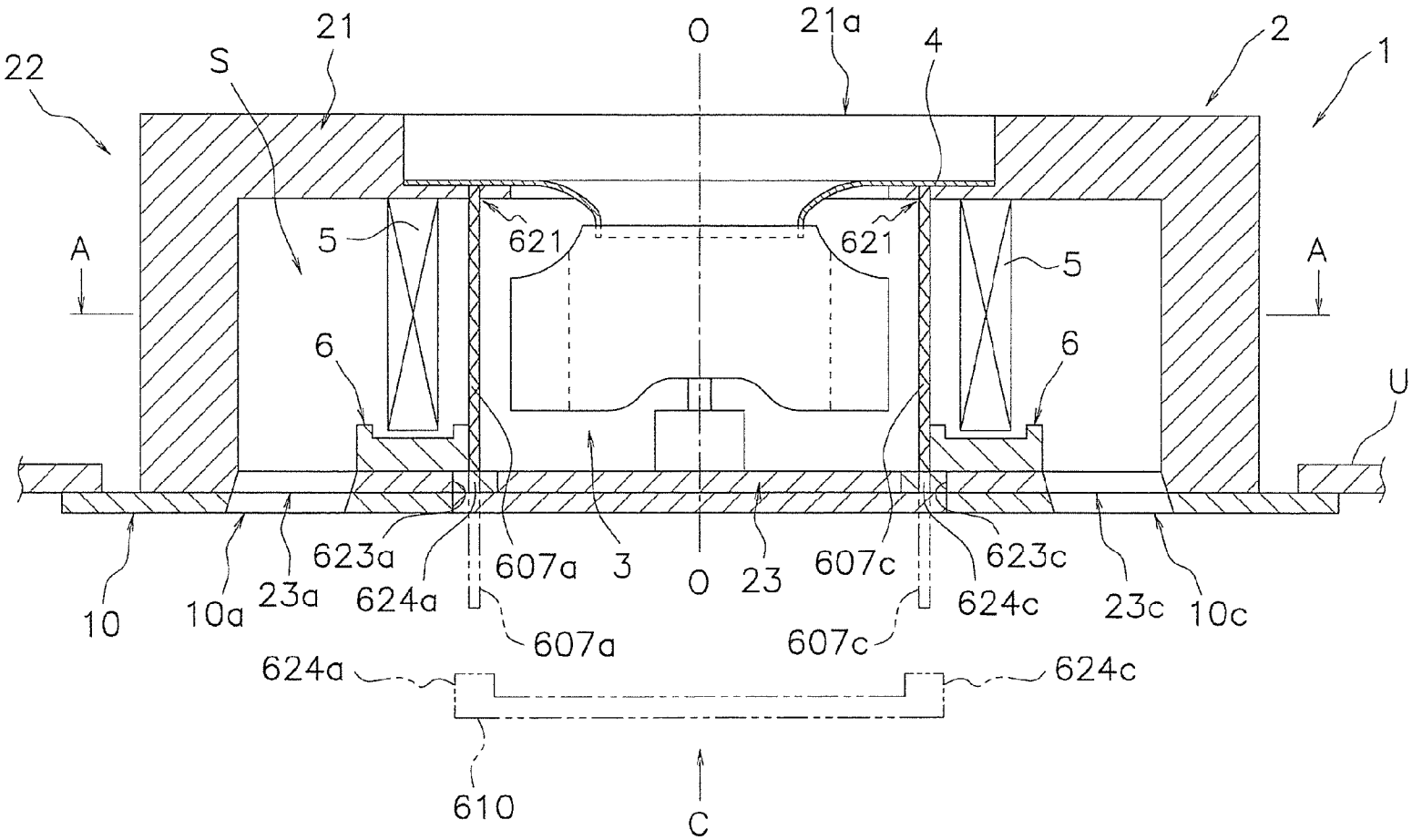
FIG. 35 is a view that corresponds to FIG. 5 and shows a state where the ceiling-mounted air conditioner pertaining to modification 16 of the first embodiment is given a ceiling-embedded configuration.
Figure 36:
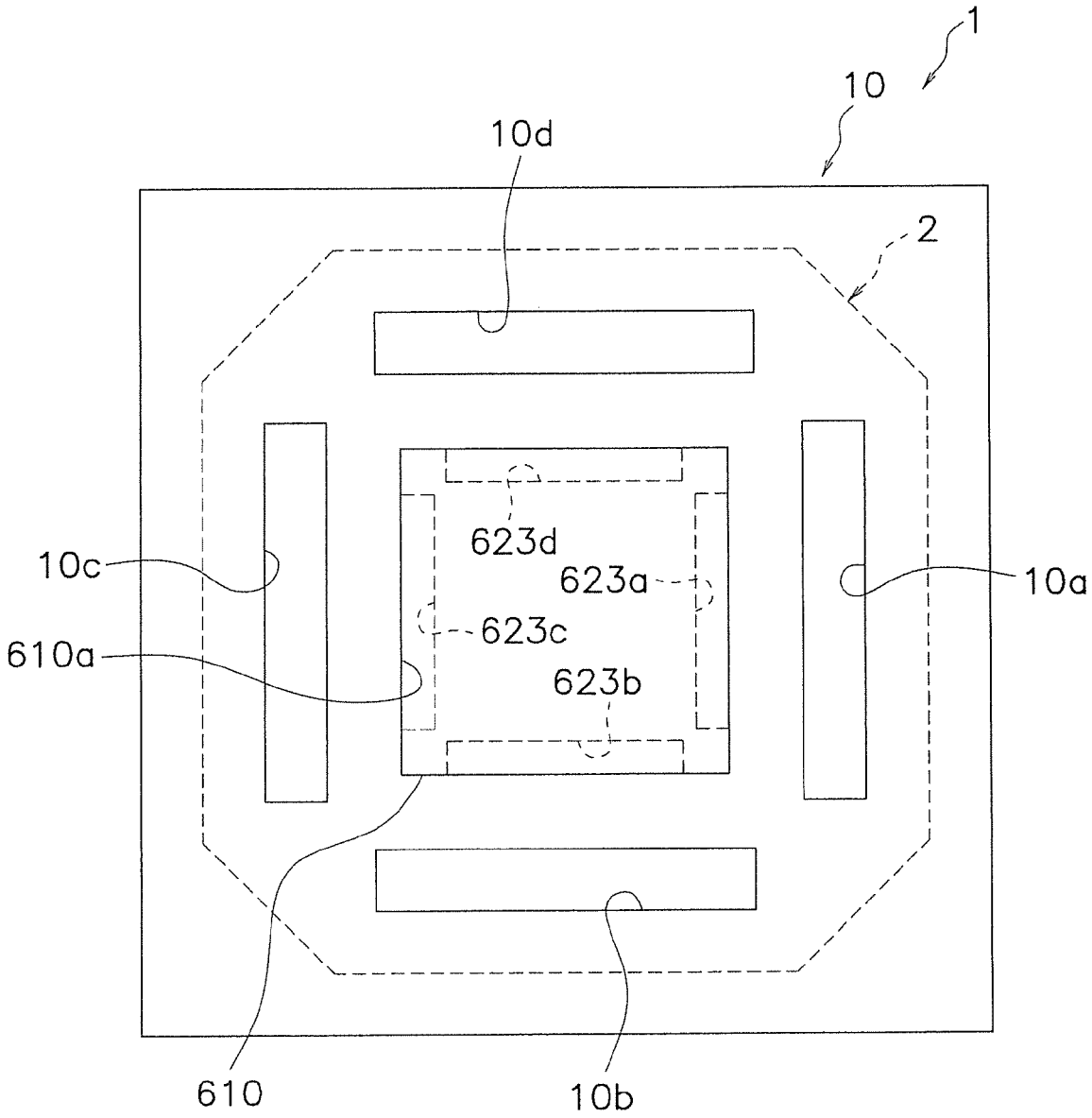
FIG. 36 is a view seen from arrow C of FIG. 35.

Further, as shown in FIG. 35 and FIG. 36, even when the air conditioner 1 where the suction opening 21*a* is formed in the top surface of the casing 2 is installed in a ceiling-embedded configuration, the filters 607*a* to 607*d* may be disposed between the blow fan 3 and the heat exchanger 5 so as to surround the outer periphery of the blow fan 3 when the casing 2 is seen in a plan view. In this case, the filters 607*a* to 607*d* (refer to the filters 607*a* and 607*c* represented by the two-dotted chain lines in FIG. 35) can be taken out from the bottom surface of the casing 2 (more specifically, the blowout panel 10) through the filter takeout holes 623*a* to 623*d* and a central opening 610*a* by removing part of the blowout panel 10 (here, a central panel 610) (refer to the cover members 624*a* and 624*c* and the central panel 610 represented by the two-dotted chain lines in FIG. 35). Here, the central opening 610*a* is an opening that is formed in the blowout panel 10 so as to be communicated with the filter takeout holes 623*a* to 623*d*, and the central panel 610 is a portion that covers the central opening 610*a* and is attachable to and detachable from the portion of the blowout panel 10 on the outer side of the central opening 610*a*. Further, although it is not illustrated here, the filters 607*a* to 607*d* may also be taken out from the bottom surface of the casing 2 through the filter takeout holes 623*a* to 623*d* by removing the entire blowout panel 10 rather than the central panel 610. That is, the filters 607*a* to 607*d* may also be taken out from the bottom surface of the casing 2 by removing at least part of the blowout panel 10.

Figure 37:
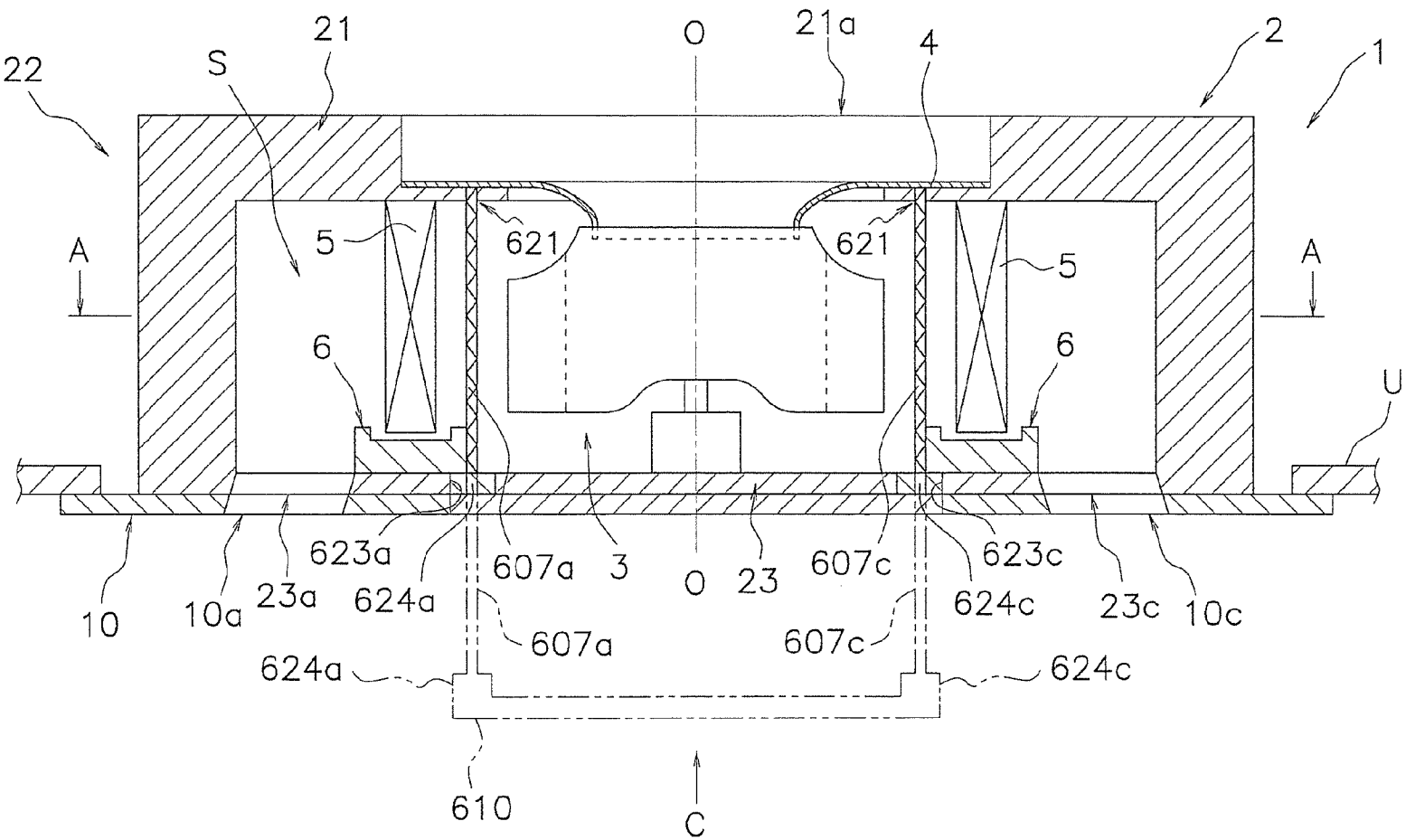
FIG. 37 is a view that corresponds to FIG. 4 and shows a state where the ceiling-mounted air conditioner pertaining to modification 16 of the first embodiment is given a ceiling-embedded configuration.

Further, as shown in FIG. 37, the bottom ends of the filters 607*a* to 607*d* may also be fixed to the top surface of the central panel 610. In this case, the filters 607*a* to 607*d* can be taken out from the bottom surface of the casing 2 (more specifically, the blowout panel 10) at the same time that the central panel 610 is removed (refer to the central panel 610 and the filters 607*a* and 607*c* represented by the two-dotted chain lines in FIG. 37). Further, although it is not illustrated here, the bottom ends of the filters 607*a* to 607*d* may also be fixed to the top surface of the blowout panel 10 when the entire blowout panel 10 is configured to be removed rather than the central panel 610. In this manner, the filters 607*a* to 607*d* can be taken out through the bottom surface of the casing 2 in conjunction with the removal of at least part of the blowout panel 10.

It will be noted that, although it is not illustrated here, even when the suction opening 21*b* is formed in the side surface of the casing 2 as in the air conditioner 1 pertaining to modification 1 (see FIG. 6), the air conditioner 1 may be given a structure where the filters 607*a* to 607*d* can be taken out from the bottom surface of the casing 2 by disposing the filters 607*a* to 607*d* between the blow fan 3 and the heat exchanger 5.

(21) Modification 17

Figure 38:
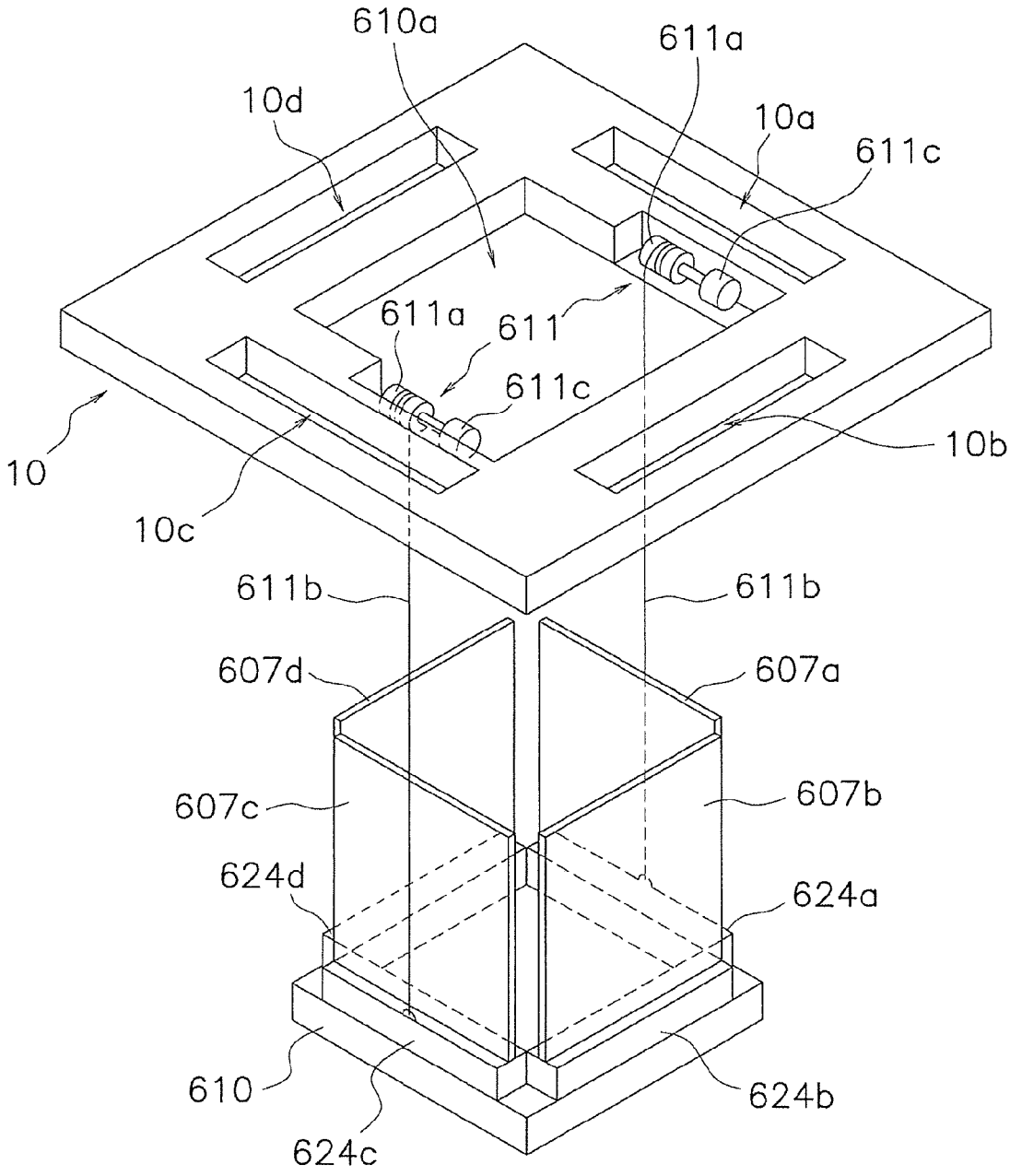
FIG. 38 is a perspective view describing a mechanism for automatically raising and lowering part of a blowout panel pertaining to modification 17 of the first embodiment.
Figure 39:
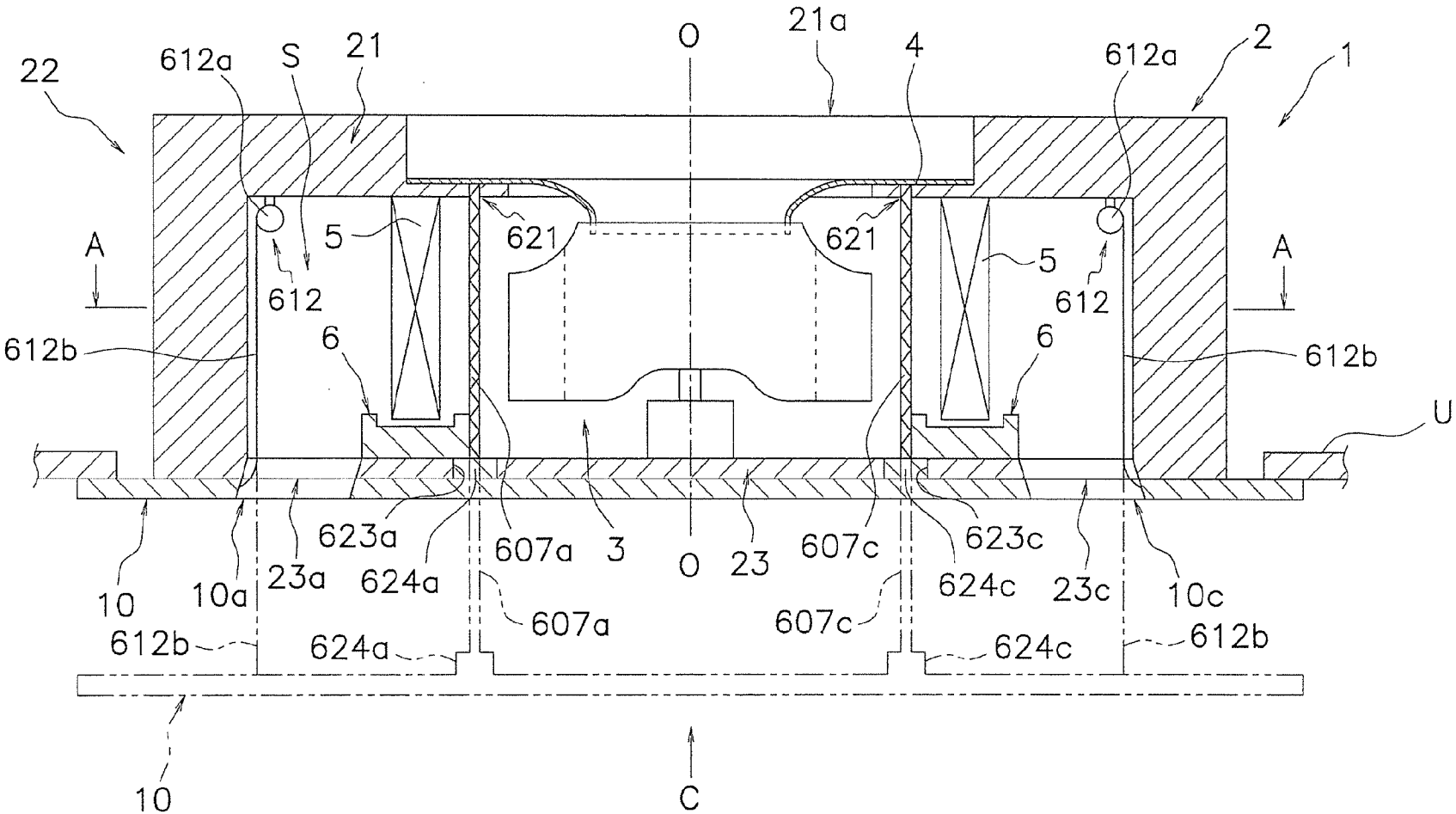
FIG. 39 is a view that corresponds to FIG. 4 and shows a state where a ceiling-mounted air conditioner pertaining to modification 17 of the first embodiment is given a ceiling-embedded configuration.

In a configuration where the filters 607*a* to 607*d* are capable of being taken out through the bottom surface of the casing 2 in conjunction with the removal of at least part of the blowout panel 10 as in the air conditioner 1 installed in a ceiling-embedded mode described in the preceding modification 16 (e.g., see FIG. 37), at least part of the blowout panel 10 may be given an automatically raisable and lowerable configuration as shown in FIG. 38 and FIG. 39, so that the filters 607*a* to 607*d* are raised and lowered in conjunction with the raising and lowering of at least part of the blowout panel 10.

First, a case will be described where there is disposed a configuration that enables the central panel 610 that is part of the blowout panel 10 shown in FIG. 38 to be automatically raisable and lowerable. A pulley 611*a*, around which a connection member 611*b* such as a wire is wound, is disposed respectively between the central opening 610*a* and the panel blowout opening 10*a* in the blowout panel 10 and between the central opening 610*a* and the panel blowout opening 10*c* in the blowout panel 10, and the pulleys 611*a* are driven to rotate by hoisting motors 611*c*. Additionally, each of the connection members 611*b* is coupled to the central panel 610 and can automatically raise and lower the central panel 610 as a result of the pulleys 611*a* being driven to rotate by the hoisting motors 611*c*. That is, panel raising and lowering mechanisms 611 are configured by the pulleys 611*a*, the connection members 611*b* and the hoisting motors 611*c*. The filters 607*a* to 607*d* are raised and lowered in conjunction with the raising and lowering of the central panel 610 by the panel raising and lowering mechanisms 611.

Next, a case will be described where there is disposed a configuration that enables the entire blowout panel 10 shown in FIG. 39 to be automatically raisable and lowerable. Pulleys 612*a*, around which connection members 612*b* such as wires are wound, are disposed in the top surface or the side surface of the casing 2 (here, in positions in the top plate 21 that configures the top surface that face the panel blowout openings 10*a* and 10*c*), and the pulleys 612*a* are driven to rotate by hoisting motors (not shown). Additionally, the connection members 612*b* are coupled to the blowout panel 10 and can automatically raise and lower the entire blowout panel 10 as a result of the pulleys 612*a* being driven to rotate by the hoisting motors. That is, panel raising and lowering mechanisms 612 are configured by the pulleys 612*a*, the connection members 612*b* and the hoisting motors. The filters 607*a* to 607*d* are raised and lowered in conjunction with the raising and lowering of the blowout panel 10 by the panel raising and lowering mechanisms 612.

In this manner, in the air conditioner 1 in the present modification, at least part of the blowout panel 10 is automatically raised and lowered, and the filters 607*a* to 607*d* are raised and lowered in conjunction with the raising and lowering of the at least part of the blowout panel 10, so the filters 607*a* to 607*d* can be lowered while work in a high place is avoided.

Second Embodiment (1) Basic Configuration of Ceiling-mounted Air Conditioner

Figure 40:
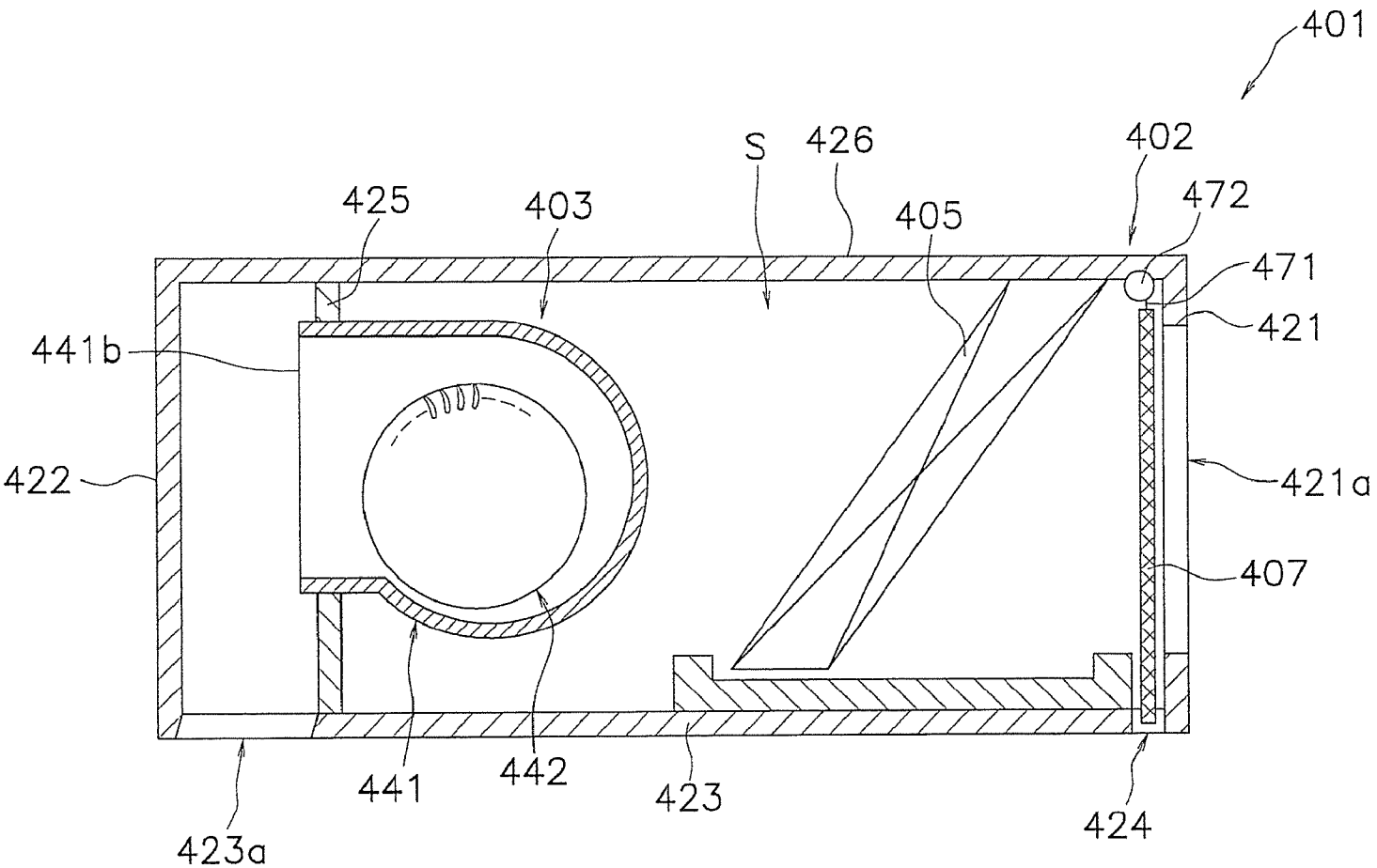
FIG. 40 is a general side sectional view (with a ceiling being omitted) of a ceiling-mounted air conditioner pertaining to a second embodiment of the present invention.

The preceding first embodiment and its modifications were of the ceiling-mounted air conditioner 1 of a configuration disposed with the casing 2 in whose top surface or side surface is formed a suction opening, the blow fan 3 that comprises a turbo fan or a diagonal flow fan disposed inside the casing 2, and the heat exchanger 5 that is disposed inside the casing 2, but as shown in FIG. 40, the invention may also be an air conditioner 401 disposed with a configuration where a blow fan 403 that comprises a sirocco fan and a heat exchanger 405 are housed inside a casing 402 in whose side surface is formed a suction opening 421*a* and in whose bottom surface is formed a blowout opening 423*a*. Below, the basic configuration of the air conditioner 401 of the present embodiment will be described.

The casing 402 is a substantially rectangular box-like member that houses the heat exchanger 405 and the blow fan 403 inside, with the suction opening 421*a* being formed in a side plate 421 (the side plate on the right side of the page of FIG. 40) of the casing 402 and the blowout opening 423*a* being formed in a bottom plate 423 of the casing 402. The blowout opening 423*a* is formed in a portion of the bottom plate 423 that is in proximity to a side plate 422 (the side plate on the left side of the page of FIG. 40) that faces the side plate 421 in which the suction opening 421*a* is formed. Here, the suction opening 421*a* and the blowout opening 423*a* are substantially rectangular openings. In this manner, an air flow path S that leads from the suction opening 421*a* that is formed in the side surface (specifically, the side plate 421) of the casing 402 to the bottom surface (specifically, the bottom plate 423) of the casing 402 is formed inside the casing 402. Further, a guide opening 424 is formed in a portion of the bottom plate 423 that is in proximity to the side plate 421. The guide opening 424 functions as a filter guide portion that holds a later-described filter 407 such that the filter 407 is movable up and down.

The heat exchanger 405 is disposed on the suction opening 421*a* side in the air flow path S and is a device for heating or cooling air that has been sucked in from the suction opening 421*a*. In the present embodiment, the heat exchanger 405 is a cross fin heat exchanger panel that includes numerous fins that are made of aluminum and formed in substantially rectangular shapes and heat transfer tubes that penetrate these fins in a horizontal direction, and the heat exchanger 405 is disposed such that its upper portion slants diagonally toward the suction opening 421*a*. Additionally, a drain pan 406 is disposed below the heat exchanger 405 so that condensation water generated by the heat exchanger 405 can be received.

The blow fan 403 is disposed closer to the blowout opening 423*a* than the heat exchanger 405 in the air flow path S and is a device for sucking in air that has passed through the heat exchanger 405, boosting the pressure of the air, and blowing out the air from the blowout opening 423*a*. In the present embodiment, the blow fan 403 is a sirocco fan and includes a scroll casing 441 that has a scroll-shaped cross section, an impeller 442 that is disposed inside the scroll casing 441, and a fan motor (not shown) that drives the impeller 442 to rotate. Additionally, a partition plate 425 that divides the space inside the casing 402 into a space on the side of the heat exchanger 405 and the blow fan 403 and a space on the side of the blowout opening 423*a* is disposed inside the casing 402, so that just air that is blown out from an outlet 441*b* in the scroll casing 441 can be sent to the space on the side of the blowout opening 423*a*.

In the air conditioner 401 configured in this manner, a cooling medium or a heating medium is caused to circulate in the heat exchanger 405 and the blow fan 403 is driven to rotate, whereby air can be sucked inside the casing 402 from the suction opening 421*a* in the side surface of the casing 402, be heated or cooled as a result of being passed through the heat exchanger 405, thereafter have its pressure boosted by the blow fan 403, and be blown out from the blowout opening 423*a* in the bottom surface of the casing 402.

Figure 41:
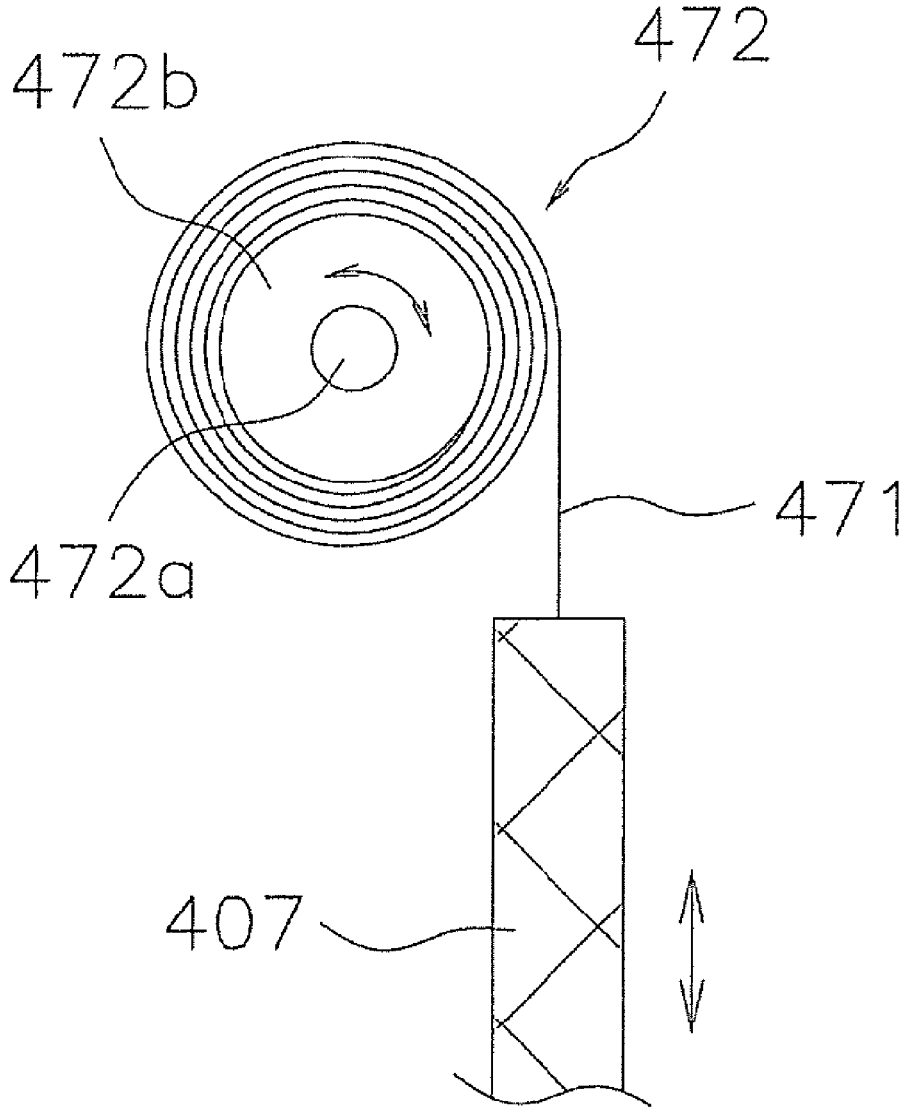
FIG. 41 is a general cross-sectional view showing the structure of a take-up mechanism.

Further, a filter 407 that traps dust in the air that is sucked in from the suction opening 421*a* is disposed in the suction opening 421*a*. The filter 407 is, for example, configured by a frame member that comprises a soft resin material and a net-like member that is formed integrally with the frame member, and the filter 407 has flexibility and elasticity. The end portion of the filter 407 near a top plate 426 is, as shown in FIG. 40 and FIG. 41, connected to a connection member 471 such as a plate or a wire that has the same degree of elasticity and rigidity as the filter 407, and the connection member 471 is taken up by a take-up mechanism 472 that is disposed in a portion of the top plate 426 near the side plate 421. The take-up mechanism 472 includes a shaft portion 472*a* that is supported on the casing 402 (specifically, the top plate 426) such that the shaft portion 472*a* may freely rotate, a roller 472*b* that is fitted over the outer periphery of the shaft portion 472*a*, and a take-up motor (not shown) that drives the shaft portion 472*a* to rotate. The other end of the connection member 471 (that is, the end portion on the opposite side of the end portion connected to the end portion of the filter 407 near the side plate 422) is connected to the roller 472*b*. In this take-up mechanism 472, when the shaft portion 472*a* is driven to rotate clockwise in FIG. 41 by the take-up motor, the connection member 471 is fed out from the roller 472*b*, so the filter 407 moves toward the bottom plate 423 in accompaniment therewith. Conversely, when the shaft portion 472*a* is driven to rotate counter-clockwise in FIG. 41 by the take-up motor, the connection member 471 is taken up onto the roller 472*b*, so the filter 407 moves toward the top plate 426 in accompaniment therewith. Here, the end portion of the filter 407 near the bottom plate 423 (that is, the end portion on the opposite side of the end portion connected to the connection member 471) is inserted as far as the inside of the guide opening 424 that serves as a filter guide portion in a state where the connection member 471 is taken up onto the roller 472*b*, and when the connection member 471 is fed out from the roller 472*b* by the driving of the take-up motor, the filter 407 is caused to automatically move downward through the guide opening 424, so that when cleaning of the filter 407 is to be performed, for example, the filter 407 can be lowered as far as a position reachable by the hands of a worker, and cleaning of the filter 407 can be performed thereafter. Additionally, after cleaning of the filter 407 has been performed, the connection member 471 is caused to be taken up onto the roller 472*b* by the driving of the take-up motor, whereby the filter 407 can again be installed in the suction opening 421*a*. In this manner, the connection member 471 and the take-up mechanism 472 function as a filter drive mechanism for automatically causing the filter 407 to move downward through the guide opening 424.

(2) When Given a Ceiling-suspended Configuration

Figure 42:
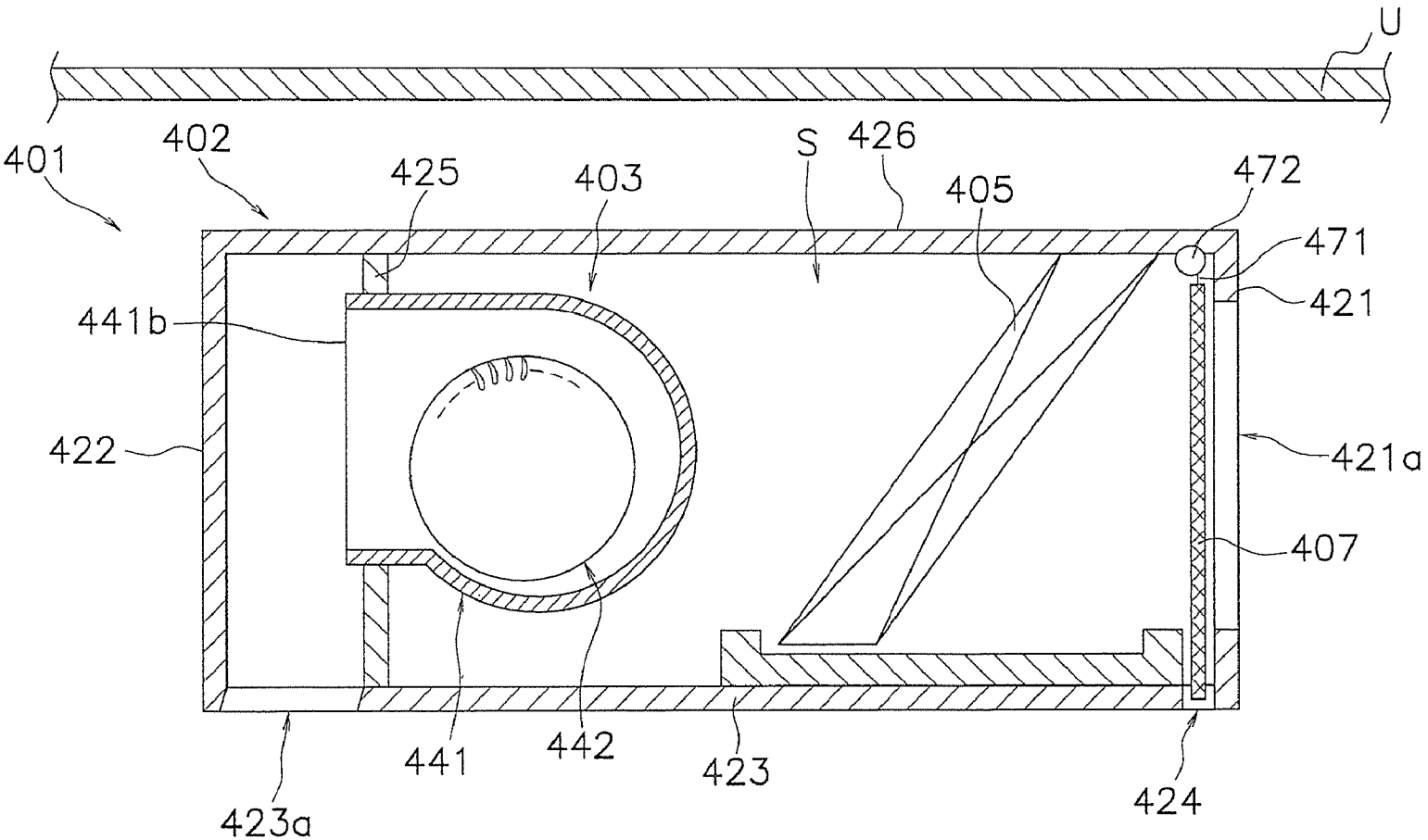
FIG. 42 is a view that corresponds to FIG. 1 and shows a state where the ceiling-mounted air conditioner pertaining to the second embodiment is given a ceiling-suspended configuration.

When the ceiling-mounted air conditioner 401 is given a configuration where it is suspended from a ceiling surface U in an air-conditioned room and installed (called a "ceiling-suspended configuration" below), as shown in FIG. 42, the air conditioner 401 is installed such that there is a clearance between the ceiling surface U and the casing 402 (specifically, the top plate 426).

In the air conditioner 401 that has been installed in a ceiling-suspended configuration in this manner, air in the air-conditioned room is sucked in from the suction opening 421*a* that is formed in the side surface (that is, the side plate 421) of the casing 402, passes through the heat exchanger 405 and the blow fan 403 that are disposed in the air flow path S, is heated or cooled, and is thereafter blown out from the blowout opening 423*a* that is formed in the bottom surface (that is, the bottom plate 423) of the casing 402. For this reason, it becomes more difficult, in comparison to when both the suction opening and the blowout openings are formed in the bottom surface of the casing 402, for the phenomenon (that is, the short circuiting of air flow phenomenon) to occur where air that is blown out from the blowout opening ends up being sucked back inside the casing from the suction opening immediately after being blown out.

Further, when the air conditioner 401 is given a ceiling-suspended configuration and cleaning of the filter 407 is to be performed, the take-up motor of the take-up mechanism 472 is driven, whereby the filter 407 can be automatically caused to move downward through the guide opening 424 (refer to the filter 407 and the connection member 471 represented by the two-dotted chain lines in FIG. 42).

(3) When Given a Ceiling-embedded Configuration

Figure 43:
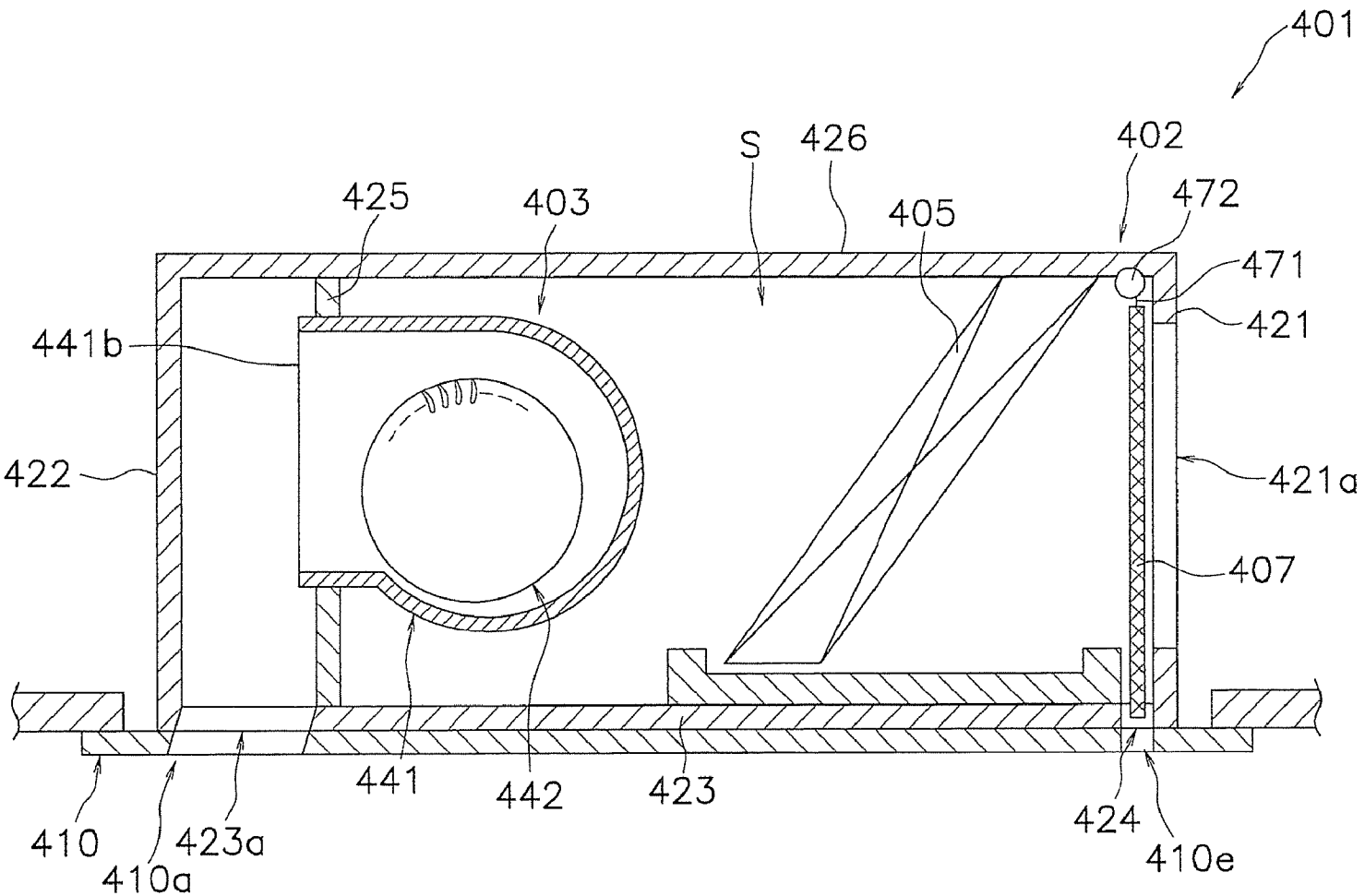
FIG. 43 is a view that corresponds to FIG. 1 and shows a state where the ceiling-mounted air conditioner pertaining to the second embodiment is given a ceiling-embedded configuration.

When the ceiling-mounted air conditioner 401 is given a configuration where the portion excluding the bottom surface of the casing 402 is installed in a space on the backside of a ceiling of an air-conditioned room (called a "ceiling-embedded configuration" below), as shown in FIG. 43, the air conditioner 401 is installed such that the casing 402 is fitted into an opening in the ceiling surface U, and a thin blowout panel 410, in which are formed a panel blowout opening 410*a* and a guide opening 410*e* that face the blowout opening 423*a* and the guide opening 424 in the bottom surface of the casing 402, is attached to the bottom surface of the casing 402 so as to cover from below a gap between the opening in the ceiling surface U and the casing 402.

In the air conditioner 401 that has been installed in a ceiling-embedded configuration in this manner, air in the space on the backside of the ceiling is sucked in from the suction opening 421*a* that is formed in the side surface (that is, the side plate 421) of the casing 402, passes through the heat exchanger 405 and the blow fan 403 that are disposed in the air flow path S, is heated or cooled, and is thereafter blown out from the blowout opening 423*a* that is formed in the bottom surface (that is, the bottom plate 423) of the casing 402 and the panel blowout opening 410*a* that is communicated with this blowout opening. That is, a ceiling chamber air conditioner that uses the space on the backside of the ceiling as an air supply chamber can be configured.

Further, when the air conditioner 401 is given a ceiling-embedded configuration and cleaning of the filter 407 is to be performed, the take-up motor of the take-up mechanism 472 is driven, whereby the filter 407 can be automatically caused to move downward through the guide opening 424 and the guide opening 410*a* (refer to the filter 407 and the connection member 471 represented by the two-dotted chain lines in FIG. 43).

(4) Characteristics of Air Conditioner of Present Embodiment

In the air conditioner 401 of the present embodiment also, similar to the air conditioner 1 pertaining to the first embodiment and its modifications, it can be made difficult for short circuiting of air flow to occur because the air conditioner 401 is configured such that air is sucked in from the side surface (that is, the side plate 421) of the casing 402 and air is blown out from the bottom surface (that is, the bottom plate 423) of the casing 402. Further, when the air conditioner 401 is used in a ceiling-embedded configuration, the suction opening 421*a* is disposed in a space on the backside of a ceiling, and the blowout opening 423*a* is disposed in an indoor space, so a ceiling chamber air conditioner that uses the space on the backside of the ceiling as an air supply chamber can be configured. Moreover, because a suction opening is not present in the bottom surface of the casing 402, a ceiling-embedded configuration can be configured simply by attaching the thin blowout panel 410, in which is formed just a blowout opening that is communicated with the blowout opening 423*a* in the casing 402, to the bottom surface of the casing 402.

Further, in the air conditioner 401 of the present embodiment, the guide opening 424 that serves as a filter guide portion that holds the filter 407 such that the filter 407 is movable between the suction opening 421*a* and the bottom surface of the casing 402 is disposed in the casing 402, so the filter 407 can be easily attached and detached during cleaning even though the air conditioner has a configuration where the suction opening 421*a* is disposed in the side surface of the casing 402.

Moreover, the connection member 471 and the take-up mechanism 472 that serve as a filter drive mechanism for automatically causing the filter 407 to move downward through the guide opening 424 are disposed in the casing 402, so the filter 407 can be lowered while work in a high place is avoided.

(5) Modification 1

Figure 44:
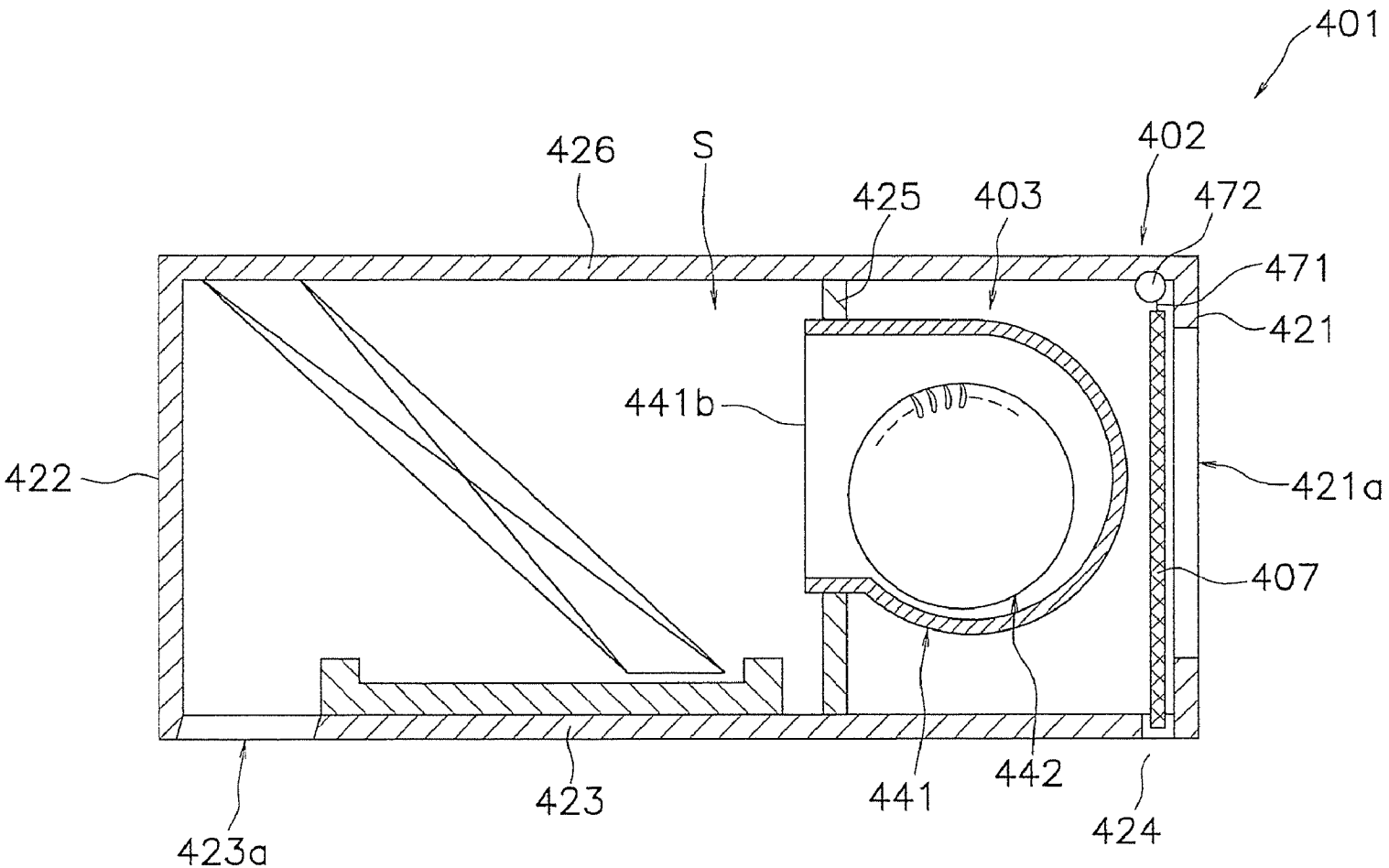
FIG. 44 is a general side sectional view (with a ceiling being omitted) of a ceiling-mounted air conditioner pertaining to modification 1 of the second embodiment.

In the air conditioner 401 pertaining to the preceding embodiment, the heat exchanger 405 is disposed closer to the suction opening 421*a* than the blow fan 403 in the air flow path S, but as shown in FIG. 44, the heat exchanger 405 may also be disposed closer to the blowout opening 423*a* than the blow fan 403. In this case, in order to avoid interference with the blowout opening 423*a*, the heat exchanger 405 is disposed such that its upper portion slants diagonally toward the side plate 422, and the partition plate 425 is disposed so as to divide the space inside the casing 402 into a space on the side of the blow fan 403 and a space on the side of the heat exchanger 405 and the blowout opening 423 a, so that just air that is blown out from the outlet 441*b* of the scroll casing 441 can be sent to the space on the side of the heat exchanger 405 and the blowout opening 423*a*.

In the air conditioner 401 configured in this manner, a cooling medium or a heating medium is caused to circulate in the heat exchanger 405 and the blow fan 403 is driven to rotate, whereby air can be sucked inside the casing 402 from the suction opening 421*a* in the side surface of the casing 402, has its pressure boosted by the blow fan 403, thereafter be heated or cooled as a result of being passed through the heat exchanger 405, and be blown out from the blowout opening 423*a* in the bottom surface of the casing 402.

In the air conditioner 401 pertaining to the present modification also, the same action and effects as those of the preceding embodiment can be obtained.

(6) Modification 2

In the air conditioner 401 pertaining to the preceding embodiment and modification 1, a cross fin heat exchanger panel is used as the heat exchanger 405, but similar to modification 5 of the first embodiment, instead of this, a stacked heat exchanger may also be used as the heat exchanger 405.

(7) Modification 3

In the air conditioner 401 pertaining to the preceding embodiment and modifications 1 and 2, the connection member 471 and the take-up mechanism 472 that serve as a filter drive mechanism for automatically causing the filter 407 to move downward through the guide opening 424 are disposed, but similar to modification 6 of the first embodiment, instead of this, a filter drive mechanism for manually causing the filter 407 to move downward may also be disposed (see FIG. 15 and FIG. 16).

(8) Modification 4

In the air conditioner 401 pertaining to the preceding embodiment and modifications 1 to 3, a configuration is employed where, with the purpose of cleaning and reusing the filter, cleaning is performed by pulling out and removing the filter from the bottom surface of the casing 402, but similar to modification 10 of the first embodiment, a take-up filter may also be employed and, without performing cleaning of the filter, replaced with a new take-up filter just when taking-up of the filter ends (see FIG. 21).

(9) Modification 5

Taking into consideration a case where the air conditioner 401 pertaining to the preceding embodiment and modifications 1 to 4 is installed in a ceiling-embedded configuration in a grid system ceiling, similar to modification 12 of the first embodiment, the blowout panel 410 that is attached to the bottom surface of the casing 402 may also be given a size that is capable of being housed inside a rectangular frame formed by T bars (see FIG. 23 and FIG. 24).

Other Embodiments

Embodiments of the present invention have been described above on the basis of the drawings, but the specific configurations thereof are not limited to these embodiments and their modifications and are alterable in a range that does not depart from the gist of the invention.

For example, in the first embodiment and its modifications, an example has been described where the present invention is applied to a so-called four-direction blowing ceiling-mounted air conditioner, but the present invention is not limited to this and can also be applied to other ceiling-mounted air conditioners such as a two-direction blowing ceiling-mounted air conditioner.

INDUSTRIAL APPLICABILITY

By utilizing the present invention, it can be made difficult for short circuiting of air flow to occur in a ceiling-mounted air conditioner where a blowout opening is disposed in a bottom surface of a casing.

What is claimed is:

1. An air conditioner being installable in a ceiling, the air conditioner comprising:

a casing having a top portion with a suction opening being formed therein, and a bottom surface with blowout openings being formed therein, an air flow path leading from the suction opening to the blowout openings;

a blow fan being disposed in the air flow path; and a heat exchanger being disposed in the air flow path, the blowout openings being formed along an outer peripheral edge of the bottom surface of the casing, the air flow path including a blowout flow path through which air that has passed through the heat exchanger flows toward the blowout openings, the blowout flow path being a part of the air flow path from a downstream side of the heat exchanger to the blowout opening, and an expanded flow path that expands toward an inner peripheral side when the casing is seen in a plan view being formed in the blowout flow path.

2. The air conditioner of claim 1, further comprising a blowout panel that is attached to the bottom surface of the casing and in which are formed panel blowout openings that face the blowout openings, wherein when the ceiling is a grid system ceiling, the blowout panel is configured to be housed inside a frame of the grid system ceiling.

3. The air conditioner of claim 1, wherein the blow fan is a turbo fan, and the heat exchanger is disposed on a downstream side of the blow fan in the air flow space.

4. The air conditioner of claim 1, wherein the blow fan is a diagonal flow fan, and the heat exchanger is disposed on a downstream side of the blow fan in the air flow path.

5. The air conditioner of claim 3, further comprising a plurality of heat exchangers disposed on an outer peripheral side of the blow fan when the casing is seen in a plan view.

6. The air conditioner of claim 5, wherein the heat exchangers are slantingly disposed when the casing is seen in a side view.

7. The air conditioner of claim 1, further comprising a flow path area changing mechanism being configured to change a flow path area of the expanded flow path.

8. The air conditioner of claim 7, wherein the flow path area changing mechanism is controlled such that the flow path area of the expanded flow path becomes large during a cooling operation and such that the flow path area of the expanded flow path becomes small during a heating operation.

9. The air conditioner of claim 1, wherein the heat exchanger is a stacked heat exchanger.

10. The air conditioner of claim 1, wherein a heat medium used in the heat exchanger is water.

11. The air conditioner of claim 1, wherein a filter is disposed in the suction opening, and a filter guide portion that holds the filter such that the filter is movable between the suction opening and the bottom surface of the casing is disposed in the casing.

12. The air conditioner of claim 11, wherein a filter drive mechanism that manually causes the filter to move downward through the filter guide portion is disposed in the casing.

13. The air conditioner of claim 1, wherein a take-up filter is disposed in the suction opening.

14. The air conditioner of claim 1, further comprising filters that trap dust included in air that is sucked in from the suction opening, wherein the heat exchanger is disposed on a downstream side of the blow fan in the air flow space, and the filters are disposed between the blow fan and the heat exchanger.

15. The air conditioner of claim 1, wherein the inner peripheral side is disposed inward of an outer peripheral edge of the heat exchanger.

16. An air conditioner being installable in a ceiling, the air conditioner comprising:

a casing having a top surface or side surface with a suction opening being formed therein;

a blow fan being disposed inside the casing;

a heat exchanger being disposed inside the casing; and a blowout panel being attached to a bottom surface of the casing and in which panel blowout openings are formed along an outer peripheral edge of the bottom surface of the casing, air being sucked in from the suction opening passing through an air flow path leading from the suction opening to the panel blowout openings and being blown out from the panel blowout openings, the air flow path including a blowout flow path through which air that has passed through the heat exchanger flows toward the panel blowout openings, the blowout flow path being a part of the air flow path from a downstream side of the heat exchanger to the blowout opening, and the blowout flow path including an expanded flow path that expands toward an inner peripheral side when the casing is seen in a plan view.

17. The air conditioner of claim 16, wherein when the ceiling is a grid system ceiling, the blowout panel is configured to be housed inside a frame of the grid system ceiling.

18. The air conditioner of claim 16, wherein
the expanded flow path is formed in a bottom portion of the casing.

19. The air conditioner of claim 16, wherein
the expanded flow path is formed in the blowout panel.

20. The air conditioner of claim 16, wherein
the inner peripheral side is disposed inward of an outer peripheral edge of the heat exchanger.

21. An air conditioner being installable in a ceiling, the air conditioner comprising:
a casing having a top portion with a suction opening being formed therein, and a bottom surface with blowout openings being formed therein, an air flow path leading from the suction opening to the blowout openings;
a blow fan being disposed in the air flow path;
a heat exchanger being disposed in the air flow path;
a filter disposed in the suction opening,
a filter guide portion holding the filter such that the filter is movable between the suction opening and the bottom surface of the casing, the filter guide portion being disposed in the casing; and
a filter drive mechanism that automatically causes the filter to move downward through the filter guide portion, the filter drive mechanism being disposed in the casing.

22. An air conditioner being installable in a ceiling, the air conditioner comprising:
a casing having a top portion with a suction opening being formed therein, and a bottom surface with blowout openings being formed therein, an air flow path leading from the suction opening to the blowout openings;
a blow fan being disposed in the air flow path;
a heat exchanger being disposed in the air flow path;
a filter disposed in the suction opening;
a cleaning mechanism that removes dust that the filter has trapped from the filter; and
a dust box that collects dust removed by the cleaning mechanism.

23. The air conditioner of claim 22, wherein
a dust box drive mechanism that automatically causes the dust box to move downward is disposed in the casing.

24. The air conditioner of claim 22, wherein
a dust box drive mechanism that manually causes the dust box to move downward is disposed in the casing.

25. The air conditioner of claim 22, wherein
a nozzle insertion opening which is configured to receive a nozzle of a vacuum cleaner by insertion, is formed facing down in the dust box.

26. The air conditioner of claim 25, wherein
an open/close lid that opens as a result of a nozzle of a vacuum cleaner being inserted into the nozzle insertion opening is disposed in the nozzle insertion opening.

27. The air conditioner of claim 26, wherein
the open/close lid closes by its own weight.

28. The air conditioner of claim 25, wherein
a valve that includes a material that is elastically deformable by a suction force of a vacuum cleaner is disposed in the dust box.

29. The air conditioner of claim 22, wherein
the dust box is disposed in a side portion of the casing.

30. An air conditioner being installable in a ceiling, the air conditioner comprising:
a casing having a top portion with a suction opening being formed therein, and a bottom surface with blowout openings being formed therein, an air flow path leading from the suction opening to the blowout openings;
a blow fan being disposed in the air flow path;
a heat exchanger being disposed in the air flow path, the heat exchanger being disposed on a downstream side of the blow fan in the air flow space;
filters that trap dust included in air that is sucked in from the suction opening, the filters being disposed between the blow fan and the heat exchanger; and
a blowout panel attached to the bottom surface of the casing and in which are formed panel blowout openings that face the blowout openings,
the filters being configured to be taken out through the bottom surface of the casing in conjunction with removal of at least part of the blowout panel when the at least part of the blowout panel is removed from the casing.

31. The air conditioner of claim 30, wherein
at least part of the blowout panel is automatically raisable and lowerable, and
the filters are raised and lowered in conjunction with the raising and lowering of the at least part of the blowout panel.

* * * * *